US006557310B2

(12) United States Patent
Marshall et al.

(10) Patent No.: US 6,557,310 B2
(45) Date of Patent: May 6, 2003

(54) INTERIOR SPACE-DIVIDING WALL SYSTEM

(75) Inventors: Dale R. Marshall, Calgary (CA); Darren R. Long, Calgary (CA); Rodney Vallas, Calgary (CA); Jim Thompson Goodchild, Calgary (CA); Robert E. Steeves, Calgary (CA)

(73) Assignee: Smed International, Inc., Alberta (CA)

( * ) Notice: Subject to any disclaimer, the term of this patent is extended or adjusted under 35 U.S.C. 154(b) by 59 days.

(21) Appl. No.: 09/875,263

(22) Filed: Jun. 6, 2001

(65) Prior Publication Data

US 2002/0017066 A1 Feb. 14, 2002

Related U.S. Application Data

(60) Provisional application No. 60/210,819, filed on Jun. 9, 2000.

(51) Int. Cl.[7] ..... E04B 2/00; E04B 2/74

(52) U.S. Cl. ..... 52/220.1; 52/220.7; 52/36.6

(58) Field of Search ..... 52/220.1, 250.7, 52/36.1, 36.6, 239

(56) References Cited

U.S. PATENT DOCUMENTS

| | | | | |
|---|---|---|---|---|
| 3,686,805 A | | 8/1972 | Pofferi | |
| 3,999,353 A | | 12/1976 | Dielman | |
| 4,224,769 A | | 9/1980 | Ball et al. | |
| 4,404,776 A | | 9/1983 | Ball et al. | |
| 4,631,881 A | | 12/1986 | Charman | |
| 4,685,255 A | | 8/1987 | Kelley | |
| 4,730,740 A | | 3/1988 | Winter et al. | |
| 4,771,583 A | | 9/1988 | Ball et al. | |
| 4,821,477 A | | 4/1989 | Rydqvist | |
| 4,831,791 A | | 5/1989 | Ball | |
| 4,833,848 A | | 5/1989 | Guerin | |
| 4,876,835 A | | 10/1989 | Kelley et al. | |
| 4,944,122 A | | 7/1990 | Wendt | |
| 5,038,539 A | | 8/1991 | Kelley et al. | |
| 5,048,698 A | | 9/1991 | Konrad | |
| 5,094,053 A | | 3/1992 | Militzer | |
| 5,155,955 A | | 10/1992 | Ball et al. | |
| 5,277,005 A | | 1/1994 | Hellwig et al. | |
| 5,309,686 A | | 5/1994 | Underwood et al. | |
| 5,549,379 A | | 8/1996 | Jun et al. | |
| 5,634,300 A | * | 6/1997 | Huebner et al. | 52/36.1 |
| 5,740,650 A | | 4/1998 | Seiber et al. | |
| 5,746,034 A | | 5/1998 | Luchetti et al. | |
| 5,802,789 A | | 9/1998 | Goodman et al. | |
| 5,852,904 A | | 12/1998 | Yu et al. | |
| 5,931,429 A | | 8/1999 | Hellwig et al. | |
| 5,979,118 A | * | 11/1999 | Gortsema et al. | 52/36.1 |
| 6,000,180 A | | 12/1999 | Goodman et al. | |
| 6,463,701 B1 | * | 10/2002 | Baloga et al. | 52/36.1 X |
| 6,481,168 B1 | * | 11/2002 | Hodges et al. | 52/220.7 |

FOREIGN PATENT DOCUMENTS

| | | |
|---|---|---|
| CA | 2 075 014 | 2/1993 |

* cited by examiner

*Primary Examiner*—Robert W. Gibson, Jr.
(74) *Attorney, Agent, or Firm*—Flynn, Thiel, Boutell & Tanis, P.C.

(57) ABSTRACT

A wall system and particularly a load-bearing spine wall defined by rigidly connected spine panels which are usable in conjunction with and connectable to branch panels for defining workstations. These spine panels include an interior frame having plural hollow cross beams rigidly joined between parallel uprights. The cross beams have elongate slots extending lengthwise along the sidewalls thereof. Each side of the frame permits one or more removable covering tiles to be attached thereto for defining the exterior surface of the spine panel. Load-bearing components having cantilevered hangers can be engaged within the elongate slots which extend lengthwise of the cross beams. Vertically adjacent tiles have longitudinal edges spaced to define a narrow elongate passage therebetween which aligns with the mouth of a respectively adjacent hanger-accommodating slot.

15 Claims, 37 Drawing Sheets

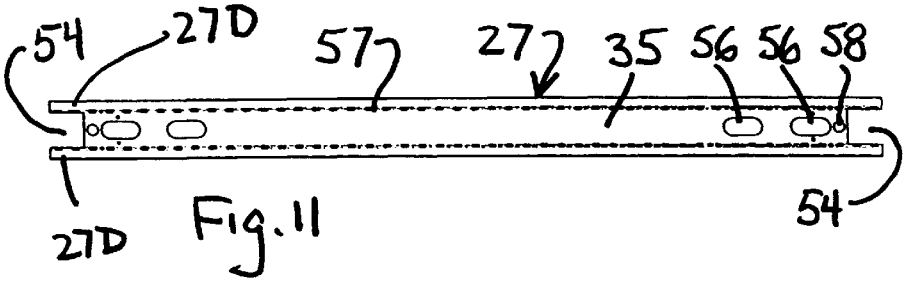
Fig. 11
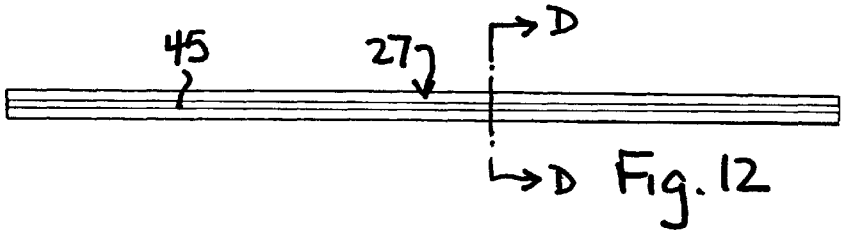
Fig. 12
Fig. 14
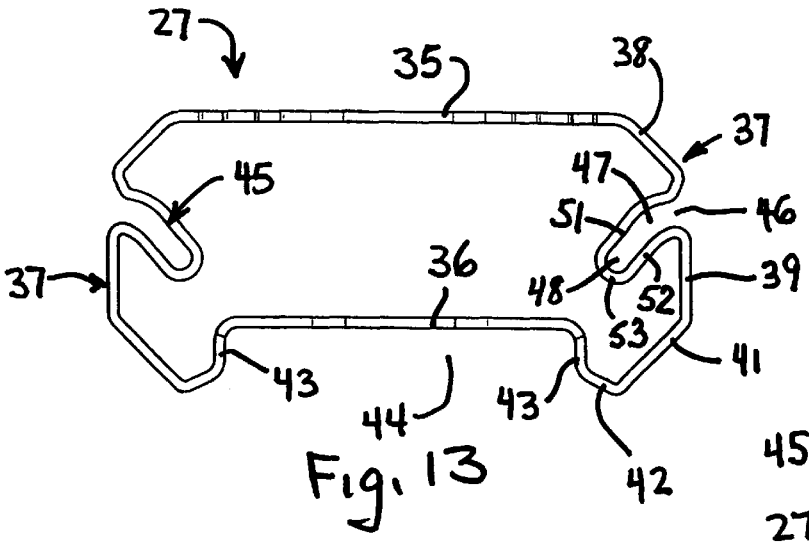
Fig. 13
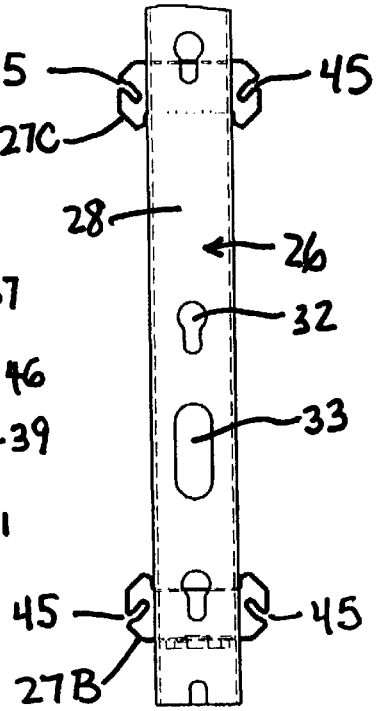

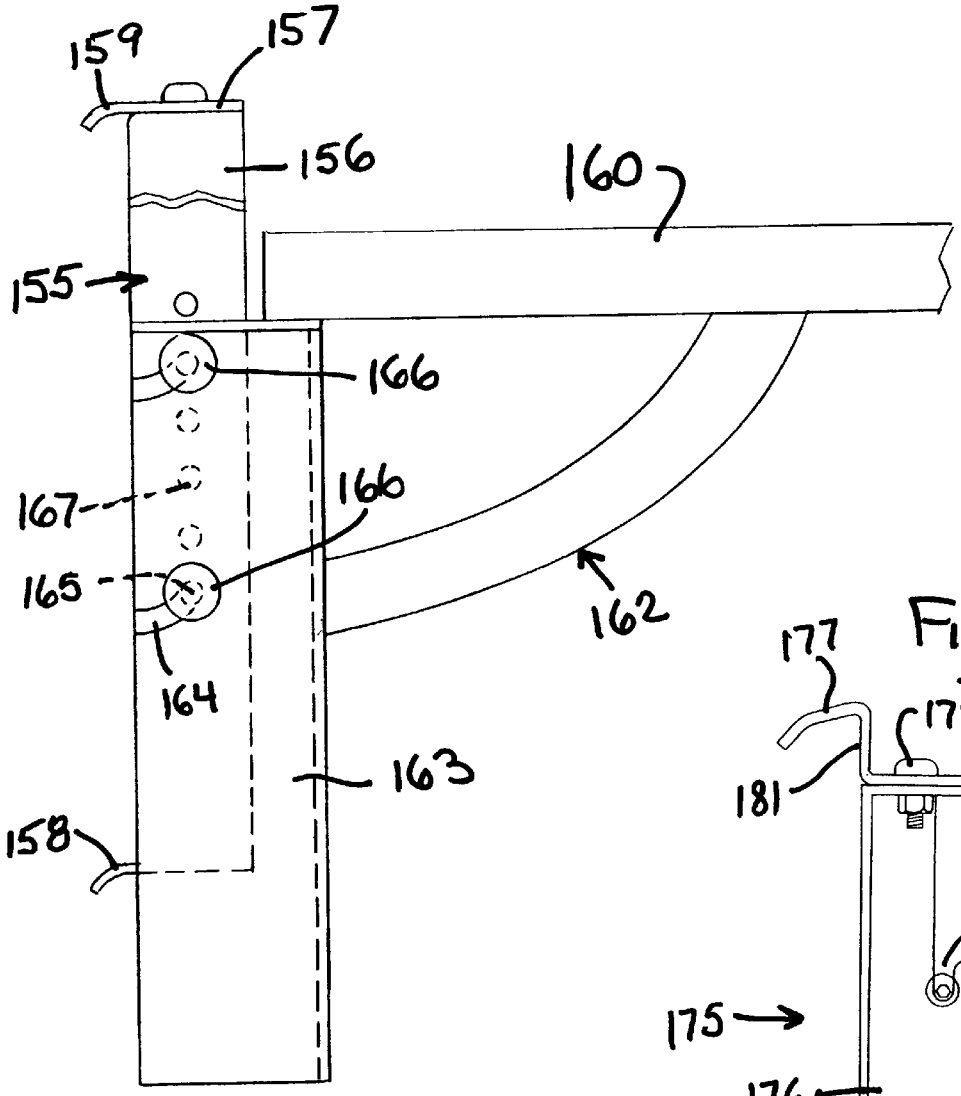
Fig. 32
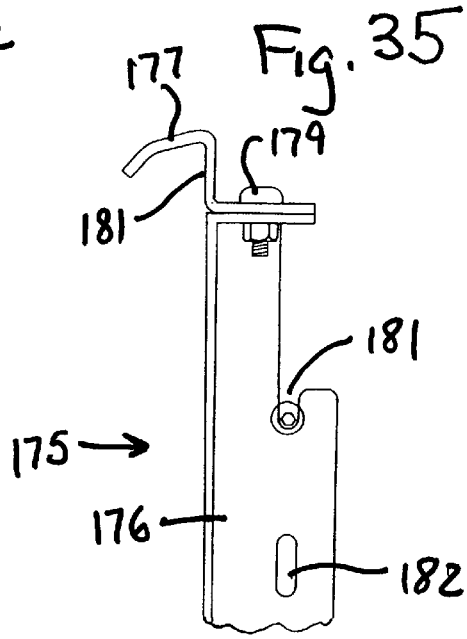
Fig. 35
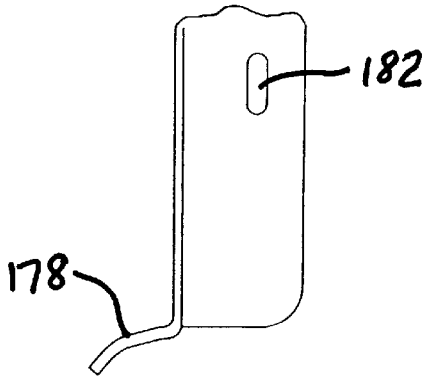

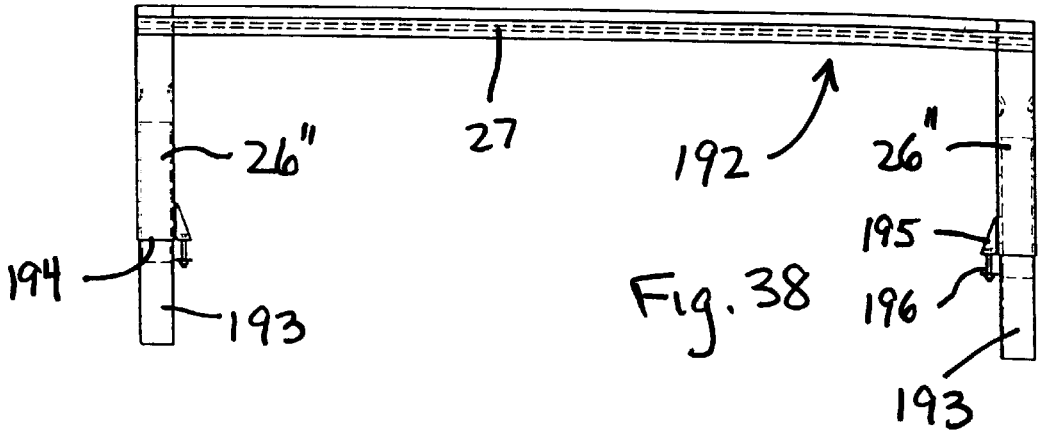
Fig. 38
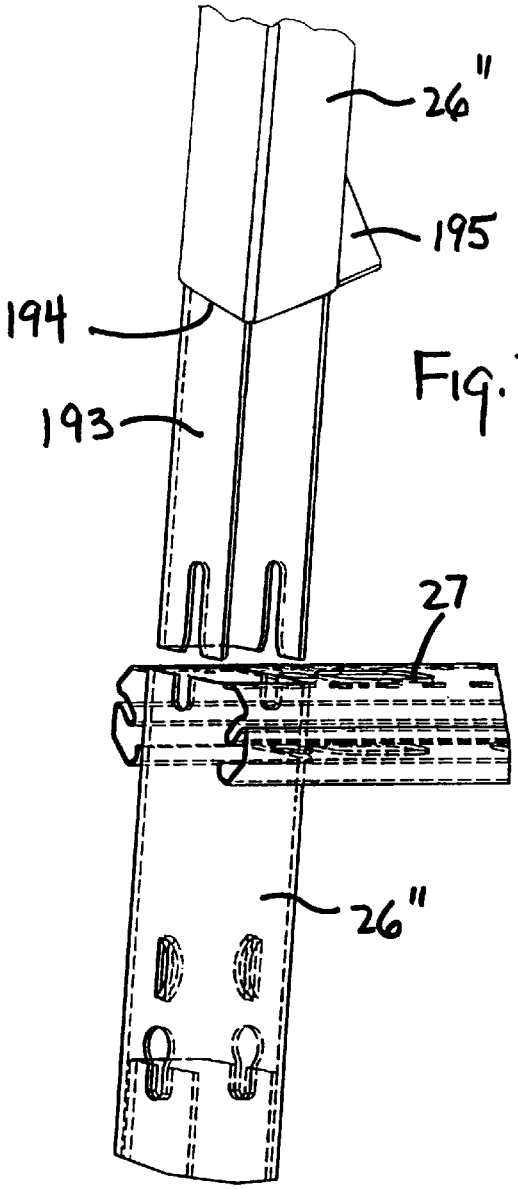
Fig. 39
Fig. 40
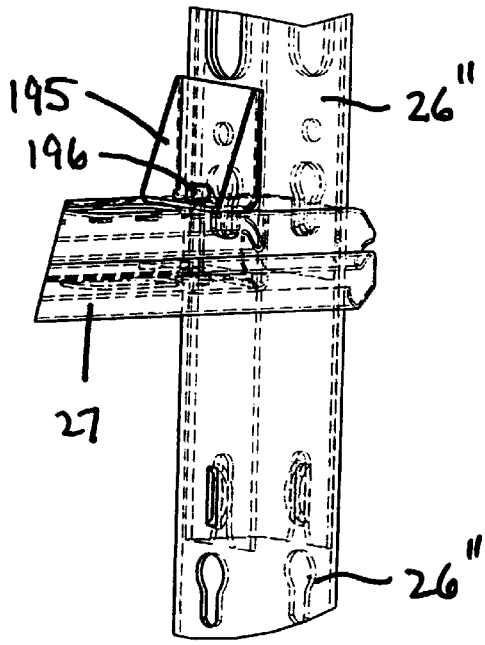

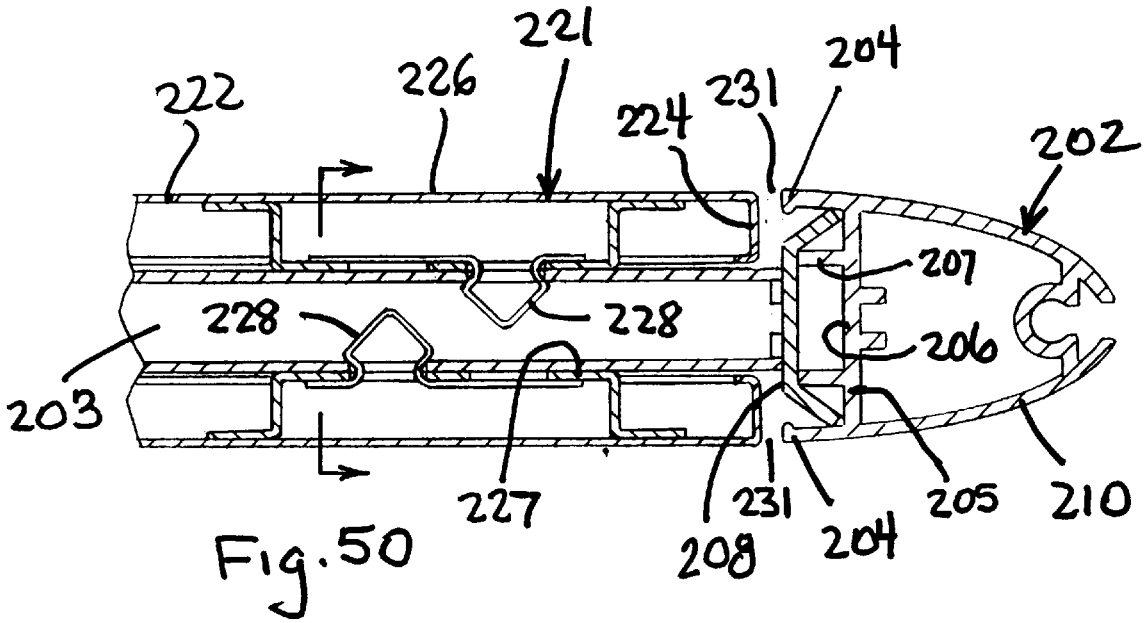
Fig. 50
Fig. 49
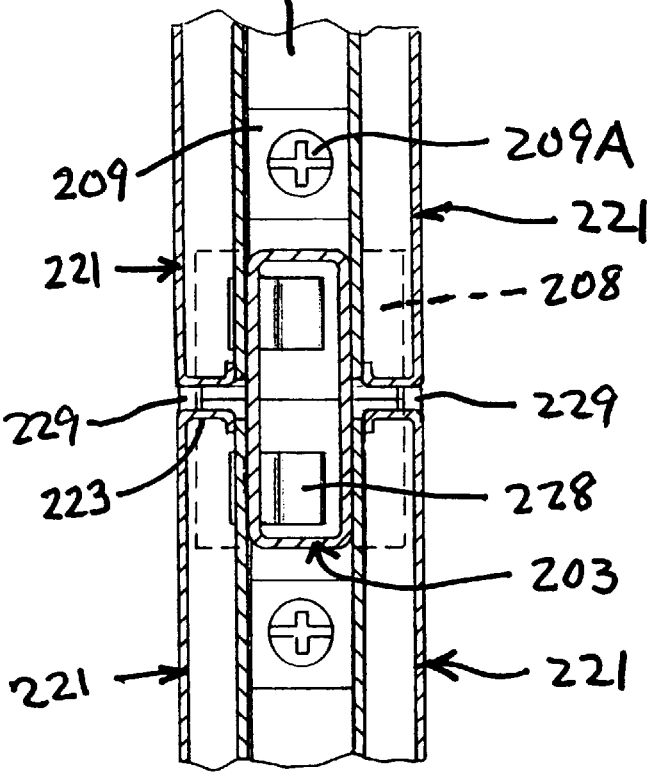

264
278
279
267
269
277
271
283
284
283
272
275
281
265

INTERIOR SPACE-DIVIDING WALL SYSTEM

CROSS REFERENCE TO RELATED APPLICATION

This application corresponds to and claims priority from U.S. Provisional Application Ser. No. 60/210,819, filed Jun. 9, 2000, entitled "INTERIOR SPACE-DIVIDING WALL SYSTEM".

FIELD OF THE INVENTION

This invention relates to a space-dividing wall panel system formed from upright panels for use in dividing large open office areas into smaller work spaces and, more specifically, to a wall panel system defining an improved load-bearing and cable-accommodating main or "spine" wall to which return or branch walls are connectable to define individual workstations.

This invention also relates to an improved load-bearing main or spine panel which cooperates with similar such panels to define a spine wall, and further relates to an improved branch panel which is connectable in an off-modular manner to the main wall.

BACKGROUND OF THE INVENTION

Commercial buildings typically include large open office areas which are divided into smaller work spaces or workstations by any of a number of space divider and panel systems that have been developed therefor. These space divider arrangements typically employ upright space-dividing wall panels which serially connect together to subdivide the office area into a plurality of smaller workstations of desired size and configuration. Such panels are typically less than floor-to-ceiling height, and cooperate with other furniture components to define an equipped workstation. These components may include worksurfaces, file cabinets, shelf units and the like which mount directly on and are supported by the wall panels, and may also include free-standing furniture components such as tables, chairs and file cabinets.

In subdividing open office areas into individual workstations, the individual wall panel assemblies have a variety of constructions. Typically, a plurality of upright space-dividing wall panels are employed which serially connect together through two-panel straight or angled connections, or through suitable three or four-panel connections, to subdivide the office area into the plurality of smaller workstations.

In one type of arrangement, a common panel construction is used to construct all of the walls of the workstations whereby each panel is individually connectable with serially adjacent panels through the aforementioned straight or corner connections. With such an arrangement, a group of workstations can be formed, for example, with a common central section of wall panels separating one row of workstations on one side of the central section from a separate row of workstations formed on the opposite side thereof.

Since each workstation usually requires power as well as communications capability such as for computers and telephones or the like, the wall panels preferably have power and telecommunications cabling within interior raceways thereof. Typically the central wall section formed by the wall panels carries the greatest number of cables since it provides access to all or most of the adjacent workstations formed on opposite sides thereof. In such an arrangement, however, the wall panels typically have a relatively narrow thickness to minimize the floor space being used and thereby have a limited cabling capacity. As a result, it may become difficult to accommodate all of the power and telecommunication cabling for all of the workstations associated with a particular group of workstations. Additionally, the central wall section also supports furniture components for the multiple workstations.

To provide an expanded capacity for the space dividing panels, a second type of space divider system is known which utilizes interconnected beams or wall panels having an increased cabling capacity to form a central divider wall. This increased capacity divider wall typically runs the length of a group of workstations and is commonly referred to as a "spine" wall. Such spine walls also provide an increased load-bearing capacity for readily supporting and mounting thereon furniture components of individual workstations.

In one known spine-type space dividing arrangement as disclosed in U.S. Pat. No. 5,155,955 (Ball et al.), an office space dividing system is provided where rectangular structural frames are formed of vertical mitered stiles having a vertically enlarged horizontal base rail proximate the lower ends of the mitered stiles and additional horizontal cross rails are disposed thereabove. The frames are connected with adjacent frames such that vertical columns are formed by the mitered stiles. Cabling is accommodated within each frame such that the communication cabling extends vertically through the mitered stiles in the region between the serially-adjacent frames and horizontally through passageways formed through the mitered stiles. This arrangement, however, requires the removal of furniture components when moving these components between panels and also routes horizontal cabling through the posts which thereby makes reconfiguration of workstations more difficult.

In a further spine wall arrangement as disclosed in U.S. Pat. No. 4,831,791 (Ball), a plurality of interconnected beams disposed at work-surface height are supported by vertical posts at the opposite ends thereof, which beams have a hollow interior in which cabling is accommodated. Such interconnected beams have stabilizer beams extending sidewardly therefrom which are connectable in the region intermediate the support posts. Additional patents relating to this particular arrangement are U.S. Pat. Nos. B1 4,224,769, 4,404,776 and 4,771,583. This arrangement also requires removal of furniture components when moving these components between wall sections.

A still further spine wall arrangement is disclosed in U.S. Pat. No. 5,852,904 wherein individual wall panel members are defined by a base panel having a horizontal boxed beam rigidly connected to a pair of laterally spaced apart vertical uprights connected at opposite ends of the box-beam and having reduced thickness compared to the box-beam. Appropriate extension panels can be mounted vertically on top of the base panel to provide variable height. With this arrangement, significant cabling capacity can be achieved, and the spine wall permits off-module connection with branch panels or other loads, including load-bearing branch panels since the box-beam construction provides the spine wall with significant strength capable of withstanding branch panel induced loads. Constructing the spine wall using the box-beam, however, does restrict interior usage of the panel.

Other known wall systems have also employed upright wall panels defined by an open interior frame and employing pads (sometimes referred to as tiles or covers) which detachably mount on both sides of the frame to provide increased flexibility with respect to use of the wall, particularly in terms of different use or job functions in the adjacent work spaces, and ease of installing and accommodating cabling in the wall panels for access from adjacent workstations.

While the known "spine" wall systems generally all function in a generally satisfactory manner, nevertheless most such systems possess structural, appearance, assembly or operational features which are believed to be less than optimal. More specifically, some of the more commonly experienced disadvantages with various known wall systems are:

- an inability to mount external loads and specifically branch panels in an off-modular relation or, while some known systems permit off-module mounting, nevertheless many permit off-module mounting only in a restricted manner in that off-module mounting can occur only at selected locations, and as such the system still possesses so-called "dead zones" which are locations where significant off-module external loading is not permittted;
- some known systems do not provide optimum flexibility with respect to maximizing the types of tiles or pads which mount on the wall panels, particularly with respect to maximization of pad flexibility both vertically and horizontally so as to provide a wide variety of different appearance and use characteristics in the adjacent workstations;
- many of the systems require use of branch or divider panels which are constructed like the spine panels and hence such branch panels are oftentimes over-designed for their intended use and hence result in the overall system being of significantly increased cost;
- many known systems provide panels which extend vertically so as to substantially contact the floor along the complete lower edge thereof and hence undesirably impede or restrict proper air circulation in the adjacent workstations;
- many such systems do not efficiently permit cabling (electrical and/or telecommunication) to be readily fed into the interior of the wall panels from an exterior source, particularly from cabling disposed below a raised floor, without use of unsightly external connectors.

Persons familiar with known systems as briefly discussed above will also readily recognize other disadvantages or inconveniences associated with such systems.

The present invention relates to an improved wall system and particularly a load-bearing "spine" wall which is usable in conjunction with and connectable to branch panels for defining workstations, and wherein the individual spine panels and branch panels and the walls and system resulting therefrom are believed to provide increased functional, aesthetic and operational characteristics, and hence are believed to overcome or at least minimize many of the characteristics deemed disadvantageous with respect to prior known systems.

In the present invention, particularly in accordance with one aspect thereof, there is defined an upright load-bearing or spine wall system defined by two or more main upright panels which are rigidly joined horizontally in series relationship. Each main panel includes an upright frame defined in part by a pair of generally parallel and vertically elongate uprights which generally define opposite ends of the panel. The uprights may be a one-piece member, or may be defined by a series of upright segments which are rigidly vertically stacked in aligned relation. The frame also includes a plurality of substantially identical elongate horizontal support beams which are disposed in vertically spaced but parallel relationship and extend generally perpendicularly between and have opposite ends rigidly joined to the uprights. The plurality of support beams includes upper and lower beams rigidly joined to the upright to define a generally rectangular ring-shaped outer frame configuration, and one or more intermediate support beams extend in spaced relation between the upper and lower support beams and are rigidly joined between the uprights. The support beams are preferably disposed in generally uniformly vertically spaced relation. The support beams comprise elongate tubular members having a horizontal width greater than the horizontal width of the uprights, and the support beams at free ends thereof are notched to define recesses which accommodate the upright therein, whereby side portions of the beam on opposite sides of the notch are cantilevered so as to project along the outer faces of the respective upright. The beam has opposite side walls which define therein slots which extend longitudinally (i.e. generally horizontally) throughout the complete length of the support beam, including throughout the cantilevered end portions, whereby the rigid aligned securement of adjacent panels results in the slots of adjacent support beams being generally aligned and in substantially continuous and open communication with one another. Each side of the frame is covered by one or more removable cover tiles which have a height which approximately corresponds to the vertical spacing between vertically adjacent beams, or is a whole number multiple of such height. Typically two or more cover tiles are removably attached generally vertically one above the other on at least one and normally both sides of the frame. The cover tiles and the support beams have cooperating connectors, such as spring or snap-like hooks, for releasably mounting each cover tile so that it is mounted on and extends vertically between two vertically spaced support beams. The mounting of vertically adjacent cover tiles on the support beams results in opposed edges of vertically adjacent tiles being vertically spaced a small distance apart so as to define an elongate clearance slot therebetween, which clearance slot generally aligns with and provides access to the longitudinally elongate slot defined in the adjacent side wall of the support beam, whereby external components such as worksurfaces, cabinets or the like can be mounted on the panel in load-bearing relationship therewith. The external device mounts thereon appropriate hangers which project rearwardly through the clearance slot between the tiles into the slot in the support beam to permit mounting of the external device on the panel. The continuous nature of the slots in the beams throughout the length of the panel, and the open aligned configuration of the slots in horizontally adjacent and aligned panels, allows external component hangers to be mounted on the wall and adjustably moved therealong, thereby providing unrestricted positioning of the component on the wall, i.e., unrestricted by the modularity (i.e., width) of the individual panels.

In the wall system of the present invention, as aforesaid, the slot in the support beam in a preferred embodiment has a generally Z-shaped cross section as it projects inwardly from the support beam side wall, and the hanger on the component has a cantilevered hook portion which adjacent the free end has a downwardly projecting hook part so that insertion of the hanger into the support beam slot results in the hook part of the hanger being positioned into a lower inner leg portion of the Z-shaped slot, and the platelike part of the hook member passing outwardly through the upper leg of the Z-shaped slot, whereby the hook engages interiorly of the slot to prevent direct horizontal withdrawal of the hanger from the slot. The hanger also preferably mounts thereon a removable locking member which inserts into the upper leg of the Z-shaped slot so as to overlie the hook plate and prevent upward movement thereof to effect positive locking of the hanger within the slot. Insertion of the hanger into the slot, or removal of the hanger from the slot, can be effected only when the locking member is removed from the hanger, and requires angular tilting of the hanger relative to the slot so as to permit the hook part at the free end of the hanger to be inserted into or removed from the lower inner leg of the Z-shaped slot. The hanger member can be secured to an appropriate support member, such that external components or loads can be mounted on the side face of the panels defining the wall system.

In the wall system of the present invention, as aforesaid, the slot in the support beam in an alternate embodiment of the invention is of an arcuate configuration as it projects inwardly from the support beam side wall, and the hanger of the component has a similar arcuate configuration so that insertion of the hanger through the passage between the tiles into the support beam slot requires that the hanger be moved through an arcuate path disposed in a plane generally transverse to the side of the panel, which movement when the hanger is properly engaged in the slot then provides for securement of the component onto the panel.

The wall system of the present invention, as aforesaid, also preferably includes one or more branch panels which are of a non-load-bearing construction but which can be attached to the spine wall at any location therealong so that the branch panel or panels extend transversely away from the spine wall so as to define different but at least partially separated work spaces thereadjacent. The branch panel secures to the main wall by a pair of vertically spaced connectors which have connector parts (i.e. hangers) thereon which correspond to the component hangers and which engage within the slots defined by a vertically spaced pair of support beams.

The wall system of the present invention, pursuant to a further aspect thereof, includes an upright divider or branch panel having opposite ends defined by upright end posts disposed in generally parallel relationship and rigidly joined by a plurality of generally parallel and vertically spaced connecting members which extend generally perpendicularly between and have opposite ends thereof rigidly joined to the end posts. The plurality of support members, each of which has a horizontal width substantially smaller than the horizontal width of the upright end posts, includes top and bottom support members which rigidly join the end posts and one or more intermediate support members disposed between the top and bottom support members, with the plurality of support members preferably being disposed in uniform vertically spaced relationship. One or more removable cover tiles are attached to each side of the frame, which cover tiles, by means of spring-like clips or hooks, cooperate with a pair of vertically spaced support members so as to permit the cover tiles to be releasably attached to the frame. The cover tiles nest between the upright end posts on opposite sides of the frame so that the width of the panel as defined between the exterior surfaces of the tiles generally corresponds to the width of the upright end posts.

In the improved wall system of this invention, as aforesaid, the branch panel can be used in conjunction with the spine panel discussed above, and the vertical spacing and elevations of the support members generally corresponds to the vertical spacing and elevations of the support beams of the main panel, and the vertically adjacent covering tiles on the branch panel preferably have their adjacent horizontal edges slightly vertically spaced to define a vertically small but elongate clearance passage therebetween which corresponds in elevation and dimension to the hanger-accommodating passages defined between the covering tiles of the main panel.

The present invention also relates to an improved panel-to-panel connector which can be utilized to connect two branch panels in series, or can alternatively be utilized to connect a branch panel to a main panel. The construction of this connector is described hereinafter.

The present invention also relates to a wall system which incorporates an improved cable-accommodating boot or shroud which encloses the leg structures associated with two joined main panels and extends vertically between the floor and the lowermost support beam. The shroud includes two substantially identical half shells which are moved horizontally together in surrounding relationship to the legs for enclosing the legs while maintaining interior space for accommodating vertical extension of cabling therethrough, such as from below a raised floor upwardly into the interior of one of the panels. Each half of the shroud is also of a telescopic construction including upper and lower telescopic half shells which are relatively vertically extendable so as to extend vertically between the floor and the bottom support beam, thereby accommodating for irregularities in the floor while enabling proper horizontal leveling of the wall system. The structure of the cable shroud is also explained in detail hereinafter.

Other objects and purposes of the invention will be apparent to persons familiar with structures of this general type upon reading the following specification and inspecting the accompanying drawings.

BRIEF DESCRIPTION OF THE DRAWINGS

FIG. 11 is a top view of the support beam shown prior to its assembly to the uprights.

FIG. 12 is a side elevational view of the support beam shown in FIG. 11.

FIG. 13 is an enlarged cross-sectional view of the support beam as taken generally along line D—D in FIG. 12.

FIG. 14 is an enlargement of the circled region designated E in FIG. 10.

FIG. 32 illustrates the hanging device of FIG. 30 vertically adjustably mounted on a support which attaches to the underside of a horizontally enlarged worksurface or tabletop for permitting mounting of the latter on a main panel.

FIG. 35 is a view similar to FIG. 30 but illustrating a modified hanging device, such device being usable for securement within a cabinet having top and bottom walls.

FIG. 38 is a side elevational view showing one of the upper stacking frame segments associated with the frame of FIG. 36.

FIG. 39 is a fragmentary perspective view which illustrates the manner in which the upright segments of the stacking frames telescope together.

FIG. 40 is a perspective view similar to FIG. 39 but illustrating the stacked upright segments rigidly joined together to define an assembled frame.

FIG. 49 is an enlarged sectional view taken generally along the line N—N in FIG. 48.

FIG. 50 is an enlarged sectional view taken generally along the line P—P in FIG. 48.

Figure 1:
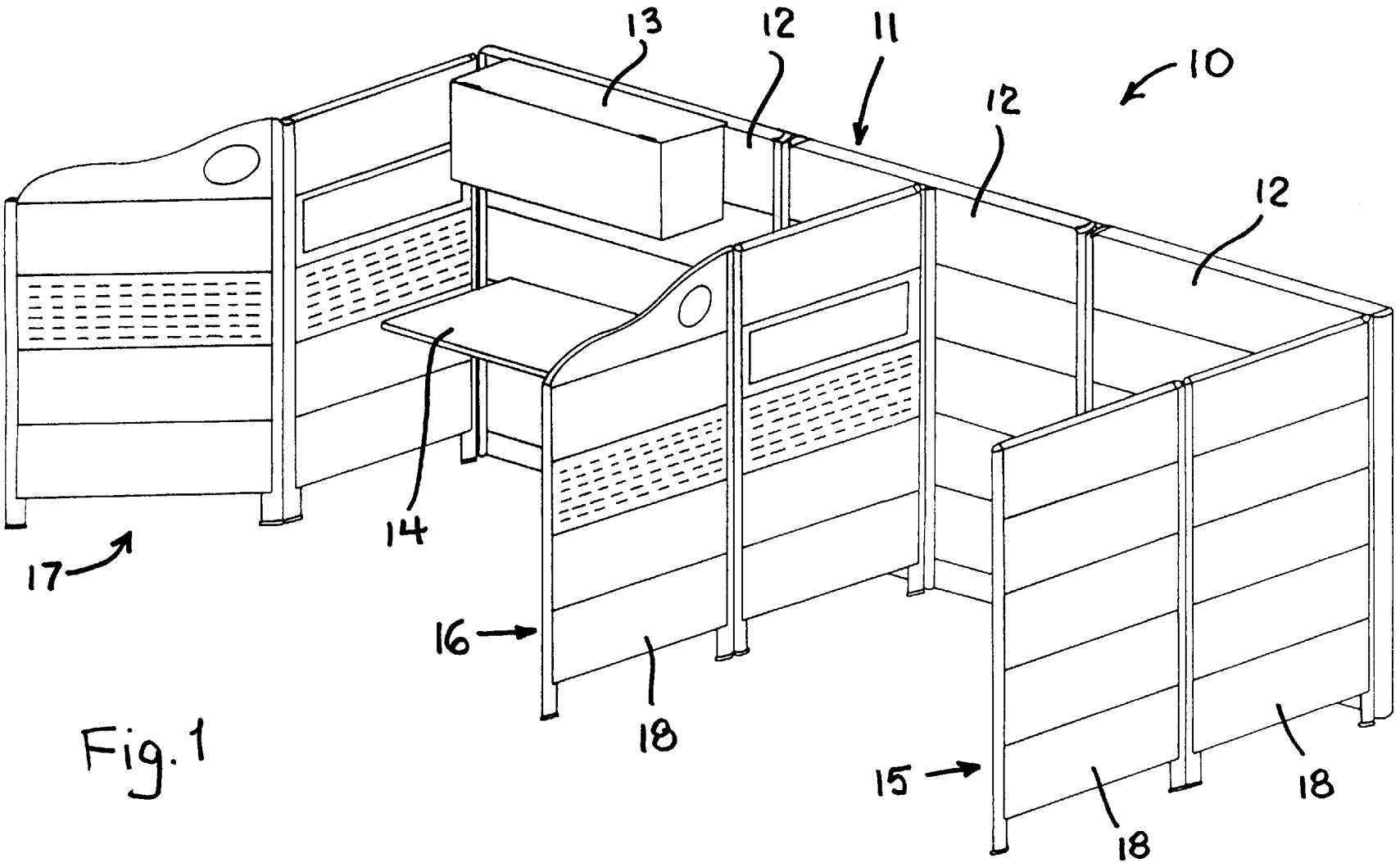
FIG. 1 is a perspective view which illustrates a wall system incorporating both a spine wall and divider walls cooperating to define workstations, and illustrating mounting of load-bearing components on the spine wall.

Certain terminology will be used in the following description for convenience and reference only, and will not be limiting. For example, the words "upwardly," "downwardly," "rightwardly" and "leftwardly" will refer to directions in the drawings to which reference is made. The words "upwardly" and "downwardly" will also be used in reference to the normal orientation of the panel or wall system during use thereof. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an interior, space-dividing upright wall system 10 which can be disposed for free-standing support on a floor so as to divide a large open area into smaller work spaces. The wall system 10 includes an upright main or spine wall 11 which is defined by a plurality of upright main or spine panels 12 (three panels in the illustrated arrangement). The spine wall 11 is adapted to support external load components thereon, such as illustrated by a wall cabinet 13 and a worksurface 14 which are mounted in cantilevered relationship on one side of the main wall.

The wall system 10 in the illustrated arrangement also includes a plurality of divider walls 15, 16 and 17 which cooperate with and, in the illustrated arrangement, connect to the main wall 11 and project transversely therefrom so as to effect separation between individual work spaces. The divider walls in the illustrated arrangement are defined by one or more upright branch panels 18 serially connected edge-to-edge. The branch panels 18, contrary to the main panels 12, typically do not permit any heavy or significant load-bearing components to be mounted thereon.

The main panels 12 are also designed to accommodate electrical and telecommunication cabling therein, so as to facilitate access to such cabling from adjacent work spaces.

In the following description, the spine wall and its associated panels will be referred to as the "main" wall or panel, and the divider wall and its associated panels will be referred to as a "branch" wall or panel for convenience in distinction, although it will be appreciated that numerous other terms can be utilized for this purpose.

Considering now the construction of the main wall 11 and the respective main panel 12, FIGS. 2–7 diagrammatically illustrate a main wall defined by two main panels 12 rigidly joined edge-to-edge. Each main panel 12 includes an interior frame (described hereinafter) which is covered on both sides by one or more removable cover tiles or pads 21. The lowermost cover tile 21 on each panel is positioned so as to be spaced upwardly from the floor, thereby leaving an open clearance space 22 between the floor and the panel so as to provide significantly improved ventilation and air circulation in the adjacent work spaces. This open space 22 will, in the preferred arrangement, typically be in the range of four to six inches in height. The panels have downwardly projecting feet for engagement with the floor, which feet are enclosed by shrouds 23 and 24 which surround the feet and project vertically between the floor and the lower edge of the panel. The shroud 23 is used for enclosing the feet located at the junction where two panels 12 rigidly join together, whereas the shrouds 24 are utilized for enclosing the feet at the free ends of the main wall. These shrouds permit cables to project vertically through the interior thereof, as explained hereinafter.

Figure 8:
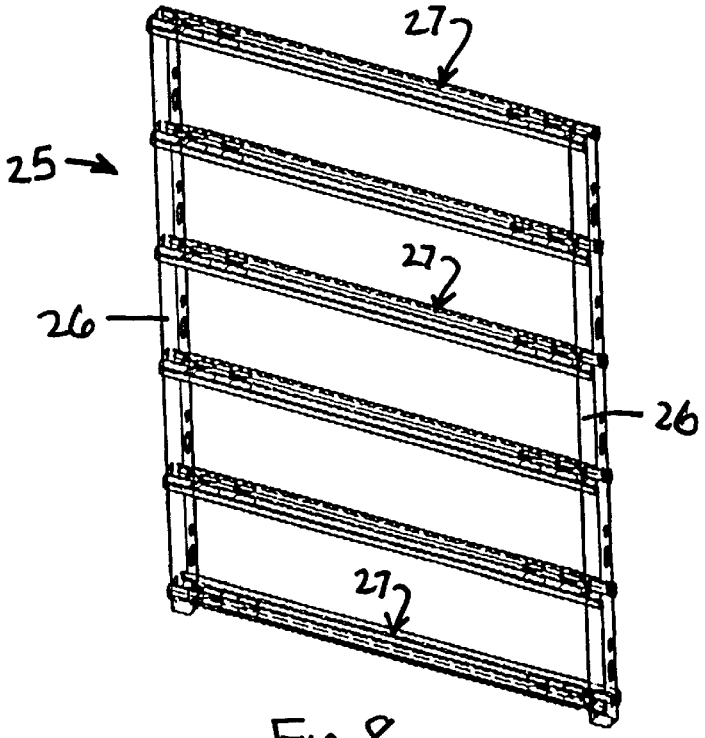
FIG. 8 is a perspective view showing the frame of the main panel with the tiles removed.
Figure 9:
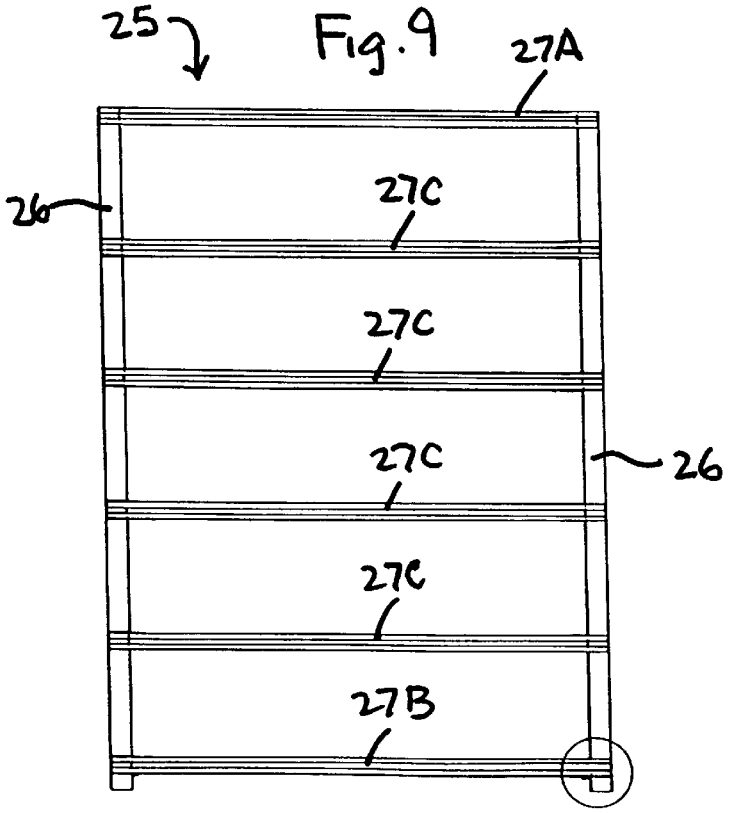
FIG. 9 is a side elevational view of the frame shown in FIG. 8.
Figure 10:
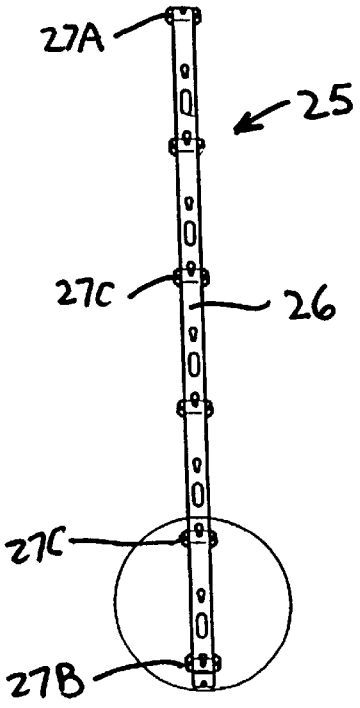
FIG. 10 is an end elevational view of the main frame shown in FIG. 9.

The main panel 12, as illustrated by FIGS. 8–10, has an internal frame 25 defined by a pair of generally parallel and sidewardly spaced uprights or posts 26 which, in the normal use position, project vertically. These uprights 26 are in turn rigidly joined by a plurality of cross beams or rails 27 which are horizontally elongated so as to extend perpendicularly between the uprights 26, with opposite ends of each cross beam being rigidly secured, as by welding, to the uprights 26. The plurality of cross beams 27 are disposed in vertically spaced relationship relative to the frame and the uprights 26, and include a top cross beam 27A which extends between and rigidly joins to the uprights 26 substantially flush with the upper ends thereof, a lower cross beam 27B which extends between and joins to the uprights 26 adjacent the lower ends thereof, and one or more intermediate cross beams 27C which extend between and rigidly join to the upright 26 in vertically spaced relation between the top and bottom cross beams. The cross beams 27, in the preferred embodiment, are uniformly vertically spaced apart, with the frame 25 illustrated by FIGS. 8–10 having a five module height as defined by the five uniform height spaces defined between each vertically adjacent pair of cross beams.

Figure 15:
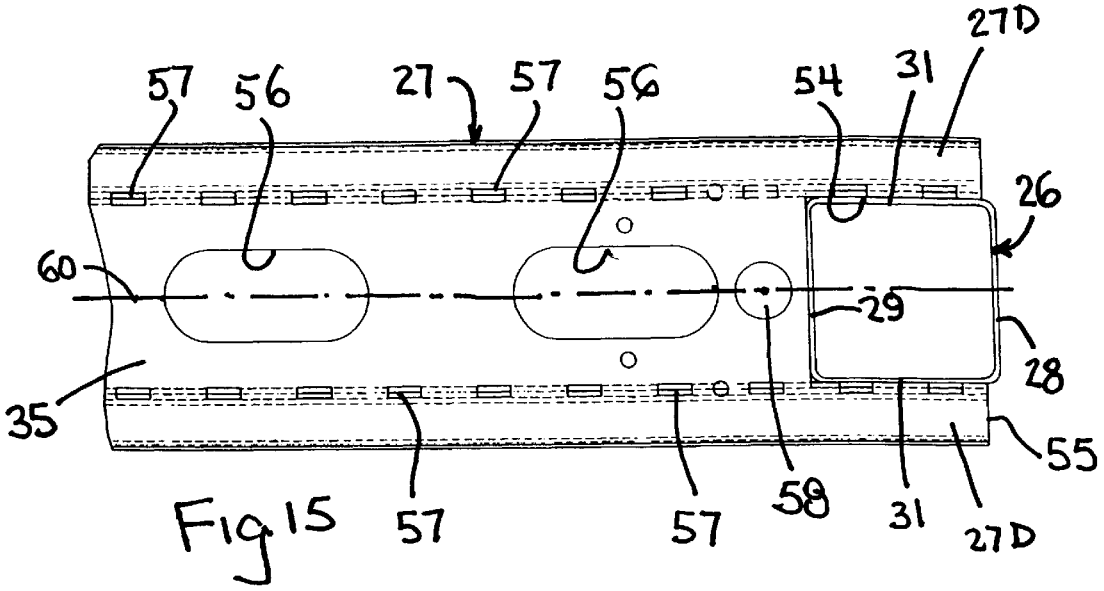
FIG. 15 is a fragmentary top view which shows one end of the support beam and its connection and cooperative relationship with the vertical upright.

The upright 26, in this illustrated embodiment, comprises a one-piece monolithic, elongate hollow tube of rectangular cross-section and, as illustrated in FIG. 15, preferably a square cross-section. The upright 26 includes generally parallel outer and inner edge walls 28 and 29 respectively, which are rigidly joined together by generally parallel side walls 31. The edge walls 28, 29 of each upright 26 have a series of openings 32 (FIG. 14) formed horizontally therethrough in vertically spaced relationship therealong, which openings 32 in the illustrated embodiment are of a generally keyhole-shaped configuration. Each keyhole opening 32 in the outer edge wall 28 has a corresponding keyhole opening aligned therewith in the inner edge wall 29. A further series of enlarged openings 33 are formed in each of the edge walls 28 and 29 in vertically spaced relationship therealong, with the openings in the outer edge wall 28 being horizontally aligned with the corresponding openings formed in the inner edge wall 29. The horizontally aligned openings 33 are positioned so that at least one aligned pair of openings 33 extend horizontally through the upright 26 for communication with the interior space defined between each vertically adjacent pair of cross beams 27. The openings 33 permit cables, for example power cable components, to pass therethrough as explained hereinafter, whereas the keyhole openings 32 are utilized for rigidly connecting adjacent panels together, as also explained hereinafter.

Figure 16:
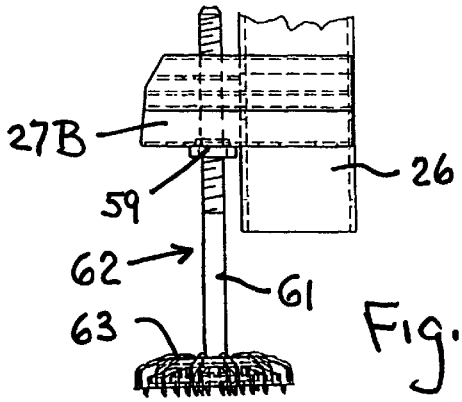
FIG. 16 is a fragmentary side view showing one lower corner of the main frame and the connection of the support leg thereto.

The elongate cross beam 27, as illustrated by FIGS. 11–15, is formed as a hollow tubular member having generally parallel top and bottom walls 35 and 36 respectively, which walls extend generally horizontally, and the top wall 35 has a width which is greater than the width of the bottom wall 36. The walls 35 and 36 are joined together by side walls 37 which have a generally convex shape such that these side walls project outwardly beyond the exterior surfaces of the upright side walls 31, as illustrated in FIG. 16.

Each of the convex side walls 31, in the illustrated embodiment, includes an upper sloped part 38 which joins to one edge of the top wall 35 and which then angles downwardly as it projects outwardly. The lower edge of upper sloped part 38 is joined to an intermediate vertical wall part 39 which at its lower edge, joins to a lower sloped wall part 41 which slopes inwardly as it projects downwardly. Wall part 41 at its lower edge joins to an inner inclined wall part 42 which slopes upwardly as it projects inwardly. This latter part 42 in turn joins to an upwardly projecting vertical wall part 43 which at its upper edge joins to an outer edge of the bottom wall 36. The bottom wall 36 and its cooperation with the opposed inner wall parts 43 effectively define a shallow channel 44 which extends longitudinally along the entire length of the beam and opens downwardly. This channel 44 has a width between the opposed vertical wall parts 43 which substantially corresponds to the width of the upright 26 as measured between the external surfaces of side walls 31.

Each convex side wall 37 of beam 27 also has a groove or slot 45 formed therein and extending longitudinally along the beam throughout the entire length thereof. This slot 45 is used to accommodate hangers or brackets which permit branch panels or load-bearing components to be connected to the main panel, and hence this slot 45 will herein be referred to as the "hanger slot" for ease of identification.

The hanger slot 45, as illustrated in FIG. 15, has a narrow mouth 46 formed generally in the plane of the vertical wall part 39, and the slot 45 includes a portion 47 of arcuate configuration as the slot projects inwardly away from the mouth 46. This arcuate slot portion 47 has an arcuate configuration as defined in a vertical plane which substantially perpendicularly intersects the elongated direction of the cross beam. The slot 45 is defined by opposed wall portions 51 and 52 which are joined to and project inwardly from the intermediate wall part 39, and these wall portions 51 and 52 at their inne ends are joined by an arcuate end wall 53 which defines the closed end 48 of the slot. The slot 45, adjacent the closed end thereof, may be relatively straight as illustrated, or may constitute an extension of the arcuate slot portion 47. The closed inner end of the slot 45 slopes down at an angle of about 40° to about 45° relative to the side wall part 39.

To secure each cross beam 27 to the pair of uprights 26, each end of beam 27 has a recess or cut-out 54 (FIG. 15) formed inwardly from the free end 55. This cut-out 54 is formed through both of the top and bottom walls 35 and 36, and is sized to snugly accommodate the cross-section of the upright 26 therein, substantially as illustrated in FIG. 15, whereby the outer surface of outer edge wall 28 is substantially flush with or possibly spaced outwardly from the free end 55 by only a small amount such as about 1 mm or less. The upright 26 is fixedly secured to the beam by being welded along the beam edges which define the cut-out 54 and effectively contact the upright.

The formation of the cut-outs 54 at the ends of the beam 27 results in a bifurcated or fork-like configuration at the ends of the beam, and hence results in a pair of generally parallel but cantilevered end portions 27D which effectively straddle and sidewardly embrace the upright 26 therebetween, as illustrated by FIG. 15, with the cantilevered end portions 27D of the beam projecting outwardly a limited extent away from the outer surface of the respective upright side wall 31. These cantilevered beam portions 27D and their outward projection beyond the width of the upright, when several such cross beams 27 are secured to the uprights, thus define vertical clearance spaces which are defined along the upright side walls 31 vertically between the cantilevered beam portions 27D so as to accommodate passage of cables, such as telecommunication cables, over the exterior sides 31 of the uprights 26 as explained below.

The beam 27, as illustrated in FIG. 15, also has one or more enlarged openings 56 formed vertically therethrough, which openings 56 extend in aligned relationship through both the top and bottom walls 35 and 36. At least one, and in the illustrated embodiment two, openings 56 extend vertically through the cross beam 27, preferably adjacent each end thereof. These openings permit vertical passage therethrough of cabling if desired, such as power cabling, to permit passage into the open compartments defined between vertically adjacent cross beams 27.

Each cross beam 27 also has a plurality of longitudinally elongate but narrow slots 57 formed vertically through the top wall 35. The slots 57 are disposed in two parallel rows which extend longitudinally of the beam and are disposed adjacent opposite longitudinally extending side edges of the top wall 35, whereby the slot rows are uniformly spaced on opposite sides of a vertical plane 60 containing the longitudinal central axis of the cross beam. The slots 57 are provided for a multiplicity of functions, as explained hereinafter.

At least one of the cross beams 27 per frame, specifically the bottom beam 27B, also has openings 58 extending vertically through the top and bottom walls 35 and 36, which openings 58 are disposed to generally intersect the longitudinal centerline of the beam and are disposed adjacent opposite ends of the beam in close proximity to the respective uprights 26. The opening 58 associated with at least one of the walls 35, 36 is provided with a threaded nut member 59 (FIG. 16) which is fixed to the wall 35 or 36 and defines a vertically extending threaded opening which accommodates therein an elongate threaded stem 61 (FIG. 16) associated with a panel foot member 62, the latter at its lower end being provided with an enlarged floor-engaging foot or glide 63. The frame of each main panel has two such foot members 62 adjustably mounted thereon adjacent opposite ends of the lower cross beam 27B so that the foot members are disposed adjacent but inwardly of the uprights 26. These foot members 26 can be vertically adjusted to compensate for irregularities and permit horizontal leveling of the wall panel in a manner which is well known, with the foot members projecting downwardly a substantial vertical distance below the lower beam 27B so as to provide the desired vertical clearance 22 beneath the wall panel.

Figure 17:
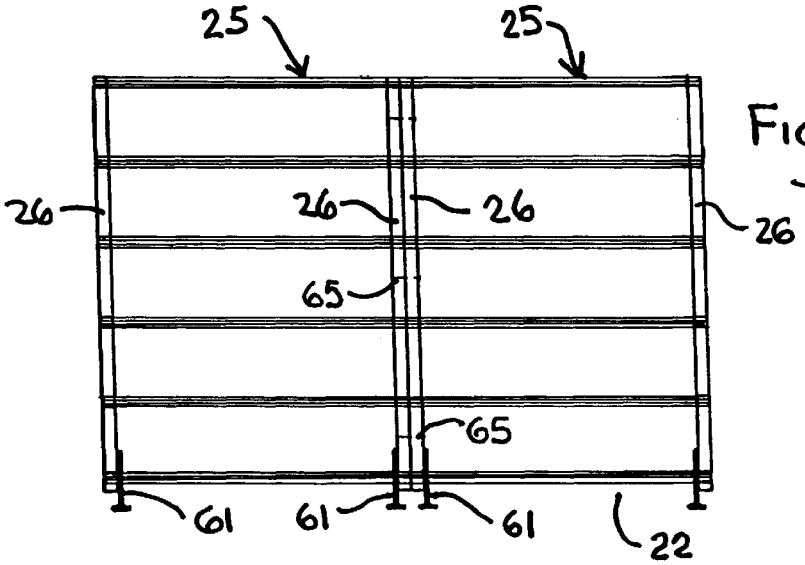
FIG. 17 is a fragmentary elevation view which diagrammatically illustrates the manner in which adjacent uprights of adjacent main panels are rigidly joined together.
Figure 18:
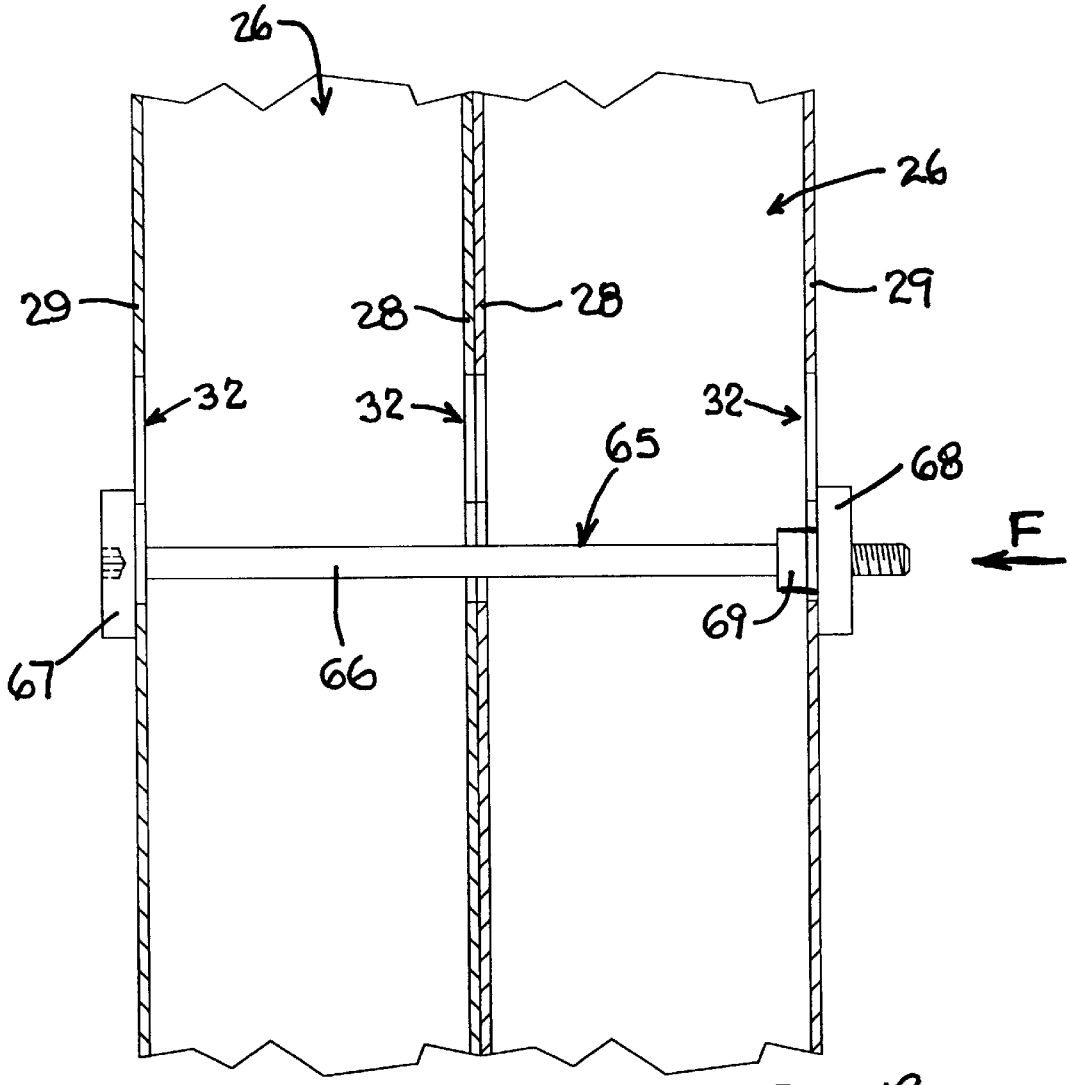
FIG. 18 is a fragmentary elevational view, partially in cross-section, and illustrating the relationship of FIG. 17 in greater detail.
Figure 19:
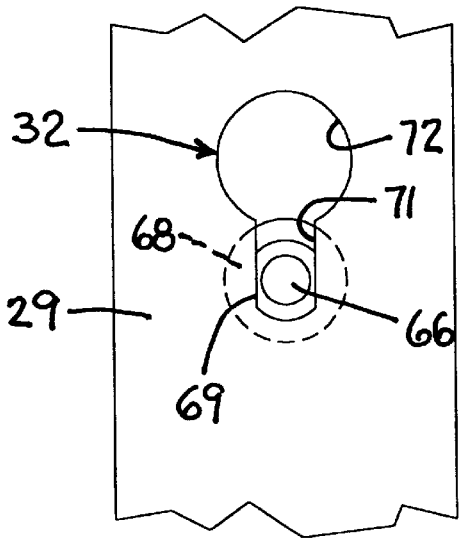
FIG. 19 is a fragmentary end view taken generally in the direction of arrow F in FIG. 18.

To define a spine wall from two or more main panels rigidly joined in edge-to-edge relationship, the frames 25 of two adjacent main panels are rigidly joined in the manner illustrated by FIGS. 17–19. More specifically, the frames 25 of two panels are positioned in generally aligned edge-to-edge relationship so that the opposed uprights 26 substantially abut, and the frames are vertically and horizontally leveled so that the keyhole openings 32 in the adjacent uprights 26 are substantially aligned. The two adjacent uprights 26 are then rigidly joined together by a plurality of fasteners 65 which extend through the aligned keyhole openings 32 in vertically spaced relationship along the uprights to provide a fixed securement at several vertically spaced locations.

Each fastener 65, as illustrated in FIGS. 18 and 19, comprises an elongate rod or pin 66, namely a bolt, having an enlarged head 67 at one end, and being threaded at the other end to accommodate a nut 68. The nut 68, over a portion of the axial length thereof disposed closest to the bolt head 67, is provided with a reduced width as defined by opposed flats 69 which are sidewardly spaced by a distance which is slightly smaller than the width of the narrow slot-like bottom portion 71 of the keyhole opening 32. The exterior diameter or configuration of the nut 68 and bolt head 67 are larger in cross-section than the width of the narrow slot 71, but are slightly smaller than the enlarged opening 72 defined at the upper end of the keyhole slot. With this arrangement, and with the keyhole slots 32 of adjacent uprights substantially aligned as illustrated in FIG. 18, the pre-assembled fastener 65 can be horizontally inserted through the aligned enlarged openings 72 so that the nut 68 cooperates with the inner edge wall 29 of one upright 26, and the bolt head 67 cooperates with the inner edge wall 29 of the other upright 26. Fastener 65 is then moved vertically downwardly into the narrow slot portions 71 of the keyhole slots, whereby the body of the bolt 66 readily passes into the slots 71, and the narrow portion of the nut as defined between the flats 69 is slidably guided downwardly into the slot 71, which thereby restrains rotation of the nut 68. The main body of the nut 68, however, is of larger cross-section and hence overlaps the exterior surface of the inner edge wall 29, and the enlarged head of the bolt 67 similarly overlaps the exterior surface of its respective inner edge wall 29. The bolt 67 can then be readily rotated by engaging an opening in the head 67 thereof with a suitable tool so as to effect tightening of the fastener and hence effecting tightening of the two uprights 26 rigidly in contacting engagement with one another. This arrangement is particularly desirable since the installer does not have to utilize a separate tool for engaging and restraining the nut.

As illustrated by FIG. 10, the top cross beam 27A and all of the intermediate cross beams 27C are fixed to the uprights 26 in an upwardly facing orientation substantially as illustrated in FIGS. 13 and 14 such that the hanger slots 45 are all oriented with a downwardly arcuate configuration substantially as illustrated by FIG. 13. While the lowermost cross beam 27B could also be fixed to the uprights in this same orientation, it is nevertheless preferred in the illustrated embodiment that the bottom beam 27B be initially vertically rotated 180° so that the slotted upper surface 35 thus faces downwardly when the bottom cross beam 27B is fixed to the uprights, which relationship is illustrated in FIG. 14. This hence results in the hanger slots 45 of the bottom beam 27B being of an upwardly arcuate configuration. This is believed advantageous when the slots 45 associated with the top and bottom cross beams 27A and 27B are utilized for transversely attaching a branch panel to the main wall, as described hereinafter.

Figure 2:
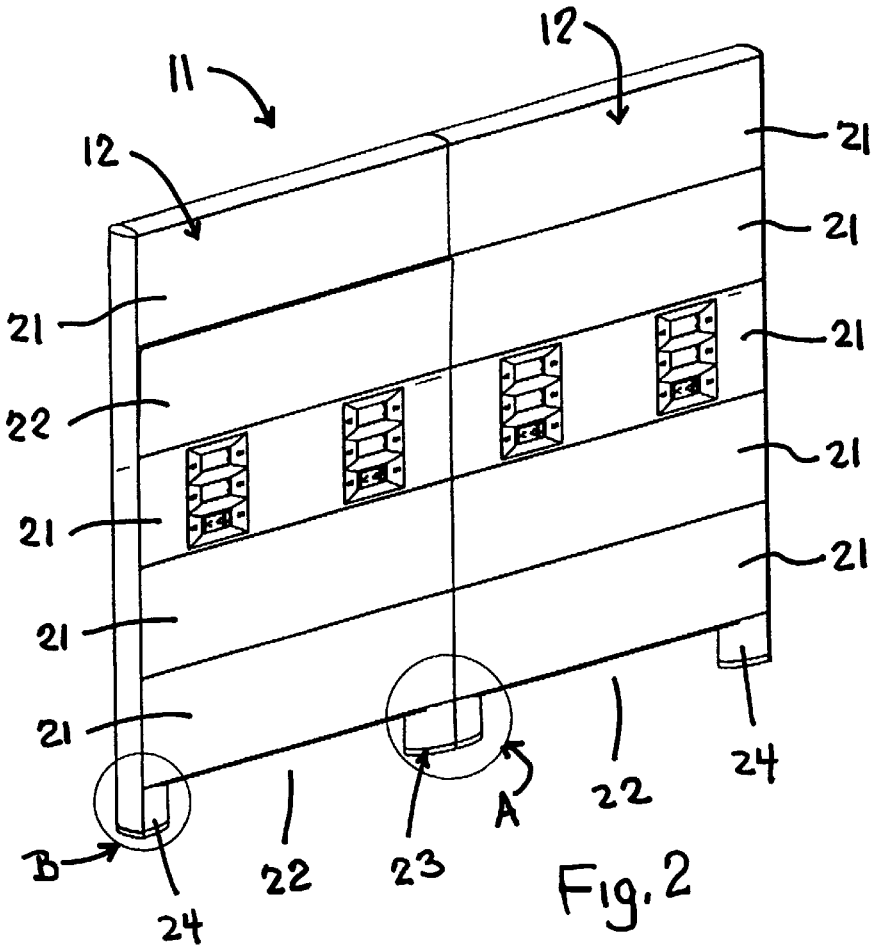
FIG. 2 is a perspective view illustrating two spine panels joined together.
Figure 20:
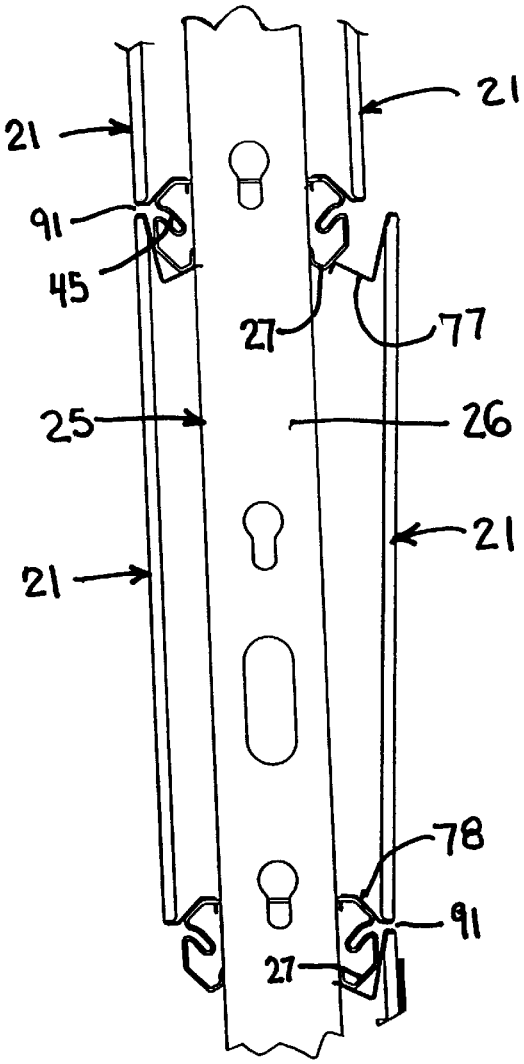
FIG. 20 is a fragmentary end elevational view of the main panel and showing cover tiles associated with both sides of the frame, with one of the cover tiles being shown partially disassembled.

As previously indicated, the opposite sides of the frame 25 are enclosed by one or more removable cover tiles 21 which, in the arrangement as illustrated by FIG. 2, extend horizontally throughout substantially the full length of the main panel. One embodiment of a cover tile 21 is illustrated in FIGS. 20–22, and specifically illustrates a cover tile having a height corresponding to one module or space so that the upper and lower edges of the cover tile engage adjacent vertically-spaced cross beams 27.

More specifically, the cover tile 21 is of a generally rectangular configuration and has a height which extends between longitudinally extending upper and lower edges 71 and 72 respectively, and terminating at end edges 73 which extend perpendicularly between the upper and lower edges. The illustrated tile 71 is formed as a generally flat plate-like sheet 74, such as by being formed from relatively thin metal, and the end edges 73 are preferably provided with inwardly turned flanges 76 therealong to improve strength and appearance. The upper and lower edges of the tile are also respectively provided with securing flanges 77 and 78 respectively for releasably connecting the tile 21 to respective upper and lower cross beams 27.

Figure 21:
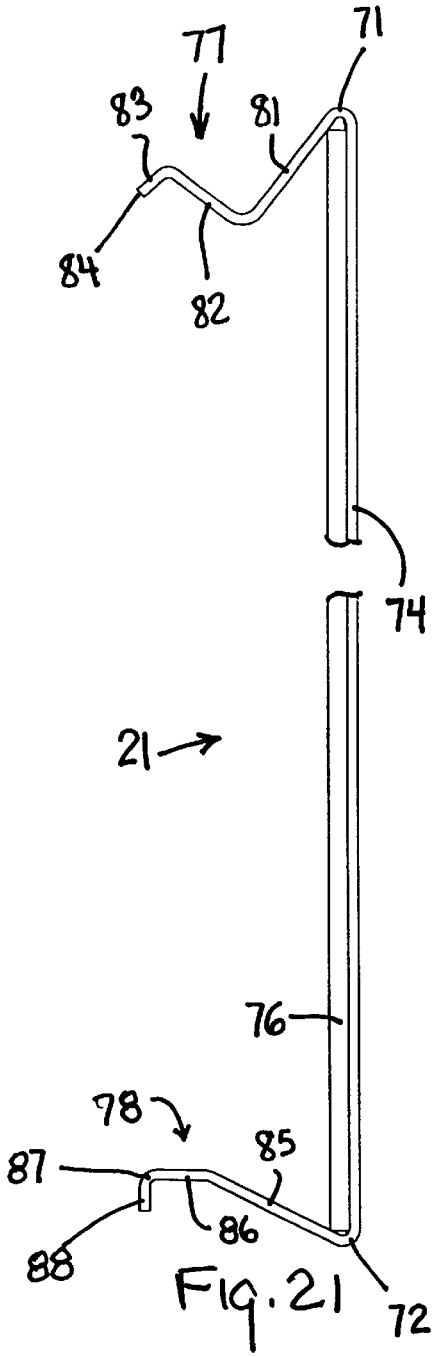
FIG. 21 is a cross-sectional view of the cover tile taken generally along line G—G in FIG. 22.
Figure 22:
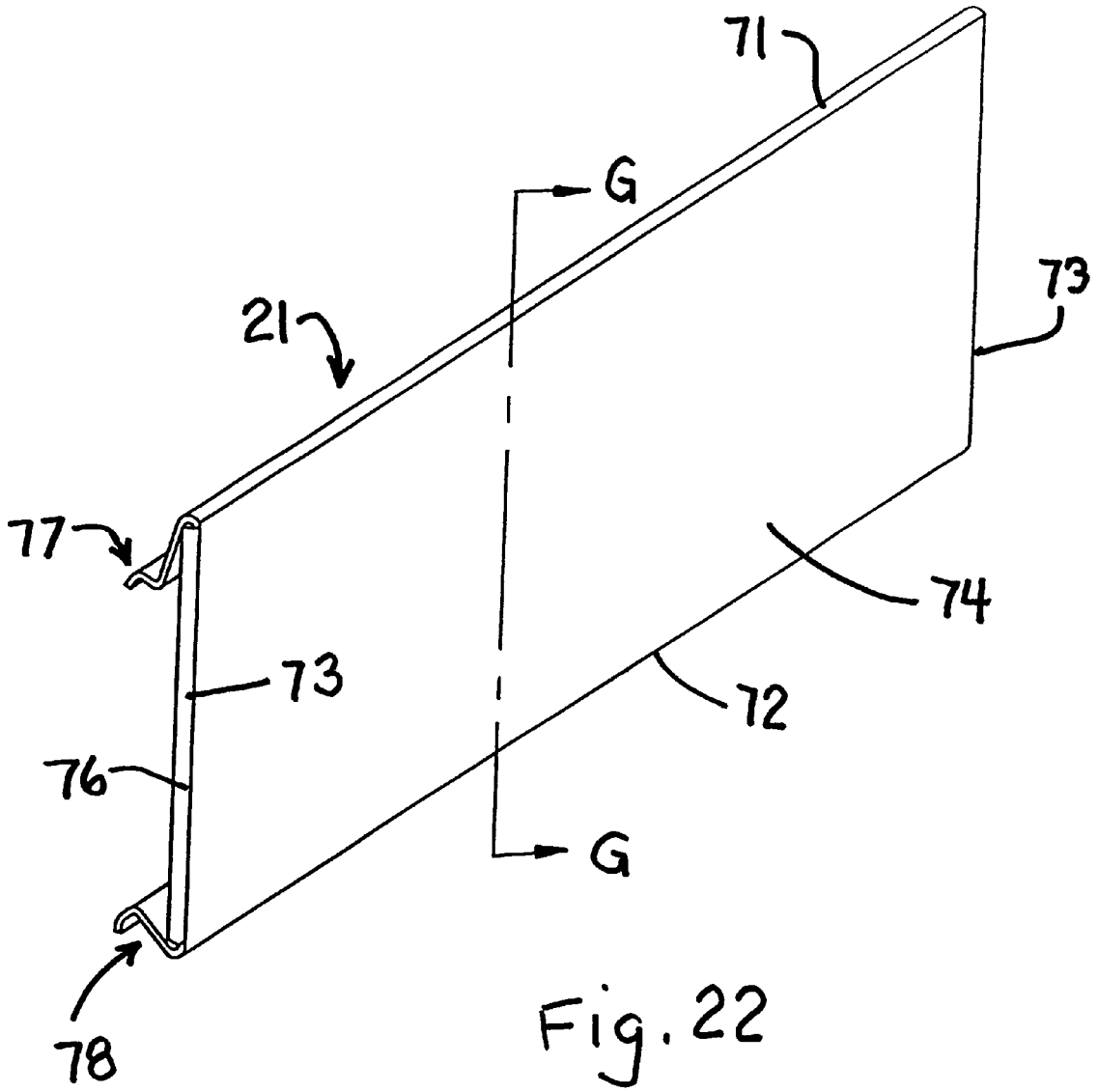
FIG. 22 is a generally front perspective view showing a typical removable covering tile for the main panel.

The upper securing flange 76, as illustrated in FIG. 21, extends longitudinally throughout the length of the tile and includes a first flange part 81 which inclines downwardly as it is cantilevered rearwardly from the upper edge. This first flange part 81 joins to an intermediate flange part 82 through a large bend angle so that the intermediate flange part 82 then angles upwardly as it projects rearwardly. The outer end of intermediate flange part 82 is in turn bent downwardly so as to join to an outer flange part 83 which then angles downwardly as it projects rearwardly so as to terminate at a free edge 84.

The flange 77 due to its cantilevered configuration and its construction from relatively thin sheet metal or equivalent, hence functions like a relatively stiff plate spring having limited resiliency, and as such can be resiliently snapped into engagement with the lower side wall portion of a cross beam 27. In particular, the flange parts 81 and 82 define a generally V-shaped notch which opens upwardly, and which creates an engagement with the V-shaped configuration defined by the wall parts 41 and 42 of the cross beam 27, as illustrated by FIG. 20.

Regarding the bottom securing flange 78, it includes an inner flange part 85 which is cantilevered rearwardly from the lower edge 72 and slopes upwardly, and it in turn joins to an outer flange part 86 which projects inwardly through a short extent and terminates at a rear edge 87. This rear edge 87, however, has several downwardly-projecting cantilevered tabs 88 formed therealong in longitudinally spaced relation, which tabs are positioned for insertion through selected ones of the slots 57 formed through the top wall 35 of the cross beam 27. The lower securing flange 78 is constructed similar to the upper flange 77 so as to have limited resilient flexibility and hence will cooperatively engage the upper portion of the side wall of the cross beam 27. For example, and as illustrated in FIG. 20, the tabs 88 are positioned so as to be aligned with and inserted through selected slots 57 in a lower cross beam 27 of a cooperating pair, and the flange 78 and specifically the inclined part 85 thereof will appropriately overlie the upper inclined beam wall 38 so as to provide proper positional support, both vertically and horizontally, for the tile 21 relative to the frame 25.

The securing flanges or hooks 77 and 78 provided along the upper and lower edges of the individual tiles 21 hence enable the lower flange 78 to be positioned on the lower cross beam 27 as indicated on the right side of FIG. 20, thus providing accurate positioning due to the engagement of the tabs 88 within the slots 57, whereupon the upper portion of the tile can be swung inwardly such that the upper flange 77 engages the upper cross beam 27 and, in response to inward pressure, the upper flange 77 resiliently deflects so as to snap into engagement with the downwardly projecting nose portion defined by wall parts 41 and 42 so as to securely but releasably hold the upper part of the tile against the beam substantially as illustrated by the left side of FIG. 20.

When two tiles 21 are mounted in vertically adjacent relationship on one side of the frame 25, each vertically adjacent pair of tiles, as illustrated by the left side of FIG. 20, have the upper edge 71 of the lower tile spaced vertically a small distance from the lower edge 72 of the adjacent upper tile, thereby defining a horizontally elongate but narrow clearance passage 91 therebetween. The passage 91 is disposed horizontally adjacent and substantially aligned with the mouth of the respective slot 45, thereby permitting insertion of appropriate hangers or brackets through the passage 92 into the respectively adjacent slot 45, as discussed hereinafter. The passage 91 has a vertical dimension which is similar in magnitude to the width of the slot 45 at its mouth.

While FIG. 20 illustrates the tile 21 having a height corresponding to one frame module or spacing so as to extend vertically between two vertically adjacent beams 27, it will be appreciated that the tile may be provided with a height so as to span two or more frame spaces, and in fact a single removable tile can be used to span the entire height of the frame so as to extend from the bottom cross beam 27B to the top cross beam 27A.

Since the illustrated embodiment of the invention has the bottom cross beam 27B mounted in an inverted position as discussed above, any removable tile which covers the lowermost frame space and which engages the lower cross beam 27B will not be provided with the securing flange 78 along the lower edge thereof, but instead will be provided securing flanges similar to the flange 77 along both the upper and lower longitudinal edges of the tile, since a lower flange of this configuration will then be able to create a snap-like engagement with the lower beam 27B due to the inverted configuration thereof.

While the tile 27 described above involves a solid sheet 24, it will be recognized that numerous types of removable tiles can be provided. For example, the tile 21 can be provided with a generally rectangular frame which defines the upper and lower longitudinal edges 71–72 and the end edges 73, which frame will again be provided with appropriate securing flanges such as 77 and/or 78 extending longitudinally along the horizontal edges thereof. Such frame can be provided with a through opening so as to provide a pass-through opening (which requires use of identical tiles on opposite sides of the wall panel), or can be provided with appropriate clear or frosted glazing. The tile frame can also have an acoustical layer such as fiberglass or the like positioned in the interior thereof so as to define an acoustical or sound absorbing tile. When the tile is of sheet metal, the surface can be provided with appropriate slots or openings to permit tools or components to be hung therefrom, or alternately can be provided with a large number of small perforations including a mesh-like screen so as to permit passage of air therethrough, the use of such tiles being particularly desirable along the lower portions of the frame. The metal tile may be appropriately painted or spray coated, or the exterior surfaces of the tiles may be covered by fabric or vinyl. The exterior surface of the tile may also be defined by a whiteboard suitable for use with erasable markers, or it may be provided with a surface suitable for tackable objects or accommodating magnets. Since removable cover tiles having these various properties are already known in the industry, further detailed description thereof is believed unnecessary.

Figure 23:
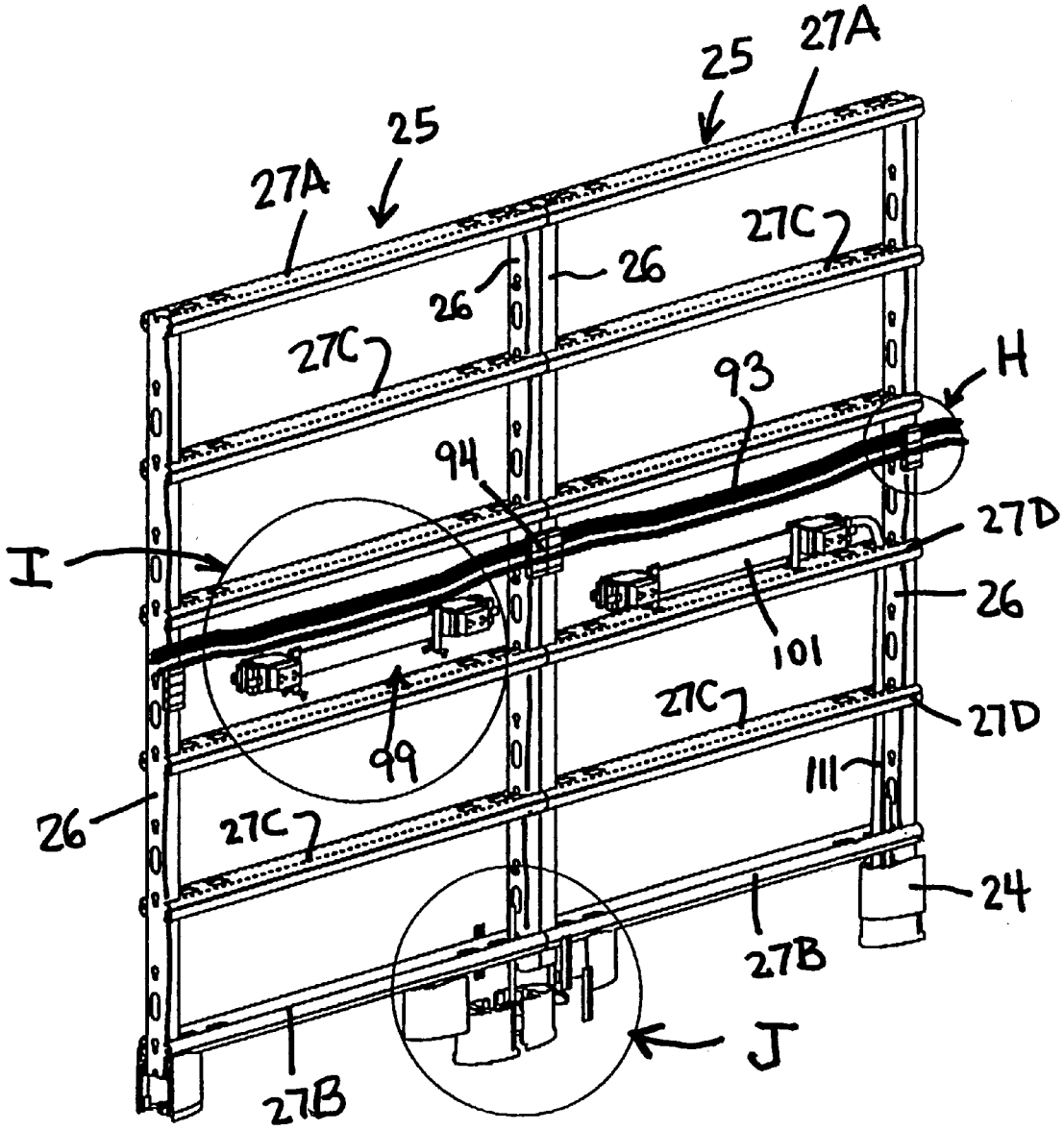
FIG. 23 is a perspective view corresponding generally to FIG. 5 but with the trim covers and cover tiles removed, the shroud at the panel junction being partially exploded, and showing telecommunication and power cabling associated with the panel frames.

Referring now to FIG. 23, there is again illustrated the main wall defined by two main panels, the frames 25 of which are fixedly secured in edge-to-edge relationship, but the cover tiles are removed for purposes of illustration. FIG. 23 illustrates how the main wall of this invention permits cabling, both electrical and telecommunication cabling, to be accommodated within the interior of the individual panels and to extend both vertically of the panel and horizontally between adjacent panels.

Figure 24:
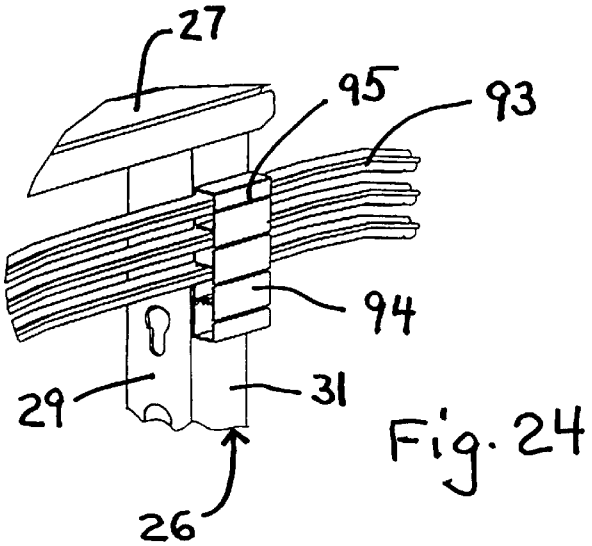
FIG. 24 is an exploded view of the circled area designated H in FIG. 23 and showing telecommunication cables retained within a clip structure which attaches to a face of the panel upright.

More specifically, there is illustrated a plurality of conventional telecommunication cables 93 which are extending internally along a plurality of panels, preferably on an elevation so as to be adjacent but above work-surface height so as to be readily accessible. These cables 93 in the illustrated embodiment are supported by clips 94 (FIG. 24) which secure to the outer surface of upright side wall 31. The clip is disposed between the cover tile and the upright, within the vertical clearance space defined between the sidewardly-protruding cantilevered beam portions 27D. The clip 94 may be of any desired configuration and, in the illustrated embodiment, includes several horizontal channels which are vertically stacked on top of one another so as to accommodate separate cables, and each channel has an outer wall which is longitudinally split as indicated at 95 so as to allow the cables to be sidewardly pushed through the split into the respective channel, thereby facilitating laying in of cables along the faces of a plurality of preassembled panel frames. These clips 94 and the cables 93 accommodated thereby will then be fully enclosed by the tiles 21 when they are mounted on the frame.

While not illustrated, it will be appreciated that the telecommunication cables can be connected to appropriate terminals such as conventional telecommunication jacks, which jacks can be mounted in appropriate mounting plates which in turn are accessible through one of the removable tiles. Referencing FIG. 5, for example, the panel can be provided with a tile 21C having an opening 96 therethrough which in turn accommodates a face plate 97, such as a molded plastic face plate which snaps into the opening 96. This face plate 97 in turn may have one or more utility outlet openings 98 formed therein, which openings individually accommodate telecommunication connectors or electrical receptacle units. The telecommunication cabling and the connectors joined thereto provide readily available connections for telephones and computers as associated with the workstations disposed adjacent and along the spine wall.

Figure 25:
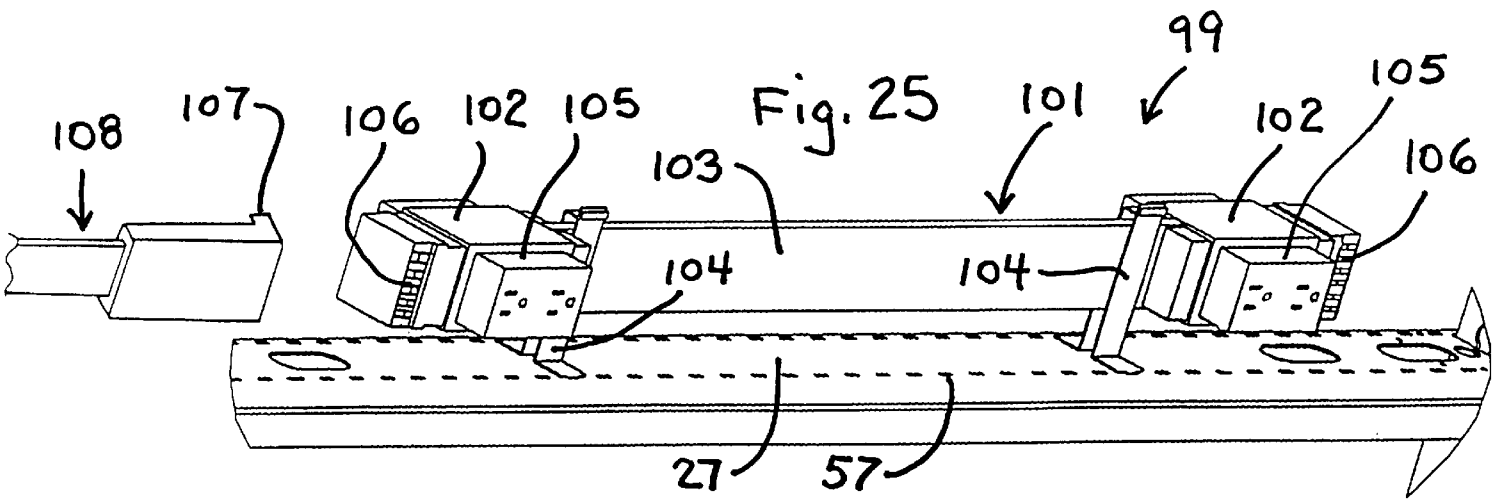
FIG. 25 is an exploded view of the circled area designated I in FIG. 23 and showing mounting of an electrical power system interiorly of the panel.

In addition to telecommunication cabling, the panels also permit an electrical power distribution system 99 to be mounted on and extend anteriorly along the series of joined panels. As illustrated by FIGS. 23 and 25, the electrical system may comprise an electrical power module 101 which includes a pair of power blocks 102 joined by an elongate connector 103 through which appropriate electrical cables extend. This module can be provided with appropriate mounting clips or brackets 104 which, at the lower ends thereof, are provided with appropriate securing fingers, such as L-shaped fingers, which project downwardly for engagement into selected ones of the slots 57 so as to fixedly secure the power module 101 on one of the cross beams 27 so that the power module is hence disposed interiorly of the frame, and between the removable tiles. The power blocks can be provided with movable receptacle units 105 which typically attach to one or both sides of the power block 102, which receptacle units in turn are accessible through one of the openings 98 formed in the face plate 97 (FIG. 5) to permit conventional electrical plugs to be engaged therewith. The ends of the power blocks are typically provided with a connecting terminal arrangement, i.e. a plug arrangement 106, and this in turn is engageable with a similar mating terminal arrangement 107 defined on one end of an electrical connector 108. This connector has a similar terminal 107 at the other end, and can be fed through the aligned openings 33 defined in adjacent uprights 26 to permit detachable connection to the power module 101 of an adjacent panel. The prefabricated electrical arrangement 99 is conventional, and one known arrangement is illustrated by U.S. Pat. No. 4,781,609.

In addition, cabling can be run vertically interiorly of the frame 25, such as indicated by the electrical cable 111 in FIG. 23. Such cable represents an infeed cable which extends upwardly from the floor, such as from below a raised floor, through the end shroud 24 from which it then extends upwardly through the openings 56 formed through the connector beams until reaching the desired interior channel space. In some situations the vertically extending electrical cable may be capable of being fed upwardly exteriorly over the cross beams but behind the tiles so as to eliminate having to feed the cable through openings, but such arrangement may require that the side walls of the cross beams be provided with vertical grooves or notches therein so as to accommodate the cable, and this in turn would interfere with the continuous hanger grooves 45 which extend along the beam, and thus such modification is less desirable.

Figure 3:
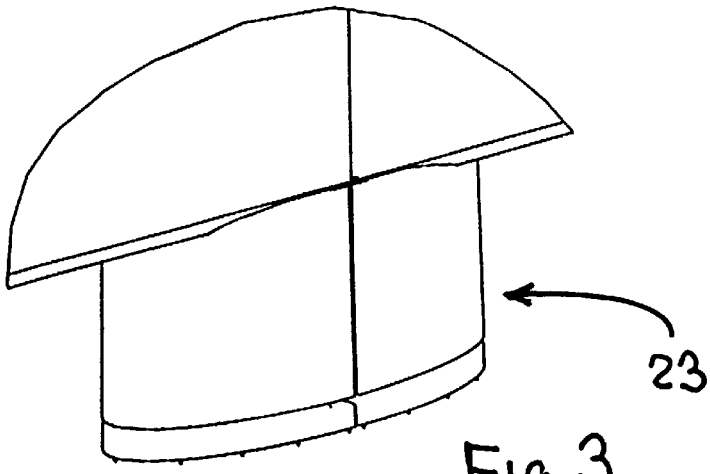
FIG. 3 is an enlargement of circled area A in FIG. 1 and illustrates a cable shroud which surrounds the panel legs at a panel junction.
Figure 4:
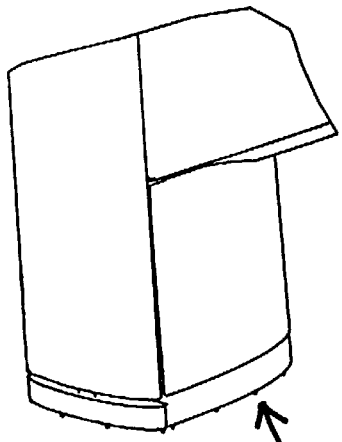
FIG. 4 is an enlargement of circled area B in FIG. 2 and illustrates the shroud which encircles the panel leg adjacent a free end of the spine wall.
Figure 6:
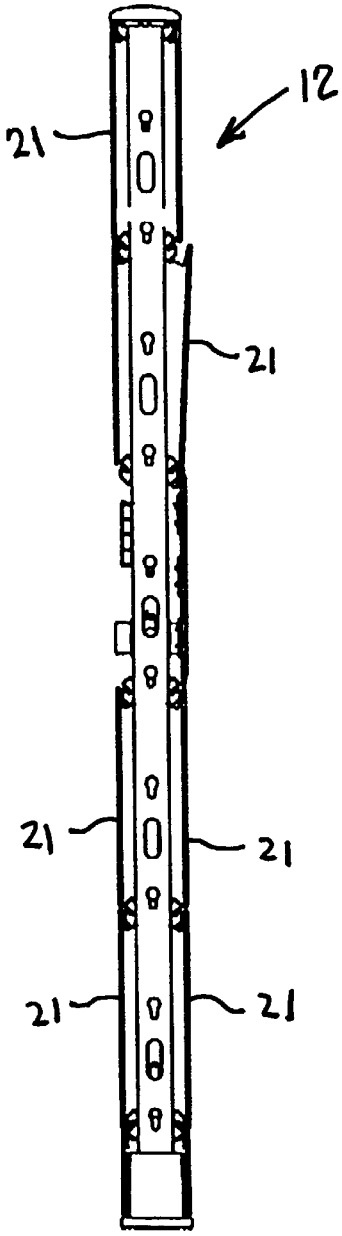
FIG. 6 is an end elevational view, with the edge trim removed, of the main panel illustrated in FIG. 5.

The leg shroud 23, as diagrammatically illustrated in FIG. 3, will now be described with reference to FIGS. 26–29.

The leg shroud 23 is defined by two substantially identical shroud subassemblies 113, each of which constitutes one-half of the finished shroud 23. These two subassemblies 113, when joined together, define a generally upright hollow tubular configuration which, when viewed in horizontal cross-section, has a rounded but elongated oval or elliptical shape.

Each subassembly 113 includes upper and lower shroud members 114 and 115 respectively, with the lower shroud member 115 being at least partially vertically telescoped into the interior of the upper shroud member 114 so as to permit vertical adjustment in the height of the shroud.

The lower shroud member 115 includes an upright perimeter wall 116 which has a configuration which defines approximately one-half of an ellipse or oval, which wall adjacent the free edges thereof includes an inwardly projecting upright wall 117 which in turn has a pair of sidewardly spaced and generally parallel upright flanges 118 and 119 cantilevered horizontally therefrom in generally parallel relationship with the adjacent portion of the perimeter wall 116. These flanges 118–119 define an elongate channel-like groove 121 extending vertically therealong and opening outwardly in a direction toward the other shroud half (not shown), and one of the flanges has appropriate serrations or gripping ribs 122 on the inner surface thereof. The groove 121 accommodates therein one side of a vertically elongate connecting strip 123, the latter having side leg portions 124 each provided with a serrated or gripping surface 125. One of the leg portions 124 is inserted into the groove 121 and is securely retained therein, whereas the other leg portion 124 is insertable into the groove or channel of the opposed mating lower shroud member 115 so as to define a substantially continuous enclosure.

The lower shroud member 115, adjacent the upper edge thereof, has a flange 126 which projects inwardly from the upper edge of each side of the wall and is cantilevered so as to terminate at a free end which defines an abutting surface 127 and an undercut recess-defining surface 128. The opposed flanges 126 are separate from one another to provide the lower shroud member 115 with flexibility but, when positioned around a panel foot, the opposed surfaces 128 define therebetween a groove which accommodates the stem 61 of the panel foot and permits side impact forces imposed on the shroud to be transmitted through the flange 126 to the stem.

The lower shroud member 115, along the lower edge of the peripheral wall, also has a lower perimeter wall portion 131 which is configured like the main perimeter wall 116 but which is offset outwardly a small amount and is joined to the lower edge of the perimeter wall 116 through a small horizontally extending transition wall which defines an upwardly facing shoulder 132. This shoulder 132 supports the lower edge of the upper shroud member 114 when the latter is telescoped around the lower shroud member. The lower free edge of the lower peripheral wall part 131 can be provided with suitable cleats 133 for gripping a carpet or the like.

Considering now the upper shroud member 114, it is constructed somewhat similar to the lower shroud member 115 in that it also includes an upright peripheral wall 135 having a configuration which approximately equals one half of an oval or ellipse, with the configuration of peripheral wall 135 corresponding to but being somewhat larger than peripheral wall 116 so as to permit these two walls to telescopically vertically slide one over the other. The peripheral wall 135 adjacent each upright free edge thereof, also has opposed upright wall portions 136, 137 spaced apart and defining an upright channel 138 therebetween, which channel opens horizontally toward a similar channel in the opposed upper shroud member. This channel 138 has gripping serrations or ribs 139 on the inner surface of one wall, such as wall 137, and grippingly accommodates therein an elongate extruded plastic securing strip 141, which strip is substantially identical to the securing strip 123 described above.

The upper shroud member 115 also has top wall flanges 142 which are cantilevered inwardly from the upper edge of the peripheral wall 135 adjacent opposite sides thereof. Each of these flanges 142 defines a pair of generally parallel slots 143 and 144 which are laterally and sidewardly spaced apart and which open toward the open mouth of the shroud member. These slots cooperate with headed projections 145 (FIG. 29), such as headed screws, which project downwardly from the bottom wall of the lower cross beam 27B to thus secure the upper shroud member 114 to the lower cross beam.

Figure 26:
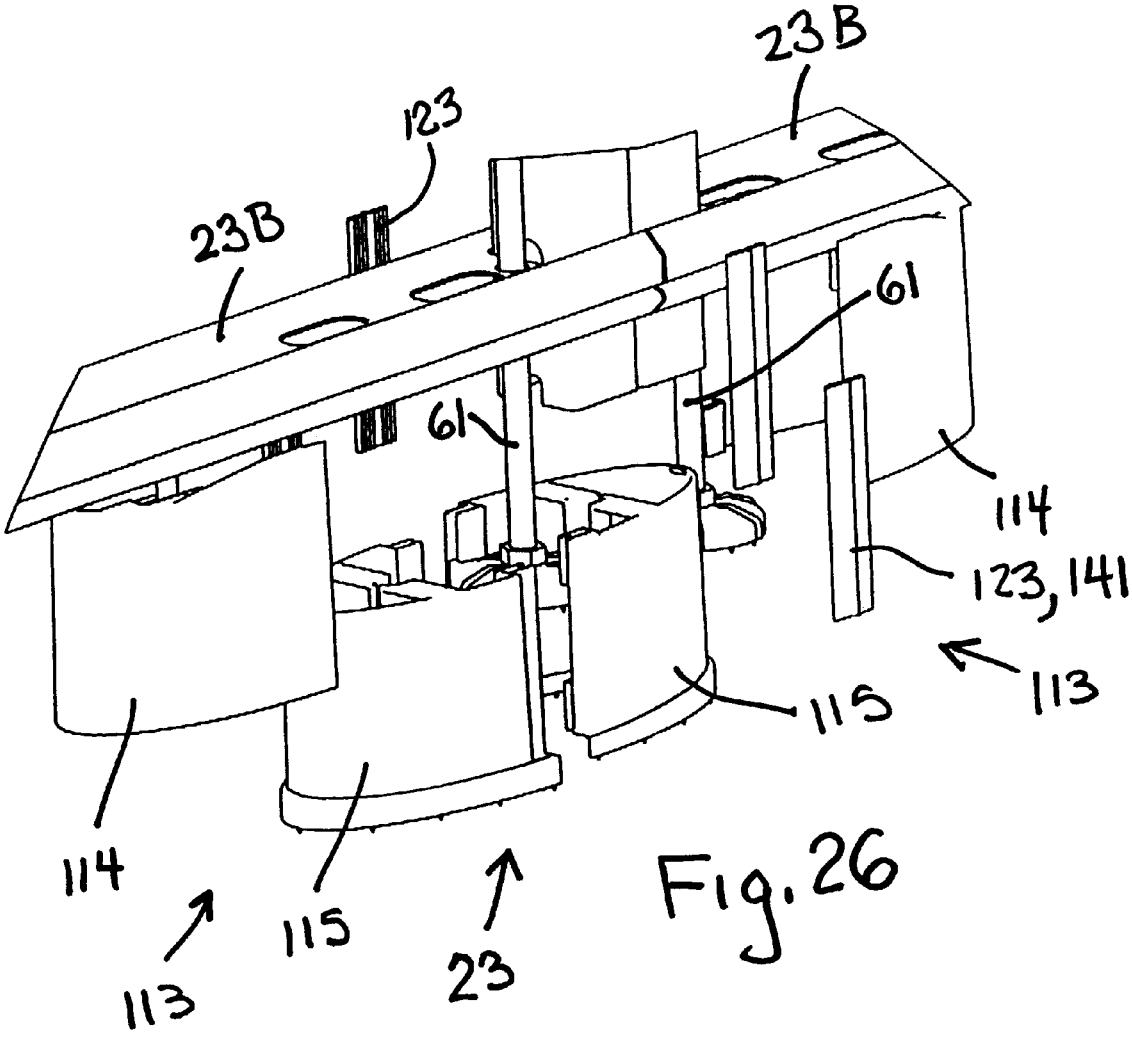
FIG. 26 is an enlargement of the circled area designated J in FIG. 23 and illustrating the cable shroud which surrounds the support feet at the panel junction.
Figure 27:
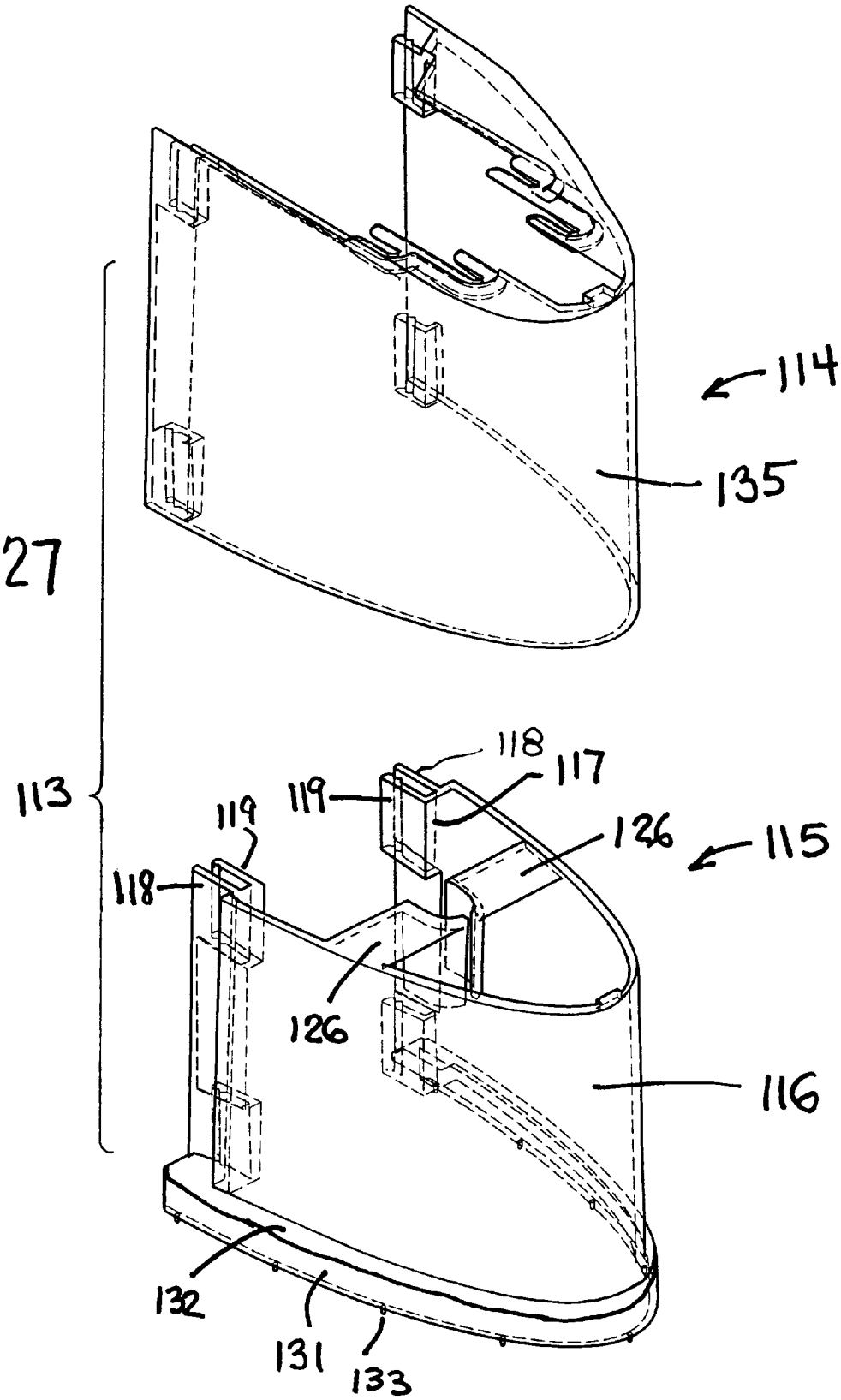
FIG. 27 is an exploded perspective of half of he cable shroud of FIG. 26.
Figure 28:
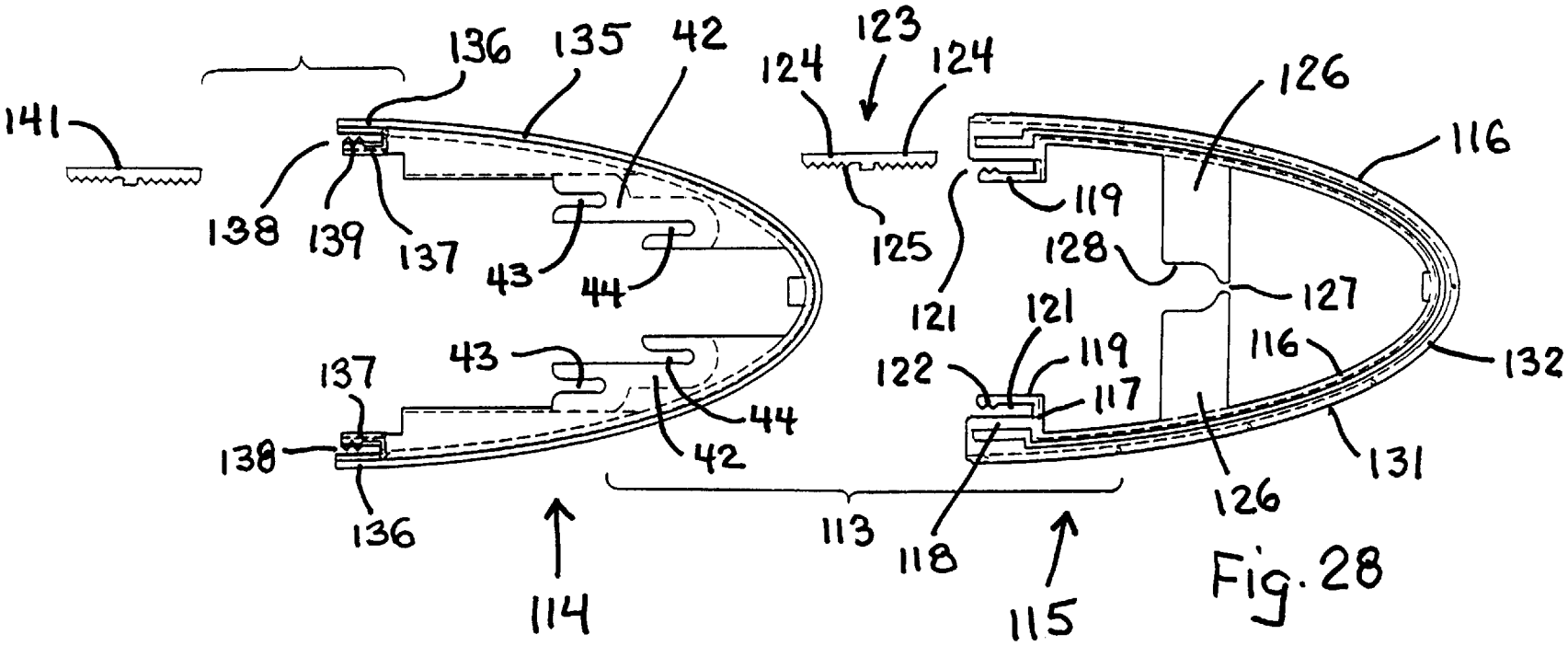
FIG. 28 is an exploded top view which illustrates the telescopic upper and lower members associated with one-half of the cable shroud shown in FIG. 26.
Figure 29:
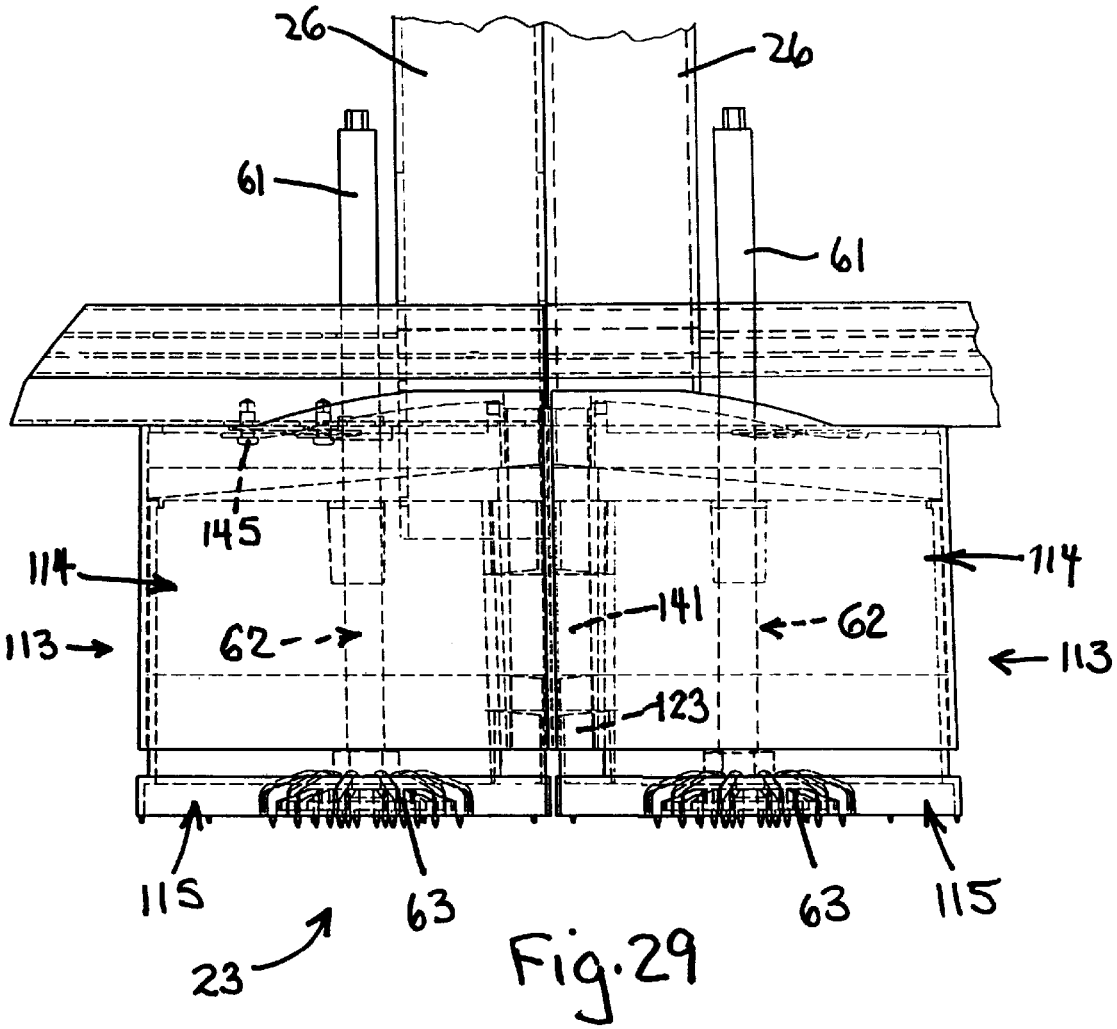
FIG. 29 is a side view of the assembled shroud in a partially extended telescoped condition.

To assemble the shroud 23, each shroud subassembly 113 is assembled by telescoping the upper shroud member 114 vertically downwardly over the lower shroud member 113. The two shroud subassemblies 113 are thus disposed in spaced but opposing relationship so as to enclose the two leg structures 62 therebetween generally as illustrated in FIG. 26. The two shroud subassemblies 113 are then moved inwardly toward one another, and the upper shroud members 114 are slidably elevated so that the inward movement causes the slots 143 and 144 to slidably engage the headed projections 145 secured to the underside of the lower cross beams, thereby suspending the upper shroud members 114 from the cross beams while allowing the lower shroud members 115 to be slidably moved downwardly for proper engagement with the floor. When the shroud members are moved inwardly substantially into abutting engagement with one another, the securing strips 124 and 141 provided along both edges of one shroud subassembly 113 are inserted into the respective channels provided along the edges of the opposed shroud subassembly 113 so as to secure the two shroud subassemblies together so that the upright free edges of the respectively opposed shroud members 114 and 115 substantially abut, and the shroud thus defines a substantially complete oval-shaped enclosure which surrounds and totally hides the leg structures 62. At the same time, the open interior of the shroud 23 enables it to communicate with a predefined or predrilled hole (not shown) formed in the floor so that cables can extend upwardly from below the floor through the interior of the shroud 23 and thence upwardly through the outermost opening 56 associated with one of the beams 27B, which outermost openings 56 are positioned so as to directly communicate with the interior of the shroud 23.

The shroud members 114 and 115, in the illustrated arrangement, are formed as integral one-piece members, such as by being molded of a plastics material.

Figure 5:
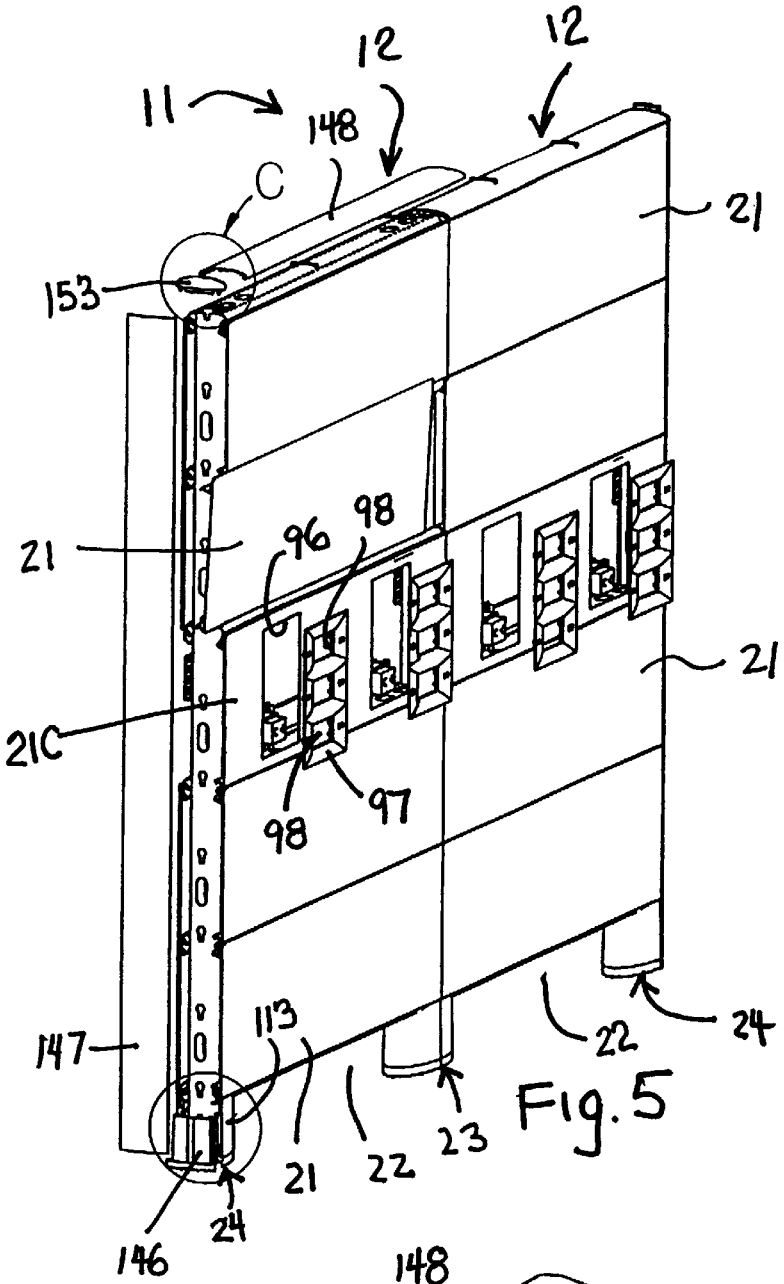
FIG. 5 is a perspective view which corresponds to FIG. 2 but illustrates the top cap, the vertical edge trim and the utilities trim plates in exploded or separated condition, and also illustrating one of the tiles in a partially disassembled condition.
Figure 7:
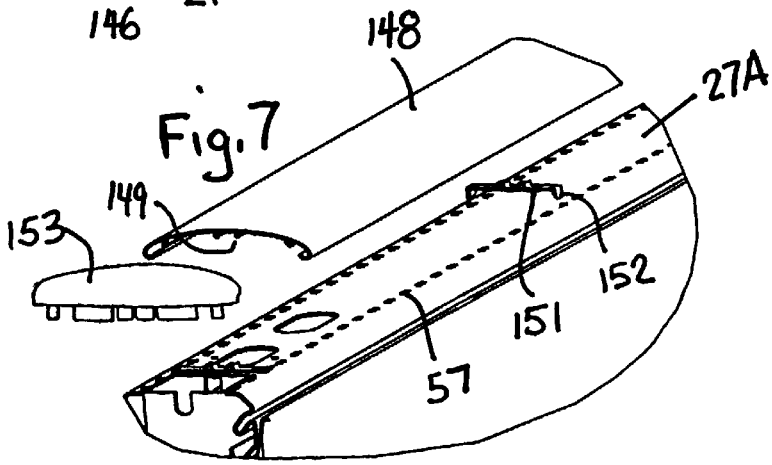
FIG. 7 represents circled area C in FIG. 5 and illustrates the top and corner caps separated from the top support beam of the frame, and further illustrating the clip which cooperates between the top support beam and the top cap.

The shroud 23, by being defined by opposed and substantially identical shroud subassemblies 113 which cooperatively engage to define a complete oval-shaped hollow configuration, are used at the junction where two panel frames 25 rigidly join so as to surround and enclose the two legs which exist at the junction. At the end of a series of panels, however, since only one leg exists, the modified shroud 24 as illustrated by FIG. 5 is utilized. The shroud 24 again includes a shroud subassembly 113 which mounts on and surrounds the leg in the same manner as described above, but the subassembly in this variation cooperates with an outer upright end member 146 which is positioned adjacent and extends transversely across the outer edge face of the upright and has edge flanges which cooperate with the edges of the lower shroud member 115 for securement thereto. This end shroud member 146 is then in turn covered by an elongate trim strip 147 (FIG. 5) which overlies the end shroud member 146 and cooperates with the edges of the outer shroud member 114. This vertical trim strip 147 extends upwardly through substantially the full height of the panel so as to enclose the outer surface of the frame and has suitable connectors thereon which enable it to create a snapped connection with the frame, such connections being conventional and hence not shown. This vertical trim strip 147 has a width which is suitable so as to close off the exposed end of the panel.

The upper edge of the main panel 12 is also suitably enclosed by a top cap or trim strip 148 (FIGS. 5 and 7) which has a length generally corresponding to the length of the panel. This top cap 148, which is typically an elongate extruded plastic member, has securing ribs 149 extending along the inner surface thereof, and these ribs in turn cooperate with securing ribs provided on the upper surface of a plurality of retaining clips 151. A plurality of such clips 151 are mounted to the top cross beam 27A at spaced locations therealong, and these clips 151 have downwardly projecting legs 152 which project into and engage with the slots 57 so as to positionally secure the clips. The top cap 148 can thus be snapped into engagement with the plurality of spaced clips 151 to thus secure the cap along the top of the panel. The cap has a width and suitably rolled longitudinally extending edges so that the latter edges generally overlap the upper edges of the uppermost tiles 21, but define a narrow passage therebetween so as to provide access to the hanger groove 45 associated with the top cross beam 27A.

There is additionally provided a corner cap 153 which has downwardly projecting legs which snap into the upper end of the vertical trim strip 147, and the corner cap 153 in addition has further legs which typically project horizontally for engagement with the top cap 148 to provide securement therewith and hence provide an aesthetic rounded corner between the edge trim 147 and the top cap 148. Such trim structures are conventional and widely used, and hence can assume a wide variety of shapes so that further description thereof is believed unnecessary.

After the panel frames 25 have been rigidly joined in end-to-end relationship and the cover tiles 21 mounted on the individual main panels so as to define a spline wall as discussed above, then components or branch walls can thereafter be suitably secured to the main wall. In the assembled condition, even if one side of the panels 12 is provided with a single removable tile, at least the hanger slots 45 associated with the top cross beam 27A and the bottom cross beam 27B are always accessible and hence permit connection to branch panels, as subsequently discussed. However, since at least one side of the frames will typically have two or more removable tiles associated therewith, and frequently the tiles will have a height corresponding to the module or space height such that each vertically adjacent pair of tiles will hence define therebetween a passage 91 aligned with the adjacent hanger slot 45 as illustrated in FIG. 20, appropriate hangers can be inserted into the slots 45 so as to permit external load-bearing components such as worksurfaces, cabinets, shelves and the like to be secured to and cantilevered outwardly from one or both sides of the spine wall.

Figure 30:
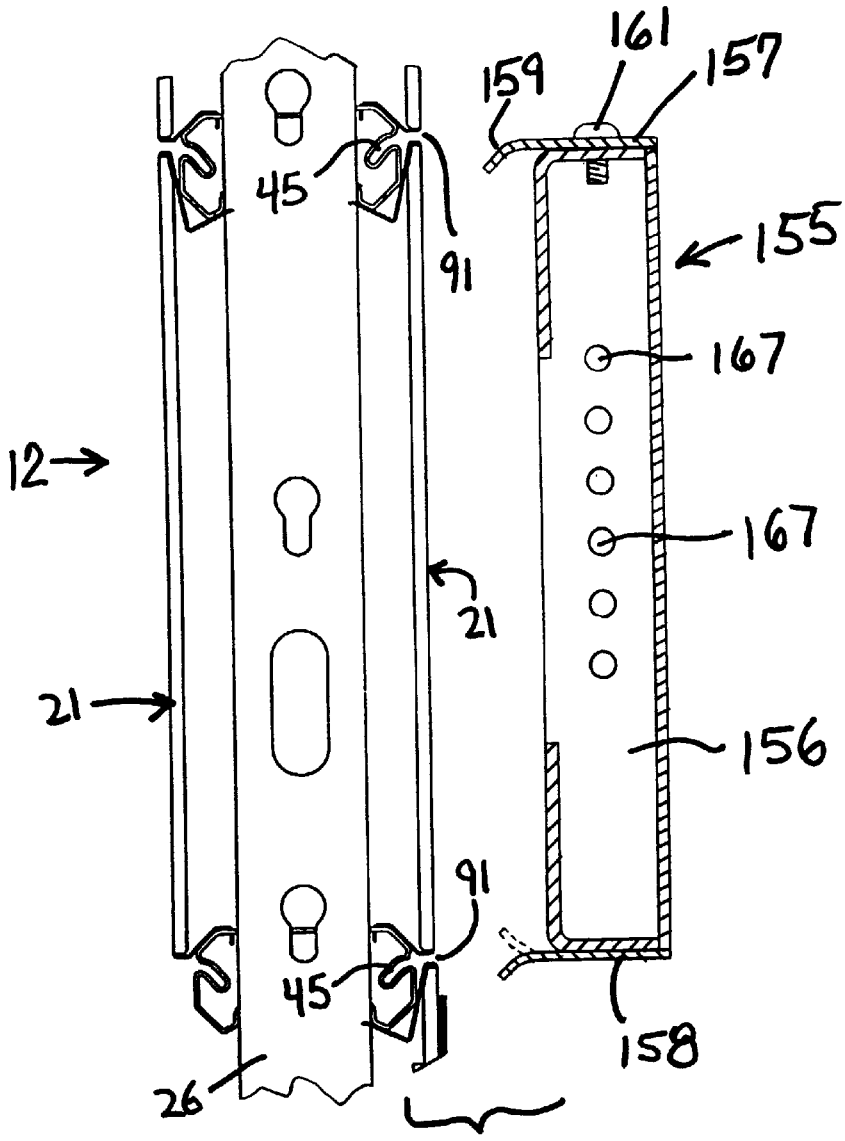
FIG. 30 is a side elevational view, in cross-section, and illustrating a hanger structure which extends vertically between and mounts on two support beams of the frame for permitting mounting of an external component on the main panel.
Figure 31:
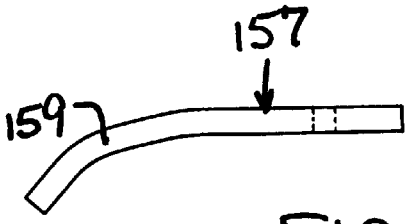
FIG. 31 is an enlarged view illustrating the configuration of the slot-engaging hanger element associated with one end of the hanger structure shown in FIG. 31.

Referring to FIGS. 30 and 31, there is illustrated one type of hanger arrangement 155 for securing a component to the spine wall. The hanger arrangement 155 includes a vertically elongate support 156 which, in the illustrated embodiment, is generally channel-shaped and at opposite ends is provided with first and second projecting hangers 157 and 158 respectively. The hangers 157 and 158 each include a plate-like hanger part 159 which is cantilevered outwardly and has a downward arcuate configuration which approximately corresponds to the downward arcuate curved configuration of the hanger slot 45 defined by the cross beam 27. The hangers 157 and 158 are vertically spaced by a distance which equals the vertical spacing between the slots 45 of adjacent cross beams, or a multiple of this spacing, depending upon the length of the vertically elongate hanger support 156. The one hanger 157, namely the hanger at the upper end of the support in the illustrated embodiment, is detachable from the hanger support 156, and for this purpose the hanger support 156 and the hanger 157 have overlapping plate portions which can be detachably fixedly joined by means of one or more securing screws 161.

To attach the hanger arrangement 155 to the spine wall, the detachable hanger 157 is detached from the support 156.

The remaining hanger 158 is then inserted into its respective slot 45 (the lower slot in FIG. 30) by vertically angularly rotating the hanger arrangement until the free end of hanger 158 is substantially aligned with the passage 91 defined between adjacent tiles 21. The free end of the hanger 158 is then moved into the passage 91 and the hanger arrangement is substantially simultaneously angularly rotated counter-clockwise toward the wall panel so that the arcuate curvature of the hanger 158 is slidably inserted into and through the arcuate curvature of the respective hanger slot 45. The separated hanger 157 is inserted into the upper slot 45 using a corresponding rotary or arcuate movement of the hanger until the upper hanger 157 is seated in the upper slot 45, such normally either being done before insertion of the lower hanger or, if done after, then it is inserted laterally adjacent the hanger arrangement 155 and is then laterally slid along the slot 45 until the mounting portion of the hanger 157 overlaps the upper end of the support 156. The securing screws 161 are then inserted and tightened so as to fixedly join the upper hanger 157 to the support 156. When so joined, the hanger arrangement 155 cannot be detached from the wall panel without first again separating the hanger 157 from the hanger support 156.

Prior to full tightening of the securing screws 161, the assembled hanger arrangement 155 can be slidably moved along the slots 45, including across the junction where adjacent panel frames are joined together, so as to position the hanger arrangement at any desired location longitudinally along the spine wall. Once at the desired location, the screws 161 are then preferably fully tightened, and this thus secures the hanger arrangement to the wall at that location. The hanger can then have an external component attached thereto.

With reference to FIG. 32, there is illustrated a worksurface 160 which can be attached to the hanger arrangement 155 of FIG. 30. In this regard, a worksurface is typically provided with a pair of support arm arrangements 162 secured to the underside thereof in laterally spaced relation, and each support arm arrangement 162 cooperates with a respective one of the hanger arrangements 155. The support arm arrangement includes a vertically elongate channel 163 in which the support member 156 is slidably received. The channel 163 has a pair of inclined slots 164 formed in the side legs thereof and opening inwardly from the rear edge. A detent-type securing pin 165 having an enlarged knob 166 on one end, can be slidably inserted into and supported in the slots 164 defined on the side channel legs. A pair of such pins are preferably provided, and these securing pins can be inserted through appropriate openings 167 formed through the hanger support 156 whereby the pair of securing pins hence stably support the worksurface support arm assembly 162 on the hanger arrangement, and at the same time permit the elevation of the worksurface to be selected and/or adjusted depending upon which holes 167 are utilized for engagement with the securing pins 165.

It should be noted that the hanger 158 can also be removably mounted and remounted in an inverted position substantially as indicated by dotted lines in FIG. 30, thereby enabling the hanger to be used for cooperation with the slot 45 provided in the inverted bottom cross beam 27B.

Figure 33:
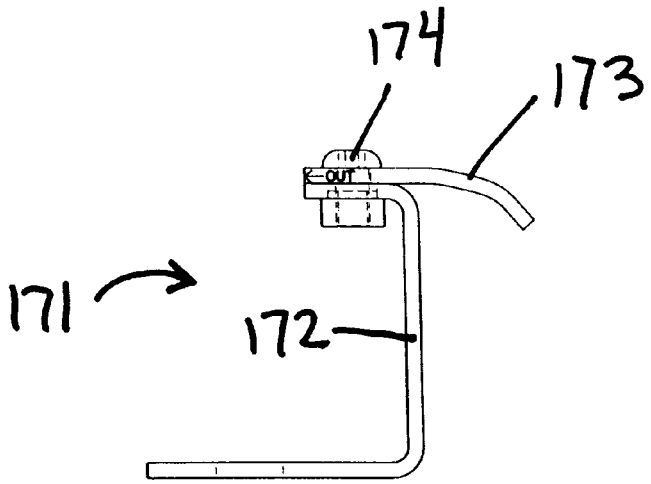
FIG. 33 is a side elevational view of a modified hanger structure which engages one of the support beam slots and cooperates with an external component, such as one edge of a worksurface.
Figure 34:
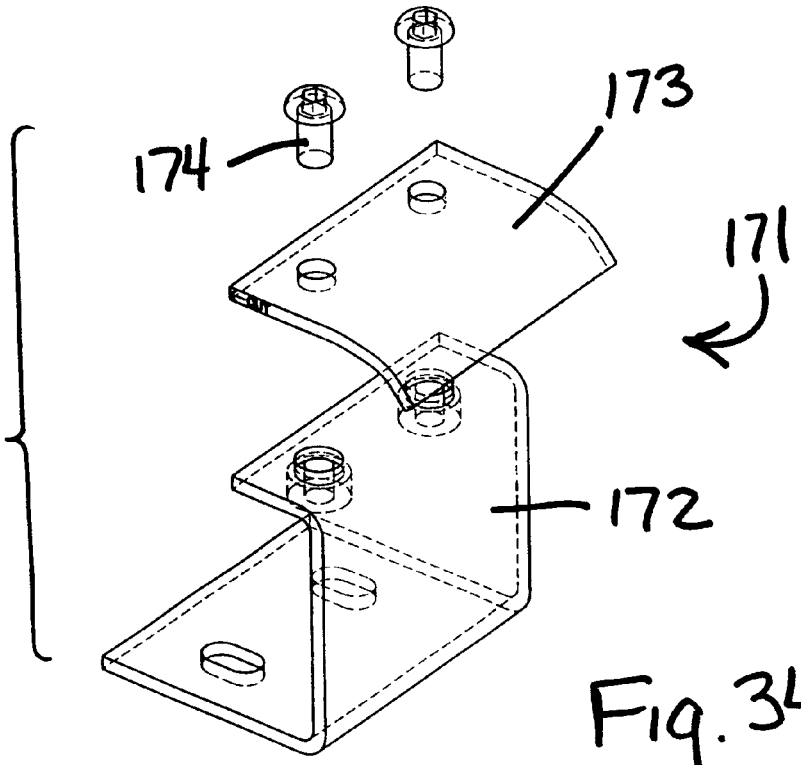
FIG. 34 is an exploded perspective view of the hanger shown in FIG. 33.
Figure 37:
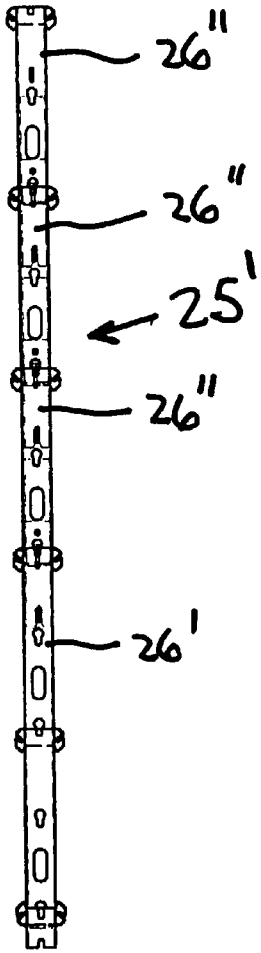
FIG. 37 is an end elevational view of the frame shown in FIG. 36.

FIGS. 33 and 34 illustrate a further hanger arrangement 171 which cooperates with a single cross beam 27 and is intended for mounting only smaller lighter-weight objects, or which can be used for securing an edge of a worksurface so long as the worksurface has other secondary support. The hanger arrangement 171 of FIGS. 34–35 includes a support channel 172 having an upper leg which supports the outer part of a hanger member 173, the latter being secured to the upper leg by a pair of securing fasteners or screws 174. The hanger 173 has a configuration identical to the hanger 157 described above, and is insertable into the respective beam slot 45 by a vertical rotary movement within a plane generally perpendicular to the side surface of the wall.

A still further modification of a hanger arrangement 175 is illustrated in FIG. 35. This arrangement corresponds generally to the hanger arrangement 155 of FIG. 30 in that it has an elongate support 176 provided with rearwardly protruding hangers 177 and 178 at opposite ends thereof, the latter having the same arcuate shape so as to require rotary movement to permit insertion into the beam slots 45. The uppermost hanger 177 is detachably secured to the upright support 176 by securing screws 179, and in this embodiment includes an intermediate offset part 181 between the hanger body and the mounting part so as to provide additional clearance for use with certain types of components, such as cabinets having top and bottom walls since the offset 181 provides sufficient clearance below a cabinet top wall as to facilitate access to the securing screws 179, such as by means of an Allen wrench.

The support 176 in this arrangement has an upwardly opening slot 182 which can accommodate therein a mounting pin provided on a side wall of a component, such as a side wall of a cabinet, so that after the hanger arrangement 175 is secured to the wall, the cabinet can be moved into position whereby a pin projecting from the inner side wall of the cabinet can be aligned with and then lowered into the slot 182 so as to provide support for the cabinet. Additional securing screws can then be inserted through the remaining slots 183 so as to effect fixed securement of the cabinet to the hanging arrangement 175. It will be appreciated that a pair of hanging arrangements 175 will typically be utilized, whereby the arrangements will be suitably sidewardly spaced so as to provide securement to the right and left side walls of the cabinet.

A side support leg arrangement, often referred to as an outrigger can also be attached to the spine wall and project sidewardly for supportive engagement with the floor. The outrigger preferably has upper and lower hangers mounted on a support which projects transversely from the wall and has a floor engaging foot. At least one of the hangers is detachable from the outrigger support. In this case the hangers have the arcuate configurations thereof disposed in opposed relationship with one another so that the lowermost hanger will engage within the slot 45 of the bottom cross beam 27B, whereas the upper hanger will engage within the slot of one of the intermediate cross beams 27C. This opposed relationship between the curvature of the hangers, when they engage the respective cross beams, effectively creates a vertical compression on the frame of the panel and hence provides for secure and strong connection of the outrigger to the panel to hence provide for desired supportive stability of the wall.

Referring now to FIGS. 36–40, there is illustrated a variation of the frame for the main or spine panel of the present invention. More specifically, the frame 25' is of a vertically stackable construction so as to permit the overall height of the panel to be varied in terms of the number of modules which are vertically stacked.

More specifically, the frame 25' includes a base frame subassembly 191 which is of a construction similar to the frame 25 described above except that base frame subassembly 191 is only two modules high. That is, the base frame subassembly 191 includes upright segments 26' which are rigidly joined by top and bottom cross beams 27A and 27B respectively, and which are also rigidly joined by only a single intermediate cross beam 27C. This base frame subassembly 191 can, by itself, be used to define a panel of relatively low height, such as a panel having a height in the neighborhood of approximately 30 to 32 inches.

Figure 36:
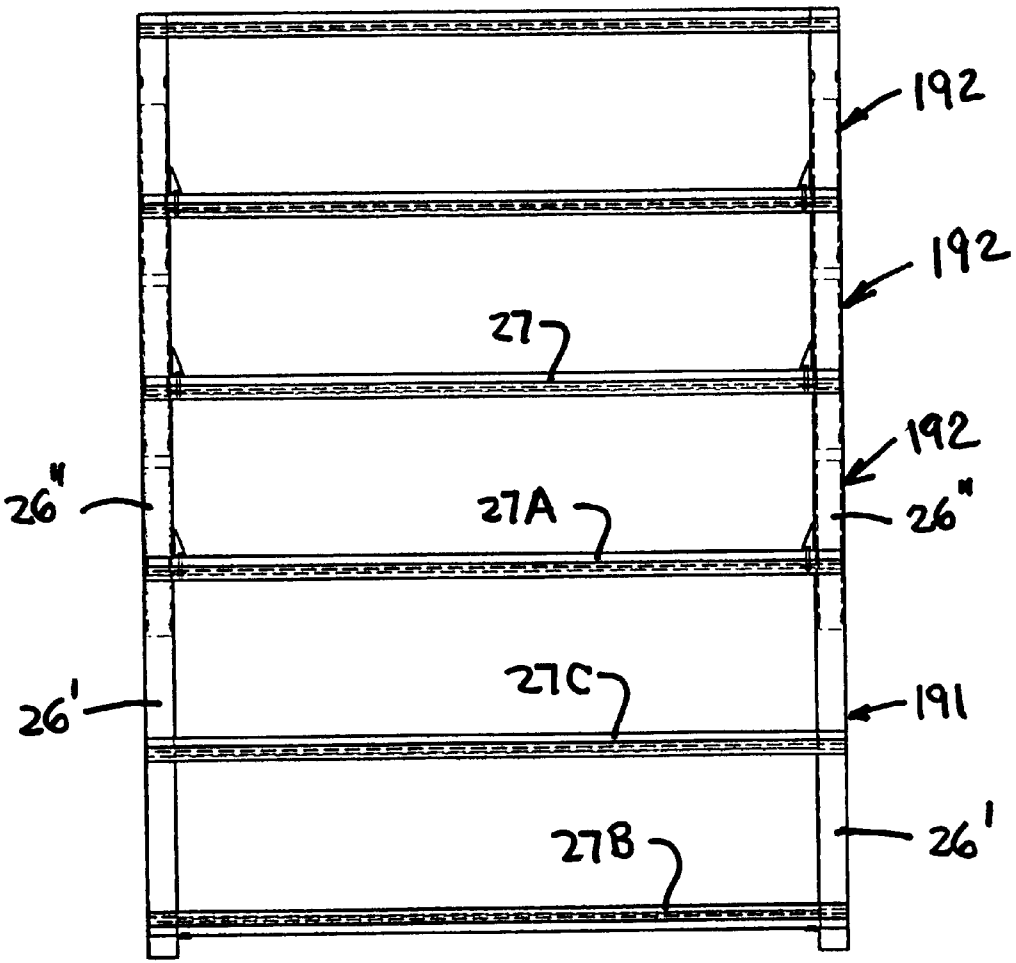
FIG. 36 is a side elevational view similar to FIG. 9 but illustrating a modified frame construction for a main panel, which frame construction is comprised of a plurality of vertically stacked components to permit creation of different panel heights.

The base frame subassembly 191, however, also permits one or more stackable frame subassemblies 192 to be vertically stacked thereon, three such subassemblies 192 being illustrated in FIG. 36.

The stackable frame subassembly 192 is of a generally U-shaped configuration and includes parallel upright segments 26" which at their upper ends are rigidly joined together by a cross beam 27. The upright segments 26' and 26" are identical in construction to the uprights 26 described above, except that upright segments 26" have a length which corresponds to a single module height, that is, a vertical centerline-to-centerline spacing between vertically adjacent cross beams.

Each of the upright segments 26", however, has a connecting part 193 which is fixed to and projects downwardly from the lower end of the upright segment 26" so as to snugly fit within the next lowermost upright segment, such as either the upright segment 26' of the base frame or the segment 26" of a further stackable subassembly. The connecting part 193 is formed generally as a channel or hollow tube which is exteriorly configured so that an upper portion thereof projects upwardly into the lower end of upright segment 26" and is fixed thereto. The lower portion of the connecting part 193, however, projects downwardly from the free end of segment 26" through a distance sufficient to permit it to snugly telescope into the upper end of a vertically adjacent upright segment 26' or 26", as illustrated in the drawings. The protruding connecting part 193 is inserted into the upper end of the adjacent upright segment such that the lower free end 194 of the upright segment 26" on the upper stackable frame abuts against the upper end of the next adjacent upright segment 26' or 26".

Once the stackable frame subassembly 192 is fully seated on the next lower frame subassembly 191 or 192, then the vertically adjacent frame assemblies are fixedly secured by means of brackets 195 which are secured to the inner edge surfaces of the upright segments 26" directly adjacent the lower end thereof, which brackets in turn have a transversely projecting surface which overlies the top wall of the next cross beam, whereupon a fastener such as a bolt 196 is then inserted through the bracket and through openings in the cross beam so as to fixedly secure and positively seat the upper stackable frame subassembly 192 on the next lower frame subassembly 191 or 192.

The panel defined by the stackable frame 25', other than its selectable height, otherwise structurally and functionally corresponds to frame 25 so that further detailed description is believed unnecessary. Further, spine panels defined by frames 25 and 25' can be joined together so as to define adjacent panels of differing heights.

The following description now relates to the branch or divider wall and, more specifically, the construction of the divider or branch panels which make up the divider wall.

Figure 41:
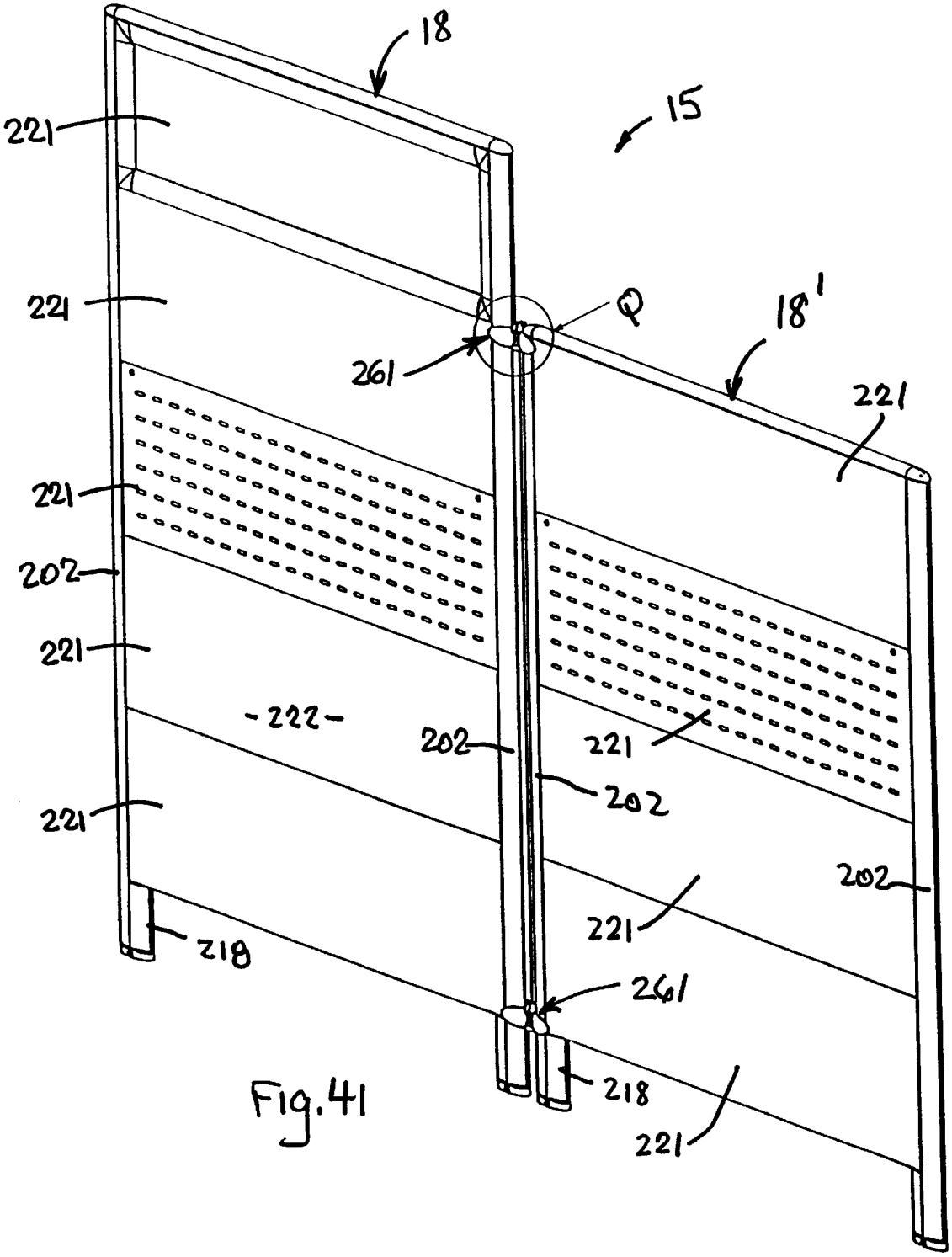
FIG. 41 is a perspective view which illustrates two branch or divider panels serially joined together, which panels are of different heights and each have a plurality of removable tiles associated with the exposed sides thereof, and which can be transversely joined to the spine wall as illustrated in FIG. 1.

As illustrated by FIG. 41, there is illustrated a divider wall 15' which generally corresponds to the divider wall 15 illustrated in FIG. 1 except that the divider wall 15' is made up of two divider panels 18 and 18' which respectively are of five and four module heights so as to illustrate that the present invention can be constructed so as to provide panels of differing height.

Figure 43:
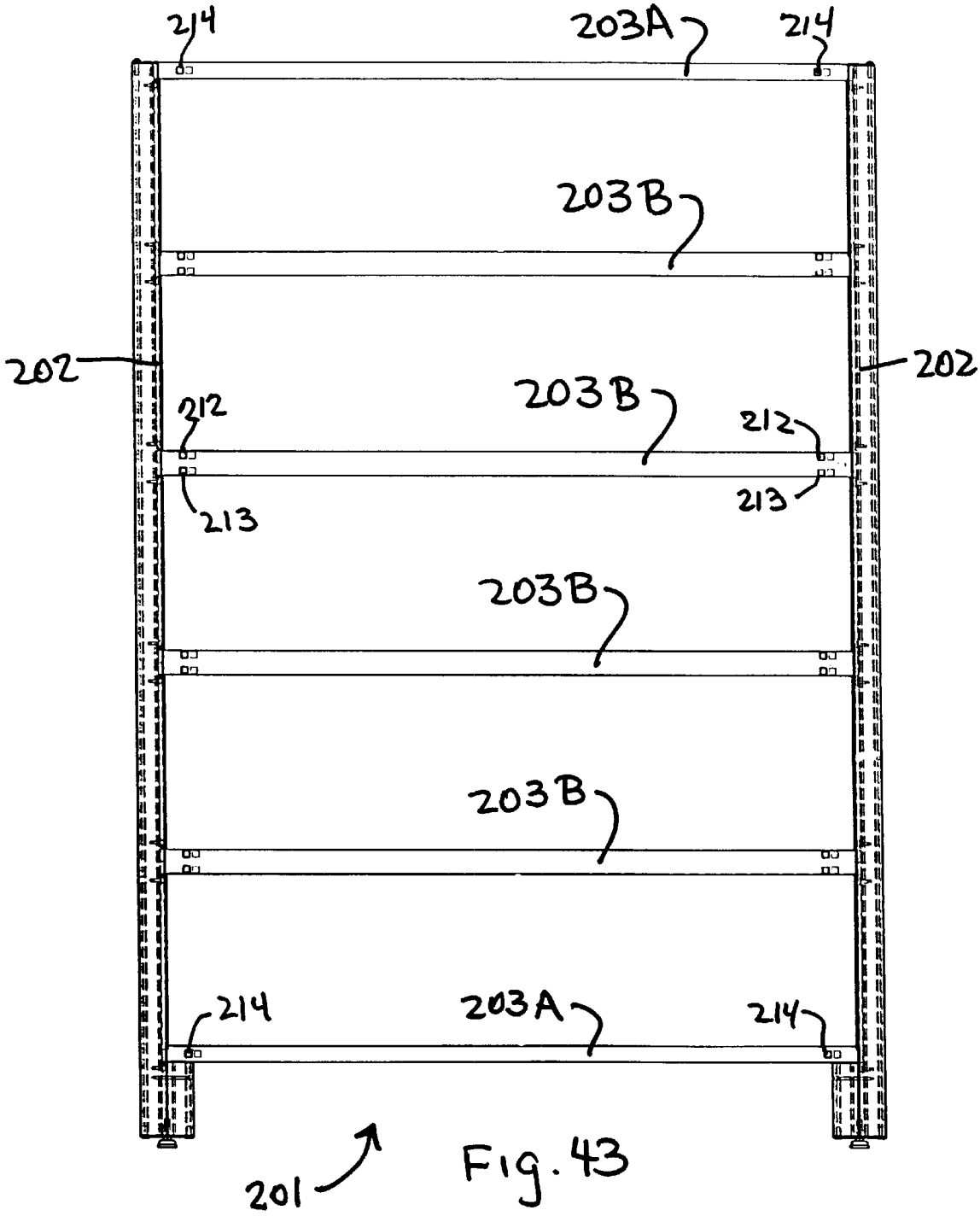
FIG. 43 is a side elevational view of the frame (with the tiles removed) associated with the branch panel of FIG. 42.
Figure 44:
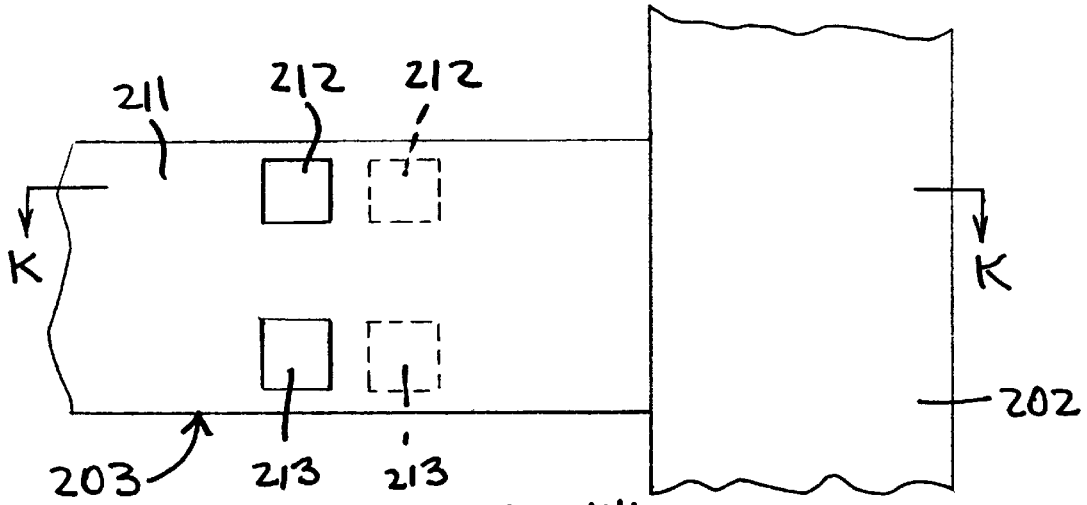
FIG. 44 is an enlarged, fragmentary view showing a portion of the frame of FIG. 43, and specifically showing the attachment of one of the cross supports to one of the uprights.

The divider panel 18, as illustrated by FIG. 43, includes an interior frame 201 having a pair of elongate and generally parallel posts or uprights 202 which extend vertically along opposite edges of the frame and which are rigidly joined together by a plurality of cross supports 203. The cross supports extend generally horizontally and are individually disposed in spaced vertical relationship so that the top support 203B extends between and rigidly joins the upper ends of the posts 202, a bottom support 203B extends between and has opposite ends rigidly joined to the posts 202 adjacent but spaced upwardly a small distance from the lower ends thereof, and one or more intermediate supports 203B are disposed substantially in uniformly spaced relationship between the upper and lower supports. In the illustrated embodiment the frame 201 defines five substantially uniform spaces disposed in vertically adjacent relationship, and hence is referred to as a five module or five high frame since it accommodates up to five removable covering tiles on each side thereof, as discussed hereinafter.

The post 202, as illustrated in FIG. 50, has an outer peripheral wall 210 which in cross section generally resembles one-half of an oval or elliptical shape. The peripheral wall terminates at inner, vertically extending edges 204. The wall defines therein an inwardly opening cavity which projects inwardly from the edges 204 and is limited by a transversely extending reinforcing wall 205. This wall has a pair of flanges or ribs 207 extending vertically therealong in sidewardly spaced relation so as to define a channel 206 therebetween which opens toward the cross supports 203 and has a width similar thereto.

To secure an end of the cross support 203 to the post 202, the cross support 203, which in the illustrated embodiment is formed as a hollow tube and more specifically a tube having a generally vertically elongate rectangular cross-section, has a channel-like positioning plate 208 fixed to the free end thereof. This plate bearingly nests on the parallel guide walls 207. The positioning plate 208 also has a flange 209 which projects from a horizontal edge thereof and is deformed inwardly so as to project into the channel 206 and overlie the rear surface thereof. This flange 209 is fixedly secured to the channel by any suitable means, such as by a screw or welding, such securement being indicated at 209A. The top support 203A and bottom support 203A have only a single securing flange 209 thereon, whereas each intermediate support 203B has flanges 209 projecting both upwardly and downwardly so as to create two points of securement to the post 202.

The intermediate cross support 203B has, in each of the opposite side walls 211 thereof, a pair of upper openings 212 which are disposed in close proximity to the top wall of the support and are disposed adjacent opposite ends thereof. A further pair of lower openings 213 are also formed in each side wall, and these lower openings are also disposed adjacent opposite ends of the support generally beneath the respective upper openings 212. The upper and lower supports 203A are of smaller vertical extent than the intermediate supports 203B, and each support 203A has only a single pair of openings 214 formed through the side wall thereof in the vicinity of the opposite ends of the support. The openings 214 in the upper support 203A generally correspond to the openings 213 formed in the intermediate supports 203B, and the openings 214 in the lower support 203A generally correspond to the upper openings 212 formed in the supports 203B. These openings 212, 213 and 214 accommodate therein spring clips associated with removable covering tiles, as explained hereinafter.

Figure 45:
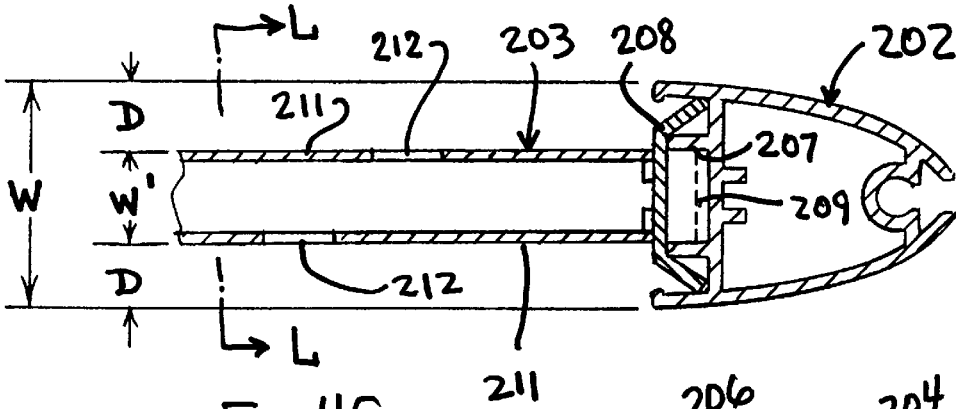
FIG. 45 is a sectional view taken generally along the line K—K in FIG. 44.
Figure 46:
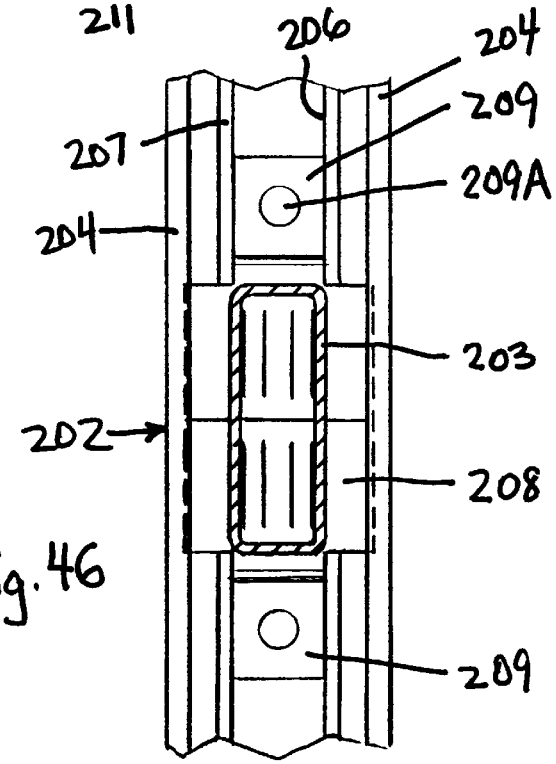
FIG. 46 is a sectional view taken generally along the line L—L in FIG. 45.
Figure 47:
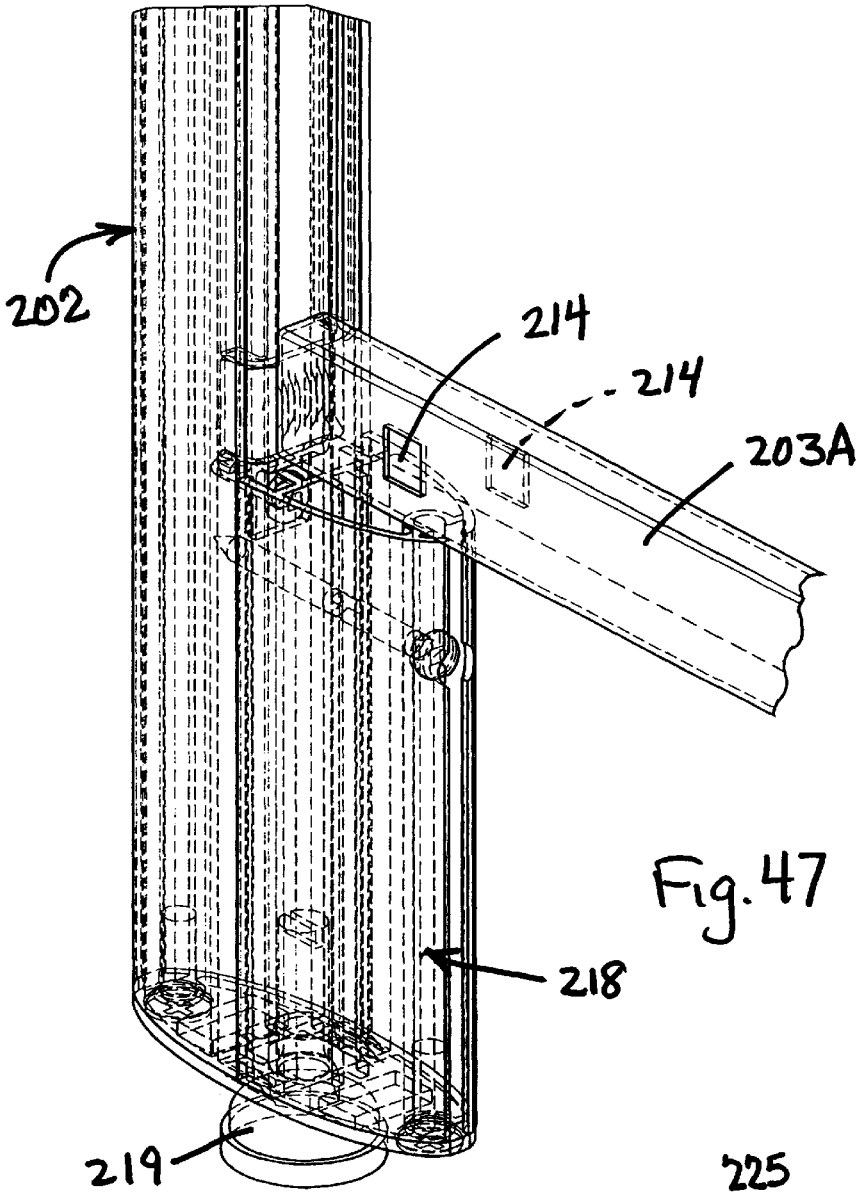
FIG. 47 is a fragmentary perspective view which shows a lower corner of the divider panel frame and specifically the leg structure associated therewith.

As illustrated by FIG. 45, the horizontal cross supports 203A and 203B, while having different vertical heights, nevertheless have the same width W', which width is significantly less than the width W defined by the edge post 202. This results in the frame 201 defining on opposite sides thereof enlarged shallow recesses which extend horizontally and vertically over substantially the full face of the frame so as to accommodate therein removable covering tiles. These shallow recesses as defined on opposite sides of the cross supports thus have a depth as indicated by the dimension D so as to accommodate therein removable tiles without the latter protruding outwardly beyond the panel thickness W defined by the edge posts 202. The width W' of the cross supports 203 is preferably no more than one-half the width W of the edge posts 202 so as to provide a narrow and relatively lightweight finished panel product.

The posts 202 can also be provided with vertically elongate flexible plastic light blocker strips (not shown) which are disposed within the channel 206. These light blocker strips project outwardly a limited extent beyond the inner edge of the post 202, and are provided with appropriate cut-outs so as to provide clearance for the positioning channels 208.

The lower ends of the posts 202, namely those portions which extend downwardly beyond the bottom cross support 203A, have a post segment 218 fixed to the inner surface of the post 202. The segment 218 cooperates with the post to define a leg structure which projects downwardly from the lower support 203A. This leg structure, as defined by the post 202 and post segment 218, defines a generally elongate oval or elliptical shaped structure. The post segment 218 also defines a threaded opening therein which accommodates the threaded stem of a conventional foot or glide 219, which glide projects below the foot for engagement with a floor in a conventional manner. The glide can be provided with carpet grippers thereon if desired.

The branch panel 18 is also constructed so as to permit one or more removable covering tiles 221 to be attached to each side thereof. The tiles may assume a wide variety of types.

More specifically, the tile 221 may be constructed from an enlarged metal sheet and includes a generally rectangular sheet or wall 222 which effectively defines the vertically enlarged side surface for the wall panel, and this sheet 222 has edge flanges 223 and 224 formed respectively along the horizontal and vertical edges thereof to provide increased strength and to improve appearance. In this variation the tile has a pair of channel members 225 fixedly secured, as by welding, to the inner surface of the sheet 222 and disposed adjacent opposite longitudinally extending edges so as to also effectively define a stiffening frame structure for the tile. Each of the channel members 225 has a pair of hooks or resilient spring clips 228 secured thereto adjacent the upper and lower ends thereof, which clips are insertable into selected ones of the openings 212, 213 or 214 associated with the cross supports 203.

The tile 221, when mounted on the side of the frame, is effectively positioned within the shallow recess defined by the side of the frame, namely as represented by the depth D in FIG. 45, so that the rear surface 227 of the tile, as defined on the rear of the channel members 225, effectively abuts the front face of the supports 203. The transverse spacing between the rear tile surface 227 and the tile front face 226 is similar to and approximately corresponds to the recess depth D. Thus, when one or more tiles are mounted on each of the frame 201, the outer or front faces 226 of the tiles are substantially vertically coplanar with the vertically extending side edges of the end posts 201 as defined by the legs 204, to thus provide for a thin, compact and aesthetically pleasing construction.

Figure 42:
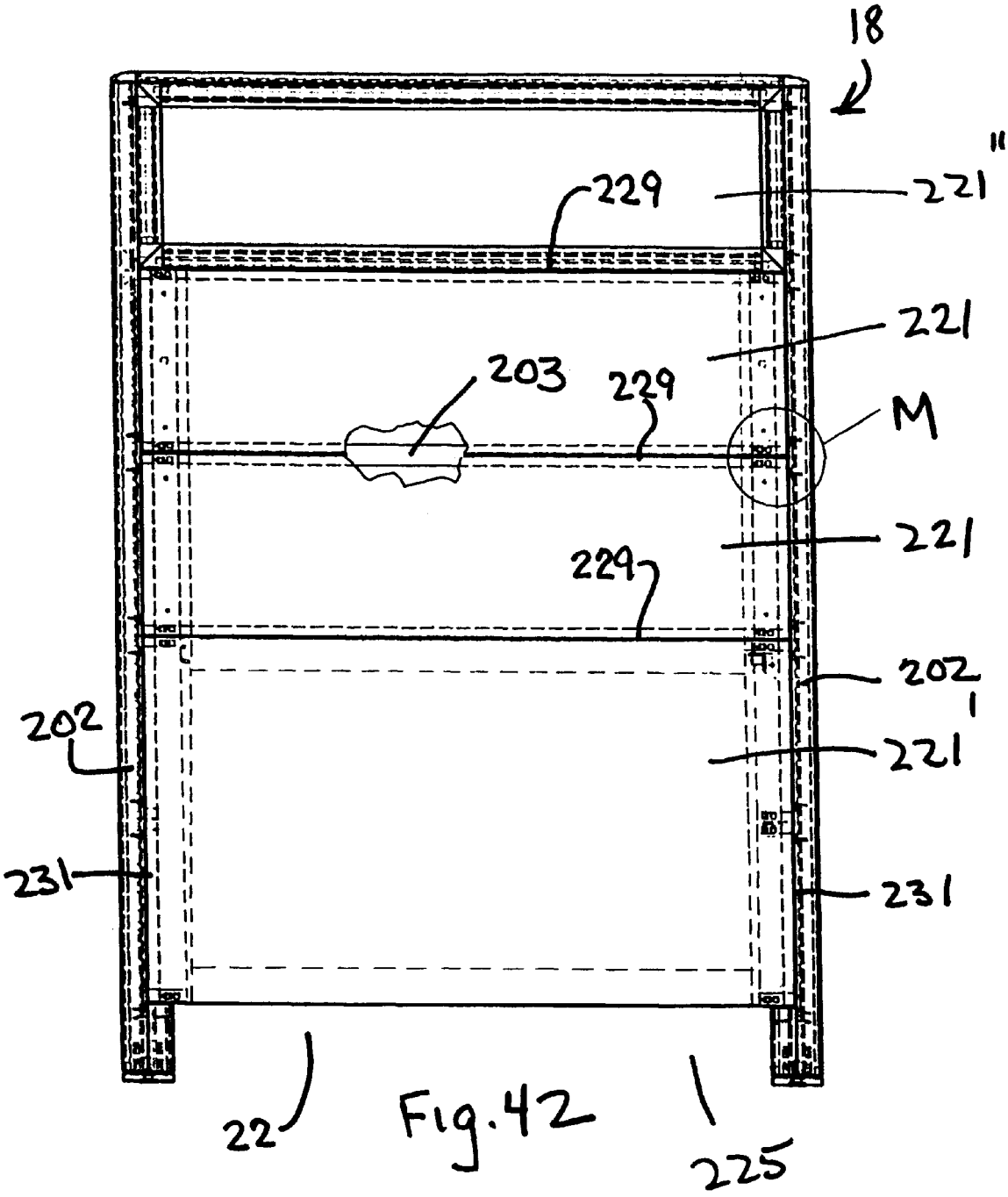
FIG. 42 is a side elevational view of a branch panel having five removable tiles associated with the exposed side thereof.

The tiles 221 have a height which, in the arrangement illustrated by FIGS. 41–43, substantially equals the module height of the frame 201, so that each tile hence spans and connects to a vertically adjacent pair of cross supports 203. The tiles can, however, be of a height which is two or more times the module height so that a single tile may extend vertically across one or more intermediate cross supports 203, with the limit obviously being a single tile which spans vertically between the top and bottom cross supports 203A and covers the entire side of the frame 201.

When multiple tiles are secured to one or both sides of the frame 201, however, the vertically adjacent tiles secure to the frame such that the lower spring clips 228 on the upper tile engage the upper openings 212 of an intermediate cross support 203, and the upper spring clips 228 of the next adjacent lower tile engage the lower openings 213 of the same cross support 203. When so mounted, the lower horizontal edge of the uppermost tile and the opposed upper edge of the next adjacent lower tile are vertically spaced so as to define a vertically narrow but elongate passage or groove 229 extending therebetween horizontally across the width of the panel. Where multiple removable tiles 221 are mounted on the frame, then a similar such groove 229 exists between each vertically adjacent pair of tiles, and these grooves will substantially horizontally align with and correspond to the access grooves 91 defined in the spine panels as discussed above, whereby the spine and branch panels provide an aesthetically similar appearance.

The tiles 221 when mounted on the frame 201 also have a width which generally corresponds to and spans between the opposed edge posts 202, with the length of the tiles 221 being such that the vertical edges thereof are positioned so as to be slightly horizontally spaced from the opposed inner edges 204 of the post 202 to define an elongate vertical passage or groove 231 extending therebetween. The bottom of groove 231 is closed off by the flexible light blocker strip described above.

The upper edge of the branch panel 18 has a suitable top cap structure removably attached thereto. For this purpose, and referring to FIGS. 51 and 52, the frame 201 is provided with a horizontally elongate top piece 232 which attaches to and extends lengthwise along the top cross support 203A. The top piece 232, which may be an elongate extruded plastic element, includes a main plate-like part or wall 237 which, on the underside thereof, has a downwardly opening center channel 233 defined between a pair of ribs 234 which extend longitudinally along the length of the top strip, the channel being sized to enable the top piece to be securely seated on the upper surface of the top cross support 203A. The top piece 232 can be secured to the top support 203A in a conventional manner, such as by screws or the like, not shown.

The opposite longitudinally extending edges of the top piece 232 include vertically extending edge walls 238 which extend longitudinally of the top piece and provide a generally shallow H-shaped cross-section. These edge walls 238 define thereon outer substantially vertical surfaces 238 along each of which extends a detent rib 235. These surfaces also terminate at a shoulder 236 which is defined by the upper surface of an outwardly protruding wall-like rib 240. The edge walls 238 each define a lower leg portion which protrudes downwardly from the central plate 237 so as to terminate in a free edge which is positionable closely adjacent the upper edge of the uppermost tile 221 so as to effect a visual closure therewith.

The top piece 232 removably mounts thereon a longitudinally extending top cap 248 which has a rounded upper surface 241 shaped, in the illustrated embodiment, with a semi-elliptical configuration and which merges into generally parallel downwardly projecting side legs 242. Each of these legs, in the inner surface thereof, has a longitudinally extending recess 243 which creates a snap fit with the respective rib 235 to create a detent for removably securing the top cap 248 to the top piece 232. When so positioned, the lower free edges of the top cap substantially abut the shoulder 236, and the outer surface of the top cap legs 242 are substantially vertically flush with an outer surface 244 defined by the longitudinally extending rib-like walls 240. In addition, the downwardly projecting lower end portion 246 of the side edge wall 238 cooperates with the outwardly projecting rib-like wall 240 and the outer surface of the adjacent tile 221 so as to define a horizontally elongate groove or passage 247 which extends width-wise of the branch panel and which aesthetically is similar in appearance to the horizontal grooves or passages 229 defined between adjacent tiles.

Figure 51:
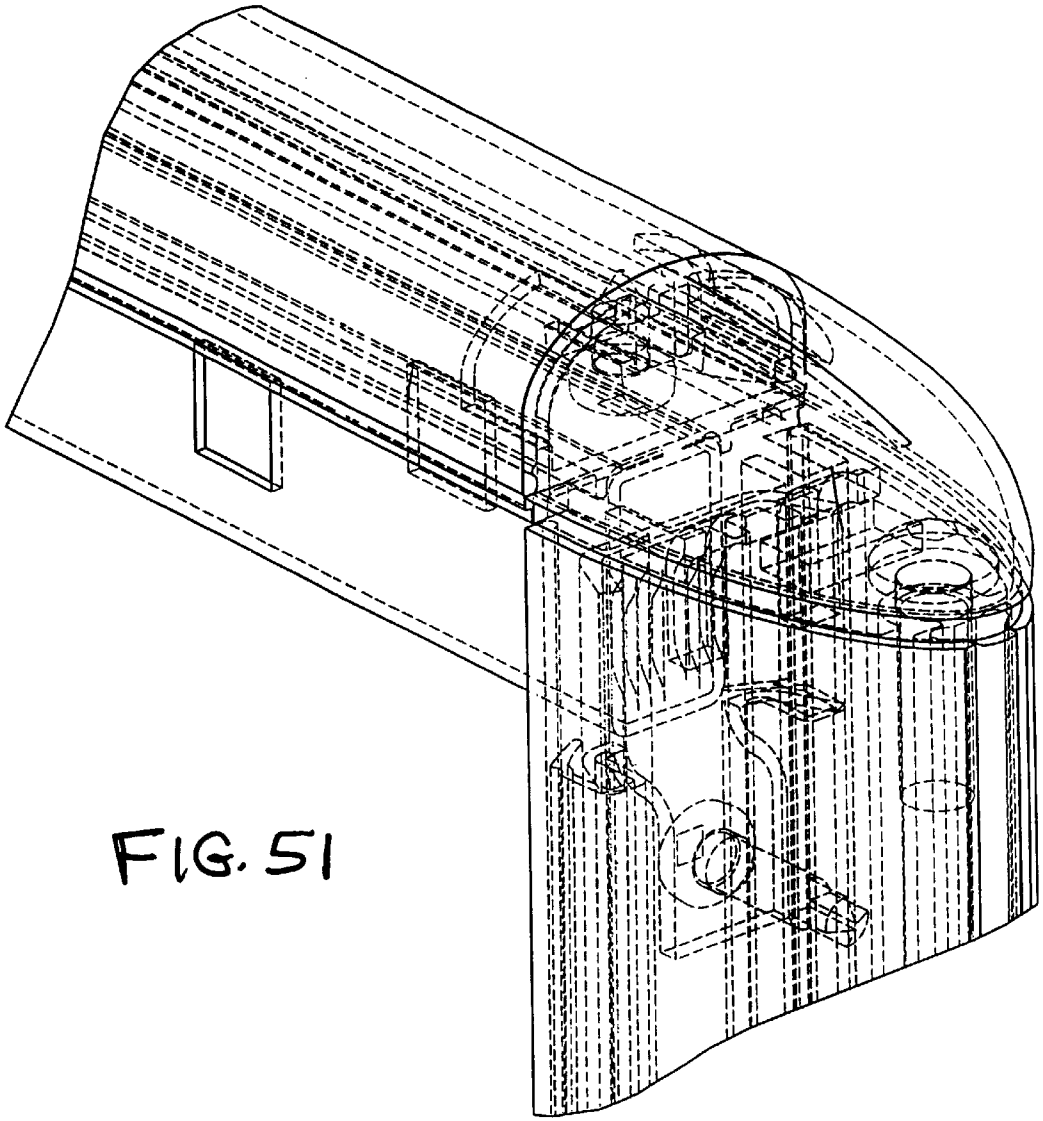
FIG. 51 is a fragmentary perspective view which illustrates an upper corner of the branch panel frame with the tiles removed, but illustrating the top and corner caps mounted on the frame.
Figure 51A:
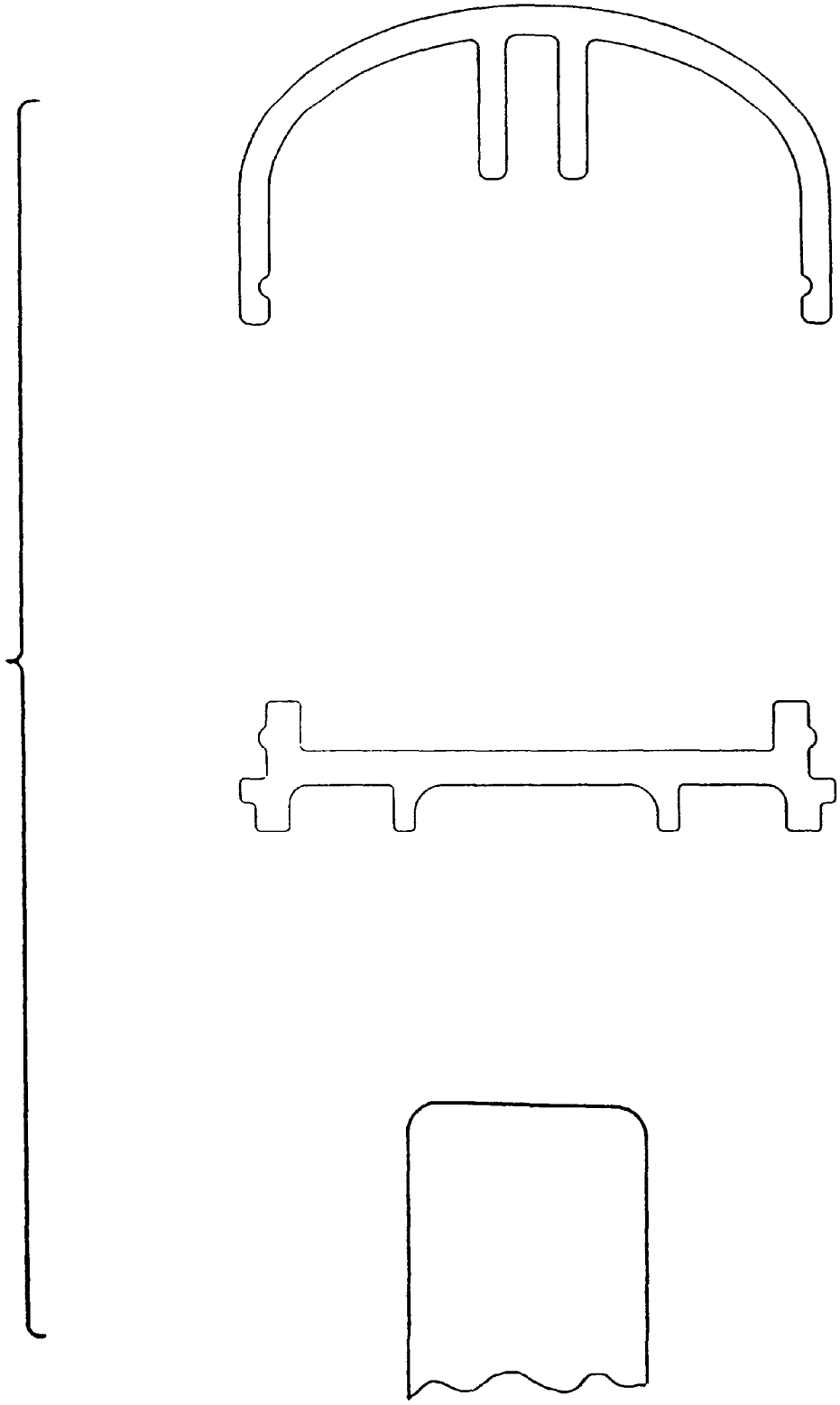
FIG. 51A is a fragmentary, exploded sectional view illustrating the arrangement for mounting the top cap as associated with opposite sides of the panel frame.
Figure 52:
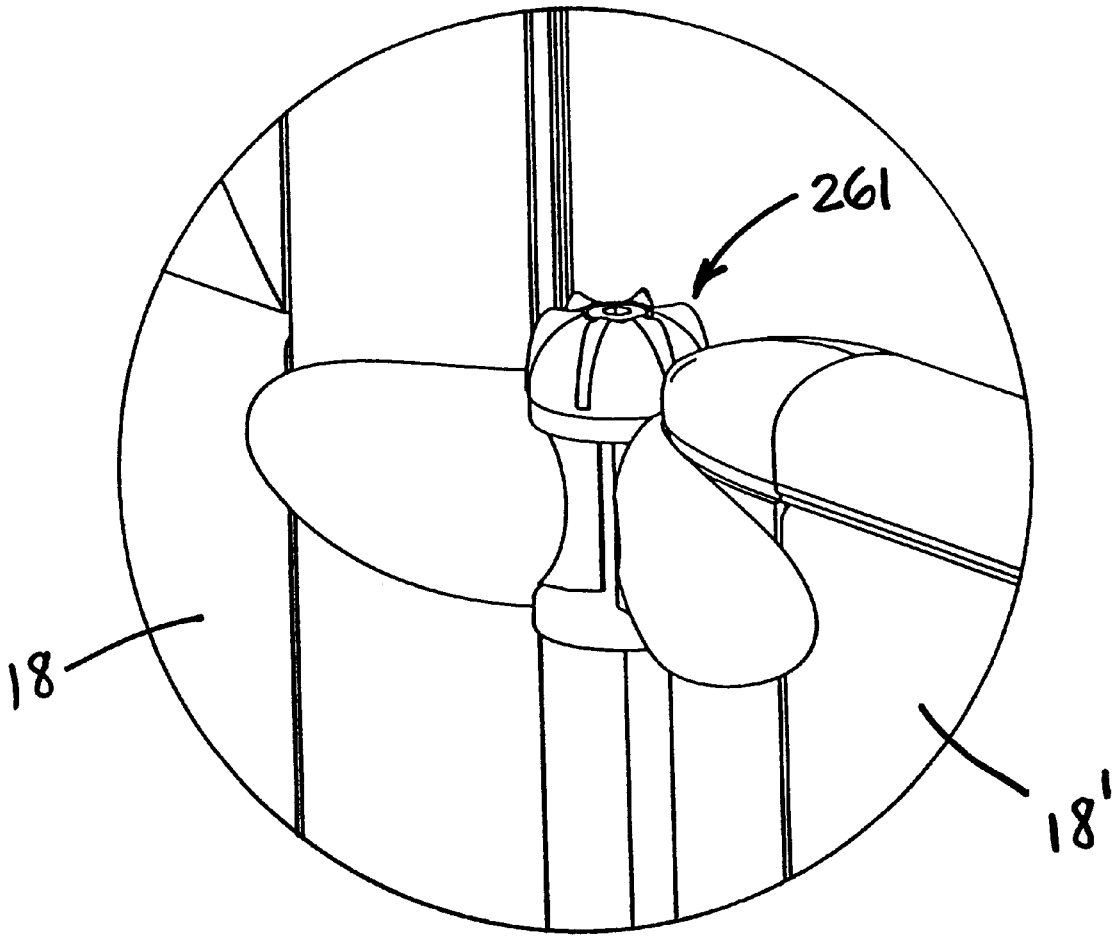
FIG. 52 is an enlargement of the circled area designated Q in FIG. 41 for illustrating the panel-to-panel connector for adjacent branch panels.
Figure 53:
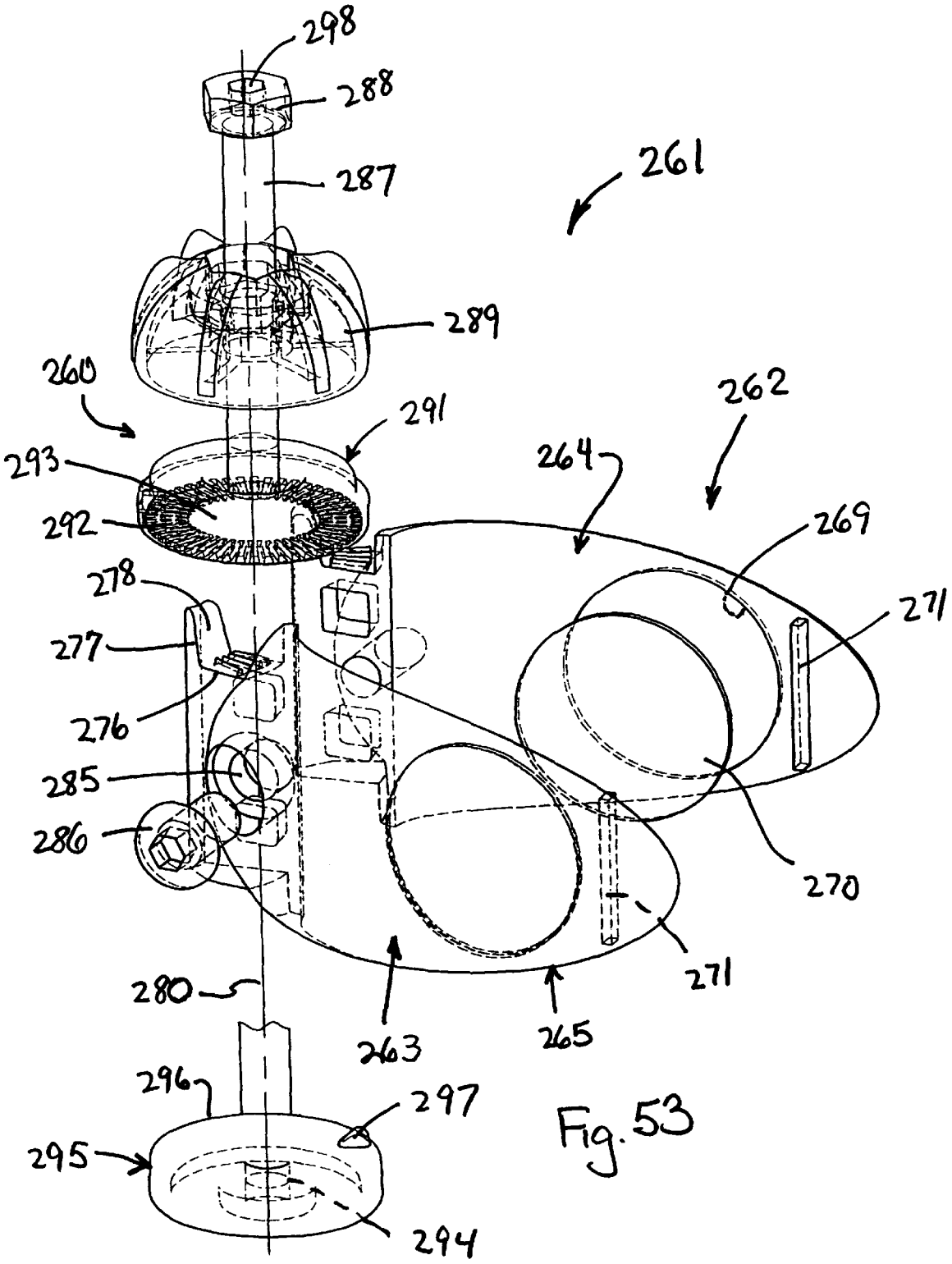
FIG. 53 is an exploded perspective view of portions of the connector illustrated in FIG. 52.
Figure 54:
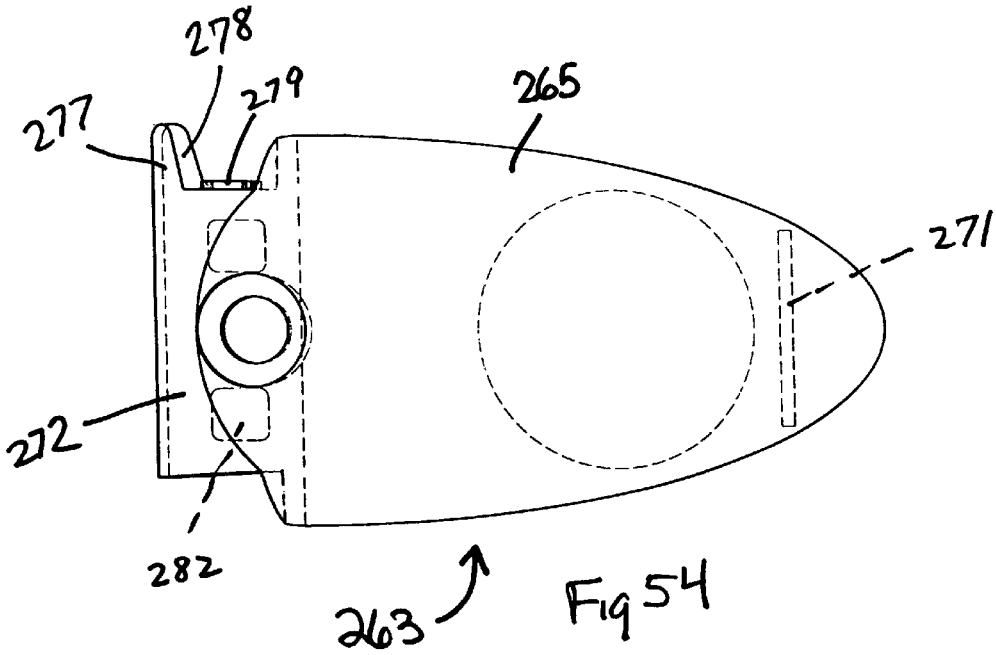
FIGS. 54 and 55 are respective side and top views of one of the jaw members of the connector.
Figure 55:
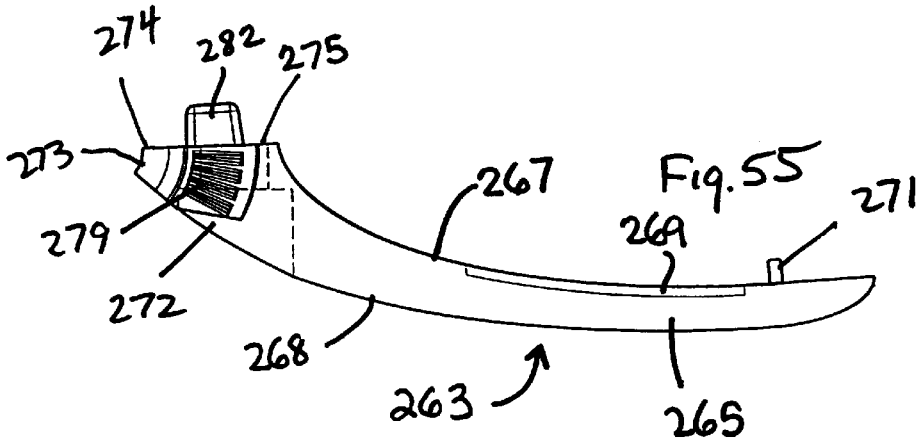
Figure 56:
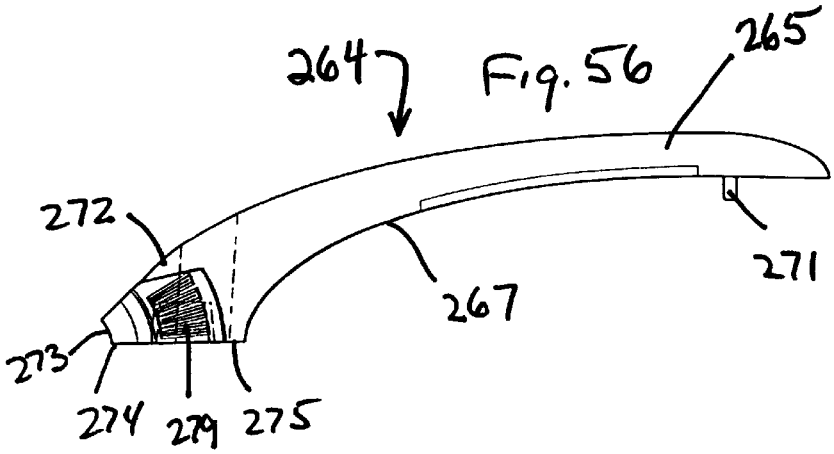
FIGS. 56 and 57 are respective top and side elevational views of the other jaw member of the connector.
Figure 57:
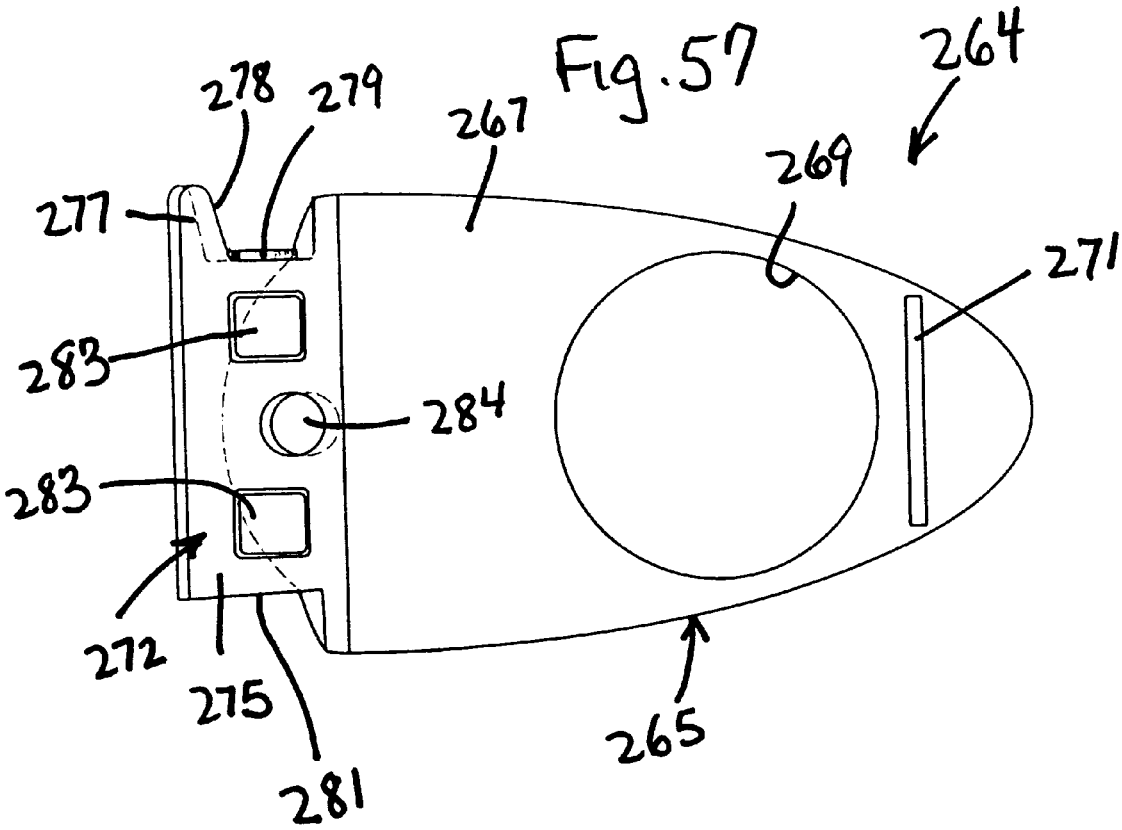

As illustrated by FIG. 51, each upper corner of the divider panel 18 has a corner cap 251 removably fixed to the upper end of the upright post 202, which corner cap in turn is aligned with and connects to the adjacent free end of the top cap 248. The corner cap 251 has a configuration when viewed from above which corresponds to the configuration of the end post 202, and when viewed in a vertical transverse direction has a rounded configuration compatible with the top cap and when viewed in a vertical longitudinal plane has a rounded configuration which resembles part of an oval or ellipse, substantially as illustrated by FIG. 51. The corner cap has suitable fingers which project axially into the end of the top cap to create an engagement therewith, and similarly has structure for creating a snap-type resilient engagement with a top plate which secures to the upper end of the post. This top plate has its outer peripheral surface spaced inwardly from the lower edge of the corner cap so as to define, in cooperation between the corner cap and post, a surrounding shallow groove 252 which effectively constitutes an extension of the groove 247.

There is diagrammatically illustrated in FIG. 42 a five-high module divider panel 18 having four substantially uniform height tiles mounted in vertically spaced relation thereon. The two tiles designated 221 may be of metal construction, which metal can be painted or powder coated, or which can be fabric or vinyl covered if desired. The lowermost tile 221' is a double module height, open frame-type tile in that the tile has a generally rectangular frame so that the interior of the tile is open, and this interior can be provided with sound absorbing material such as fiberglass or the like to define an acoustical tile, with the outer surface being appropriately fabric covered. Alternately, a frame-type tile can be used to construct a tile having a pass-through opening, or can be utilized to construct a tile having a glazing therein, such being illustrated by the upper tile 221". The tiles can also be provided with outer surfaces which function as marker boards (i.e., such as a conventional white board) or as tack boards, and the metal surface of the tile can also be provided with slots to permit hanging of small tools or articles thereon, or with multiple small perforations to facilitate air flow therethrough.

The overall assembled divider panel 18, as illustrated in FIGS. 41 and 42, results in a substantial vertical clearance space defined between the floor and the lowermost tile or cross support 203A, such clearance space as indicated at 255 being of substantial height so as to provide greatly increased air circulation within the surrounding work spaces. This clearance space and the height thereof is generally compatible with the clearance space defined under the spine panels as described above.

It should be pointed out that the improved construction of the branch panel 18 and specifically the open frame construction, and the ability of the frame 201 to accommodate removable tiles in the shallow recesses defined on opposite sides of the frame, results in a compact and lightweight panel, which also has a small thickness. For example, in the preferred and illustrated embodiment, the thickness of the panel 18 as represented by the width W, (i.e., the transverse width across the post 202) is about one and one-quarter inch, and the cross supports 203 which connect horizontally between the posts 202 have a width of about one-half inch. It will be recognized, however, that these dimensions represent only one embodiment of a preferred configuration and that such dimensions can be varied without departing from the construction of the invention. Further, the frame 201 can be of varying heights defined by a different number of modules, and such is illustrated for example by FIG. 41 which illustrates a four-high module panel positioned adjacent and interconnected to a five-high module panel.

As is believed apparent from the description of the divider panel 18, and the drawings thereof, this panel in the preferred embodiment is intended to function primarily as a space divider, often referred to as a divider screen, and hence is not a load-bearing panel in that external loading components such as shelves, wall cabinets, worksurfaces and the like are not intended to be mounted thereon, and in fact the frame has no provision for permitting load-bearing components to be mounted thereon. These divider panels thus can be used in conjunction with a spine wall as described above, or can be used entirely independent of the spine wall and used in conjunction with freestanding furniture such as tables, desks and files so as to cooperate therewith to define a work space.

To connect two or more divider panels 18 in a series or edge-to-edge relationship, substantially as illustrated by FIG. 41, there is provided an improved panel-to-panel connector 261 which cooperates between the adjacent vertical edges of two panels to provide a structural connection therebetween. Two such connectors 261 are typically used for joining two panels 18, one such connector 261 being disposed for cooperation between the opposed posts 202 adjacent the lower ends thereof, and the other preferably being positioned adjacent the upper ends of the posts, or at least adjacent the upper end of the post of the lowermost panel, such as depicted in FIG. 41. The connectors 261 are particularly desirable since they can be positioned vertically anywhere along the edges of the posts 202, and hence are particularly desirable for connecting adjacent panels 18 of differing heights. The connectors also permit a wide range of different positional orientations (i.e. angular relationships) between two or more panels which are being connected at a common junction.

Considering now the construction of the connector 261, and referring specifically to FIGS. 53–59, the connector 261 includes at least two connector jaw arrangements 262 each cooperating with a respective divider panel, and each jaw arrangement 262 includes a pair of relatively movable jaw members 263 and 264 which cooperate with the panel post 202 for effecting clamping engagement therebetween. The jaw arrangements are joined by a connector arrangement 260.

Figure 48:
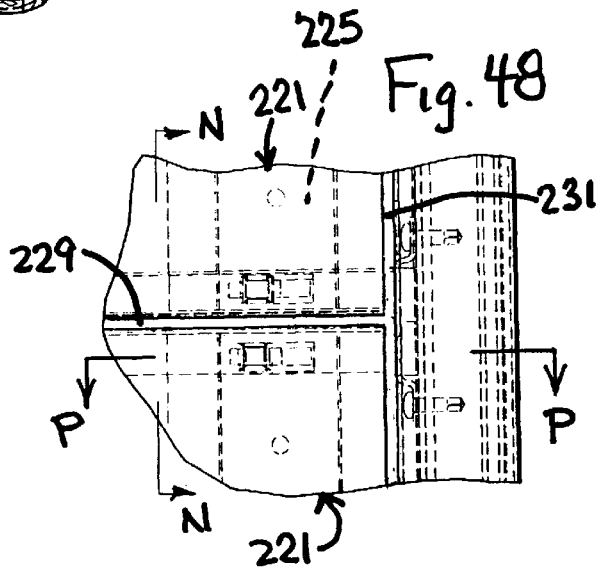
FIG. 48 is an enlargement of the region depicted within the circle designated M in FIG. 42.

Each jaw member 263, 264 includes an enlarged jaw part 265 having an inner concave surface 267 which, in horizontal profile, has a curvature which generally corresponds with the outer curved surface 268 of the post 202 so as to permit relatively snug embracement with one side of the post. The jaw part 265 also has an outer convex surface which is also smoothly curved and which approximately follows the curvature of the inner surface. The inner concave surface 267 has a shallow recess 269 formed therein for accommodating a thin cushioning pad 270 of any suitable material, such as an elastomeric material, to complement secure gripping of the jaw part against the post 202. Each jaw part 265 also has a vertically elongate locating rib 271 which extends vertically across and is cantilevered outwardly from the concave inner surface 267 in the vicinity of the free end of the jaw part. The rib 271 functions to project into the vertical passage or slot 231 (FIG. 48) defined in the divider panel adjacent the post.

Each jaw member 263, 264 also includes a mounting part 272 connected to the jaw part 265 adjacent the inner end thereof. The mounting part 272 defines thereon a vertically-extending inner edge surface 273 which is of a concave arcuate configuration in horizontal cross-section. This arcuate end surface 273 terminates at a vertical edge or corner 274 which defines one end of a flat inner side surface 275 which projects generally transversely from the inner end surface 273 until it intersects the inner concave surface 267.

The mounting part 272 also has a generally flat top wall 276 which merges into a projection 277 which projects upwardly and extends for merger with the arcuate inner surface 273. This projection 277 defines thereon a surface 278 which is sloped outwardly as it projects downwardly for merger with the top wall 276, with this sloped surface 278 also being of a partial circular convex configuration when viewed in horizontal cross-section. The top wall 276 additionally defines thereon an upwardly facing toothed or serrated sector 279 which is also of an arcuate configuration when viewed from above. The arcuate configuration of the toothed sector 279, the sloped surface 278 and the arcuate end surface 273 are all generated about a vertical axis which approximately corresponds to the vertical axis 280 defined by the connecting structure 261. The mounting part also has a bottom wall 281 which has a small slope relative to the horizontal.

To couple the jaw members 263 and 264 together in opposed relationship to one another, the one jaw member 263 has a pair of projections 282 which are cantilevered outwardly from the respective flat surface 275, and these projections slidably project into opposed and similarly shaped openings or recesses 283 which open inwardly from the opposed flat surface on the other jaw member 264. This latter jaw member 264 also has a threaded opening 284 which projects generally transversely inwardly from the respective flat surface 275, which opening preferably extends at an angle which deviates at least a few degrees from a perpendicular relationship relative to the respective flat surface 275. The threaded opening 284 is engaged by the threaded end of a threaded fastener 286 which extends through and is supported in a stepped bore 285 formed through the mounting part of the other jaw member 263. The stepped bore 285 is configured so as to confine the enlarged head of the fastener 286 and provide a reaction surface for the head when the threaded fastener is tightened. The stepped bore 285 also provides at least minimal and adequate clearance with respect to the fastener 286 so as to permit limited relative pivoting between the opposed jaw members 263, 264 during opening and closing thereof, as described hereinafter.

Considering now the connecting structure 260, same includes a generally vertically elongate connecting pin 287 which defines the axis 280. The connecting pin at its upper end has an enlarged flat-sided head 288 which is seated in a recess defined in a manually-engageable locking knob 289 so that the knob 289 and pin 287 are nonrotatably connected. A bottom surface of the knob 289 in turn rotatably bears against a top annular plate or washer 291 which, on its bottom surface is provided with a toothed or serrated annular surface 292 which is configured for mating engagement with the serrated sectors 279 defined on the jaw members 263 and 264. This top washer 291 also has an opening 293 extending coaxially therethrough, the inner surface of which is of a generally truncated conical configuration which slopes radially outwardly as it projects downwardly and is angled so as to be compatible with the sloped surfaces 278 defined on the jaw member projections 277.

The connecting pin or shaft 282 projects downwardly through the top washer 291 and, at its lower end, is threadably engaged within a central threaded opening 294 formed in a bottom washer 295. The bottom washer 295 has an upper surface 296 which is formed as a shallow conical surface which slopes downwardly as it projects radially inwardly toward the threaded opening, the slope of this surface relative to the horizontal typically being only a few degrees. The bottom washer 295 also has a wedge-like stop 297 projecting upwardly from the washer upper surface in the vicinity of the surrounding peripheral wall thereof.

To assemble the jaw arrangement 62 with the connecting structure 260, the connector structure is assembled so that the washers 291, 295 and knob 289 are all mounted on the shaft 287. With the upper washer 291 in a partially raised position, the jaw members 263, 264 are positioned so that the projections 287 are inserted upwardly into the conical opening 293 of the upper washer, and the sloped bottom surfaces 281 on the jaw members are engaged with the sloped or upper conical surface 296 of the bottom washer 295. The shaft 287 can be rotated, either by the hand knob 289 or by means of a tool engaged within the opening 298, to partially tighten the connecting structure. In this regard, the stop 297 on the lower washer projects between the mounting parts of the two jaw members, thereby preventing rotation of the bottom washer and hence effecting movement of the upper and lower washers toward one another in response to rotation of shaft 287. With the washers partially tightened toward one another, but before the serrated annular surface 292 on the top washer engages the opposed serrated surfaces 279 on the jaw members, the jaw members are positioned so that the flat surfaces 275 thereon are disposed closely adjacent with their inner corners 274 substantially abutting to define a pivot or contact point, and with the flat surfaces 275 being slightly angled relative to one another as they project outwardly from the rear corners. In this condition the jaw members are sufficiently spaced apart as to enable them to be inserted over the post 202 of a panel. When properly positioned over a panel post 202, the threaded fastener 286 is tightened which causes the opposed jaw members 263, 264 to swing inwardly toward one another, reacting basically about a pivot created by the contacting inner corners 274. The inner concave surfaces of the jaw members thus basically move into gripping engagement with the opposed outer side surfaces of the post 202, and the locating ribs 271 effectively project into the vertically elongate passages 231 which are defined in the branch panel directly adjacent the inner free edge of the post 202 so as to provide a positive interlock with the panel post. When the jaw members 263, 264 have been fully tightened into locking engagement with the panel post, then the shaft 287 is further rotated, either manually or with a tool, to effect relative movement of the upper and lower washers 291, 295 toward one another and hence to cause the serrated lower surface 292 on the upper washer 291 to engage the serrated arcuate sectors 279 on the jaw members, thereby locking the jaw members in the inner closed position and preventing them from separating.

During the initial tightening of the connector 260, namely the initial drawing together of the upper and lower washers 291 and 295, the inner conical wall on the upper washer 291 reacts against the sloped wall 278 on the jaw member projections 277, and at the same time, the sloped bottom walls 281 on the jaw member mounting parts react against the upper sloped surface 296 of the bottom washer 295, whereupon the jaw members are thus pulled inwardly so that the inner arcuate surfaces 273 of the jaw members effectively slidingly abut the center shaft 287 so as to provide for proper positioning of the jaw members, and also to provide a connection which tends to prevent loosening thereof.

Figure 58:
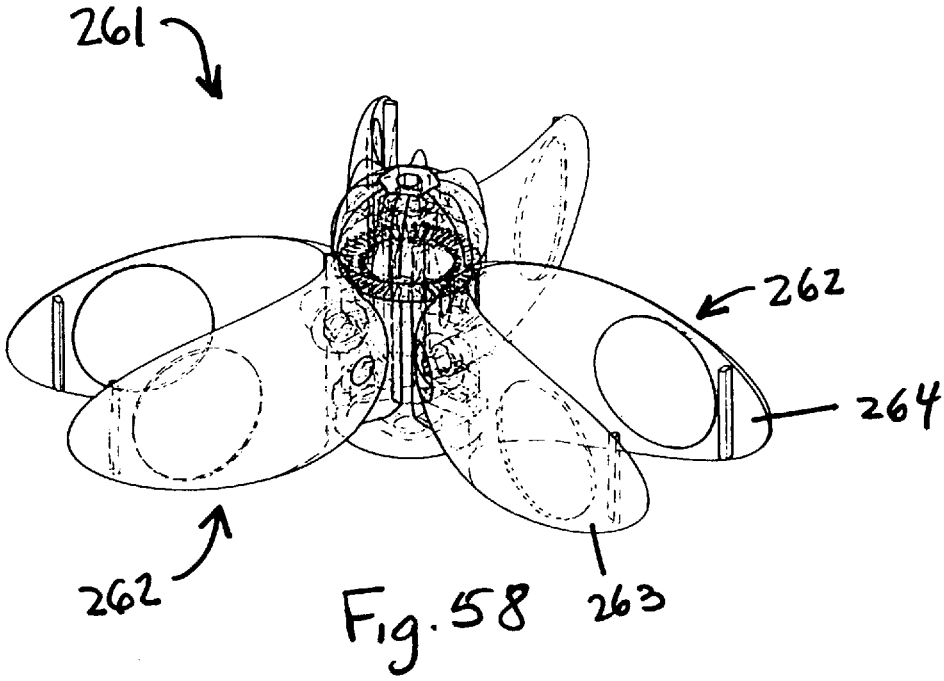
FIG. 58 is a perspective view which illustrates a variation of the panel-to-panel connector having three jaw arrangements for interconnecting three branch panels at a common junction.
Figure 59:
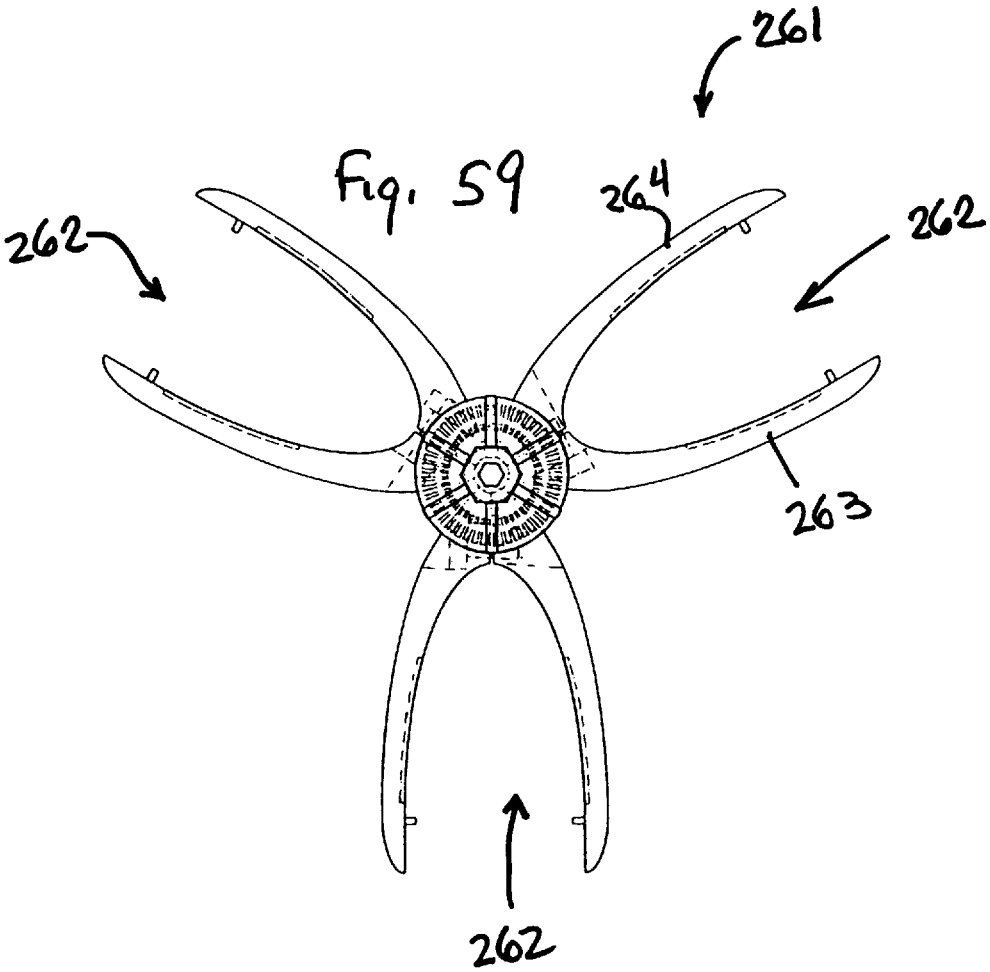
FIG. 59 is a top view of the connector illustrated in FIG. 58.

As illustrated by FIGS. 58 and 59, the panel-to-panel connector 261 when used solely with the branch panels 18 will have two or more jaw arrangements 262 mounted thereon, which jaw arrangements all cooperate with the connecting structure 260 in the same manner as described above.

Figure 61:
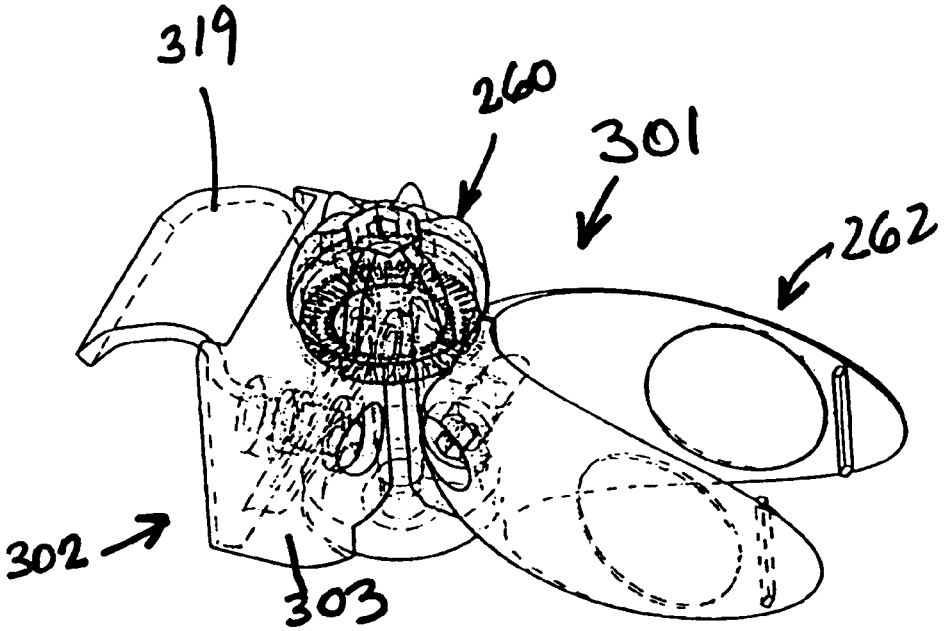
FIG. 61 is a perspective view of a connector which joins a branch panel to a spine panel.
Figure 62:
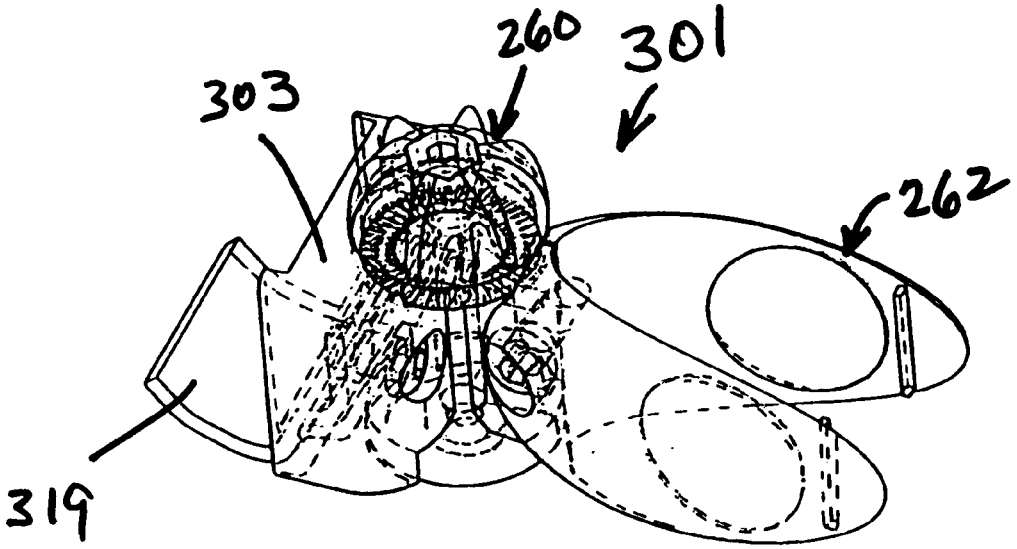
FIG. 62 is a perspective view corresponding to the connector of FIG. 61 but showing the hanger for the spine panel in an inverted position.

While the panel-to-panel connector 261 discussed above is designed for use specifically in connecting two or more divider panels 18, FIGS. 61 and 62 illustrate a modified panel-to-panel connector 301 which is used specifically for connecting a divider panel 18 to a spine or main panel 12.

The modified connector 301 includes a connecting structure 260 which is identical to that associated with the panel connector 261 described above, and in addition includes at least one jaw arrangement 262 for gripping engagement with a post 202 of a branch panel 18, which jaw arrangement 262 is identical to that described above. The connector 301, however, additionally includes a connector arrangement 302 which cooperates directly with the spine panel 12 so as to permit engagement with any one of the hanger slots 45 which are formed in and extend longitudinally along the frame of the spine panel.

The connector arrangement 302 (FIG. 60) includes an intermediate connector member 303 which is of a block-like configuration, and on one side thereof has a generally semi-cylindrical recess 304 formed therein and extending vertically throughout the length thereof, which recess accommodates therein the connector shaft 287. The member 303 also has, at the upper end thereof, a substantially semi-cylindrical guide hub 305 which projects upwardly and which is generally generated concentrically relative to the recess 304. The guide hub 305 has an outer sloped or generally truncated conical surface 307 which generally conforms with the inner sloped wall defined on the top washer 291. The bottom of the member 303 also has a generally semi-cylindrical recess 306 formed therein and opening upwardly from the bottom wall thereof for accommodating the bottom washer 295. The recess 306 is bounded by an upper wall which has a sloped configuration which is generally compatible with the sloped upper surface 296 of the bottom washer 295.

The top wall 308 of member 303 also has a substantially semi-cylindrical recess 309 which opens downwardly in generally concentric relationship to the hub 305, and the bottom wall of this recess is provided with a sector surface 310 which is toothed or serrated for mating engagement with the serrated annular surface 292 defined on the bottom of the top washer 291.

The connector arrangement 302 also includes a hanger part 311 which, at one end, has a flat plate-like portion 312 which is positionable within a shallow guide channel 313 formed in the connecting member 303, whereby the plate-like portion overlies and abuts the flat vertical surface 314 defined by the channel 313. The hanger part 311 is fixedly connected to the mounting part 302 by a pair of threaded fastener devices which include threaded bolts 315 which project through a pair of stepped bores 316 formed horizontally through the connecting member 303, which bores are disposed on opposite sides of the semi-cylindrical recess 304 and project through the back surface 314. Similar holes 317 are formed through the plate-like portion 312 for alignment with the bores 316, and the fasteners project therethrough and accommodate thereon threaded nuts 318 which are tightened down against the plate-like portion to fixedly secure the hanger part 311 and connecting member 303 together.

The hanger part 311 includes, at the other end thereof, a cantilevered plate-like hanger portion 319 which, in vertical cross-section, has a curved or arcuate configuration which substantially identically corresponds to the configuration of the spine wall hangers described above so as to fit in the hanger slots 45. The hanger portion 319 and the plate-like mounting portion 312 are, in the illustrated embodiment, joined by an offset intermediate portion 321 which provides sufficient clearance so as to permit the nuts 318 to be accommodated without interfering with the covering tile of the spine panel.

The hanger part 311 can be oriented with the hanger portion upwardly as illustrated in FIG. 61, thereby resulting in the hanger part being particularly suitable for connection within a hanger slot 45 associated with one of the upper cross beams, preferably the top cross beam, of the spine panel. In addition, a further connector 301 is preferably provided for connecting the spine and main panels adjacent the lower ends thereof, and in this case the hanger part 311 will be reversely oriented as it is mounted on the connecting member 303 so that the hanger portion 319 will hence be disposed downwardly as shown in FIG. 62, the hook configuration thus being curved upwardly, so that the hanger part can be properly engaged within the hanger slot 45 associated with the lower crossbeam 27B of the spine panel. In this manner, since the upper hanger part has an arcuate downward gripping engagement with a top cross beam, and the lower hanger part has an upward gripping engagement with the lower cross beam, a secure and strong connection of the branch panel to the spine panel can be achieved. At the same time, however, the connector arrangement 302 and its cooperation with the slots 45 formed in the spine panel enables the hanger arrangement to be positioned longitudinally anywhere along the spine panel, and the user thus has unlimited flexibility with respect to positioning of the branch panel longitudinally along the spine wall.

Figure 60:
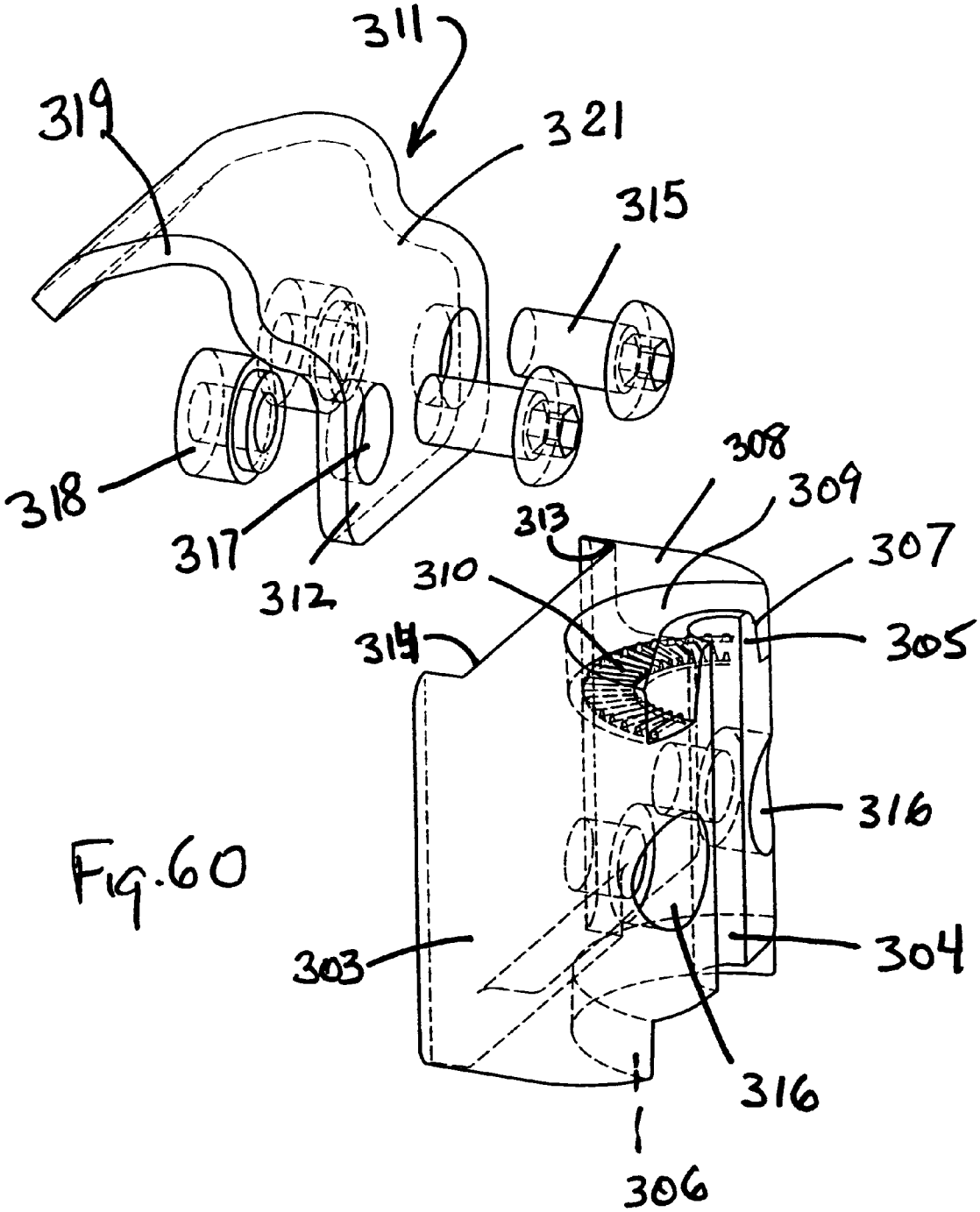
FIG. 60 is an exploded perspective view of a hanger arrangement which cooperates with the connector of FIGS. 61 and 62 for permitting connection between spine and branch panels.

While the connector arrangement 302 of FIGS. 60–62 is illustrated as having a hanger 319 thereon for cooperation with a spine panel, it will be appreciated that the connector 302 can also be suitably modified for connection to an opposed flat surface associated with an upright member. For example, the connector 302 can have the hanger 319 eliminated, and can be provided with a generally flat surface which permits the connector to abut a flat upright surface, and then be fixed thereto by screws or the like, whereupon the overall connector arrangement employing the modified connector 302 thus permits the connector as joined to one edge of an upright panel to be joined to any other upright structure.

Figure 65:
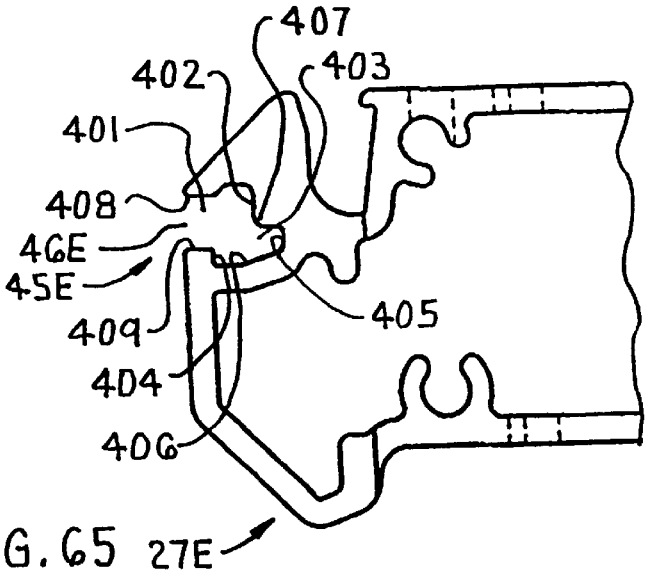
FIG. 65 is an enlarged fragmentary sectional view of one side of the modified support beam of FIGS. 63 and 64.
Figure 64:
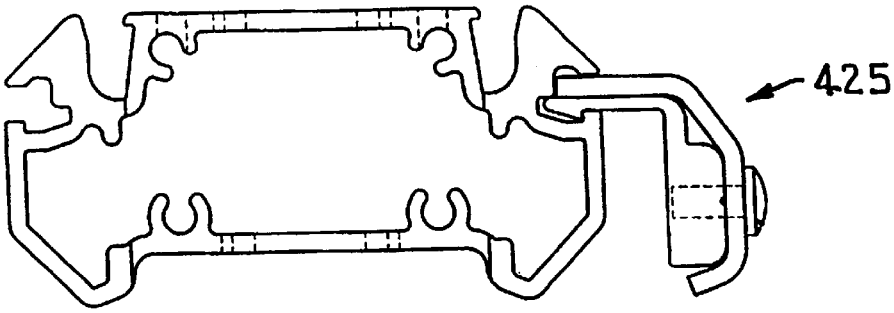
FIG. 64 is a sectional view similar to FIG. 63 but showing the modified support beam and modified hanger assembly joined together.
Figure 63:
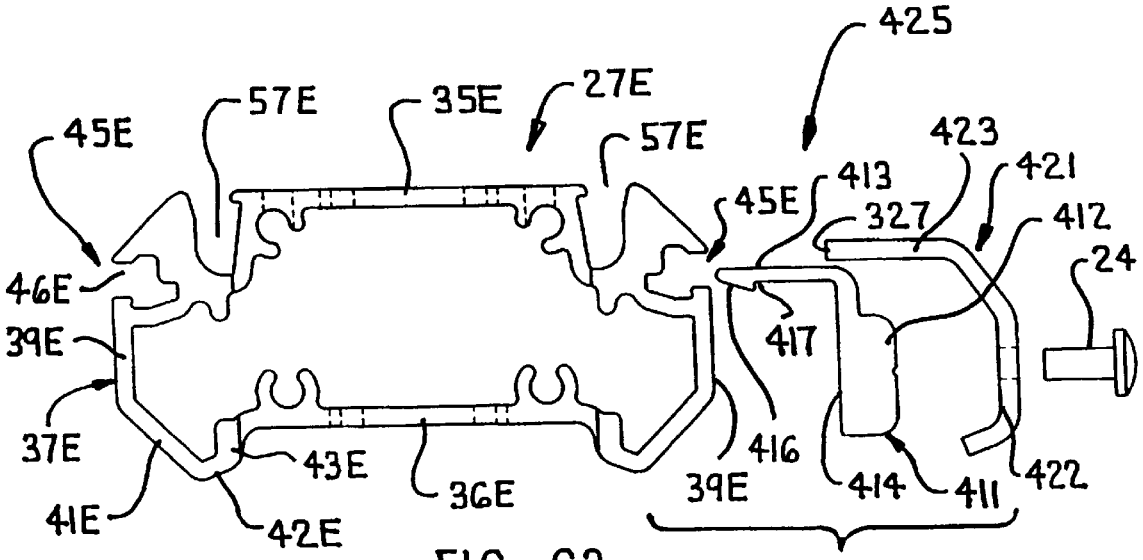
FIG. 63 is an enlarged cross-sectional view similar to FIG. 13 but illustrating a modified support beam, as well as a modified hanger assembly for use with the modified support beam.

Referring now to FIGS. 63–65, there is illustrated in cross section a modified support beam, and a modified hanger arrangement for use therewith, which modified support beam is used in place of the support beam 27 associated with the wall system of FIGS. 1–40 described above.

More specifically, the modified support beam 27E possesses many of the same structural and functional relationships possessed by the support beam 27 described above, particularly as illustrated in FIG. 13, and hence corresponding parts of the modified support beam 27E are designated by the same reference numerals but with addition of an "E" thereto.

The modified support beam 27E has a generally similar construction in that it is defined generally as an elongate hollow tube having generally parallel top and bottom walls 35E and 36E respectively, joined by outwardly protruding convex side walls 37E, the latter having generally flat center wall portions 39E which extend generally vertically. Each of the convex side walls 37E has a hanger slot or groove 45E formed therein and extending longitudinally of the support beam along the entire length thereof. The slot 45E is designed to accommodate therein hangers or brackets for branch panels or load bearing components, and one embodiment of a hanger assembly 425 used for cooperation with the hanger slot 45E is illustrated.

The hanger slot 45E has a narrow mouth 46E formed generally in the plane of the vertical wall part 39E, which narrow mouth is defined vertically between upper and lower edge walls 408 and 409, respectively. The narrow mouth 46E opens inwardly of the beam for communication with an enlarged inner slot portion 401 which projects horizontally inwardly from the mouth 46E and terminates at a rear wall 402. The upper inner slot portion 401 also communicates with a lower slot portion 403 which extends between an outer wall 404 which opens downwardly from the bottom mouth wall 409, and a rear wall 405 which is spaced rearwardly from the rear wall 402 and is joined thereto by a top wall 407. The lower inner slot portion 403 as it extends between the opposed walls 404 and 405, in the illustrated embodiment, is in part sloped slightly upwardly as it projects toward the rear wall 405. The top wall 407 is at an elevation whereby it is disposed between the upper and lower walls 408–409 which define the width of the mouth 46E.

The slot 45E associated with the support beam 27E, due to the presence of the mouth 46E and its open communication with the inner upper slot portion 401 which terminates at the rear wall 402, which upper slot portion vertically communicates with the lower inner slot portion 403 which extends between the walls 404 and 405, results in the slot 45E, when viewed in cross section, having a generally Z-shaped cross section, the upper leg of the Z being defined generally by the mouth 46E and the inner upper slot portion 401, and the lower leg of the Z-shaped slot being defined by the lower slot portion 403.

The modified hanger arrangement 425 which cooperates with the modified support beam 27E is, in the illustrated arrangement, defined by two principal parts, namely a hanger or hook member 411 and a locking member 421. The hanger member 411 includes a main body 412 which is adapted for attachment to a bracket or other structure used for connection to an exterior component or branch panel. The hanger member 411 has a hook part 413 which is cantilevered generally horizontally inwardly from the upper part of the main body 412, which cantilevered hook part 413 has a thin plate-like construction and, adjacent the free end thereof, terminates in a tang or hook 416, the latter having a lower surface which is tapered so as to slope downwardly as it projects away from the free end of the hook and terminates at a rear hooklike shoulder 417.

The hanger member 411 is adapted to be inserted into the slot 45E by initially angularly tilting the hanger member counterclockwise in FIG. 63 so that the cantilevered hook part 413 slopes slightly downwardly in alignment with the mouth 46E, whereupon the hook part 413 is inserted through the mouth 46E into the lower inner slot portion 403 until the free end of the hook part 416 substantially abuts the rear wall 405. The hanger member 411 is then reversely angularly tilted back to the original position substantially as illustrated in FIGS. 63–64, whereupon the hook shoulder 417 is positioned behind the wall 404, with the lower surface of hook part 413 bearing against the lower mouth surface 409, and the upper surface of the hook part 416 bearing against the top wall 407. The hook part is thus locked in the slot 45E in that it can not be horizontally withdrawn from the slot, but rather can be removed only by reversing the installation process, namely by first pivoting the hook part upwardly, followed by withdrawal of the hook from the slot.

After the hook part 411 has been inserted into and mounted in the slot as described above, then the locking part 421 is mounted on the hook part 411 and inserted into the slot 45E substantially as illustrated in FIG. 64 so as to positively lock the hanger member 411 in engagement within the slot 45E.

The lock member 421 includes a body part 422 which engagingly overlies part of the main hanger body 412, and which includes a top platelike locking part 423 which is cantilevered generally horizontally inwardly so as to directly overlie the hanger hook part 413. The thickness of the platelike locking part 423 is such that it can be slidably inserted through the upper portion of the mouth 46E into the inner upper slot portion 401, with the free end of the platelike lock part 423 being disposed to substantially abut the rear wall 402. With the hanger member 411 and locking part 421 engaged in the slot substantially as illustrated by FIG. 64, then the hanger member 411 and locking member 421 are fixedly secured together by an appropriate fastener, such as a screw 424 which extends through an appropriate opening in the locking member 421 for threaded engagement with the body part of the hanger member 411.

Figure 66:
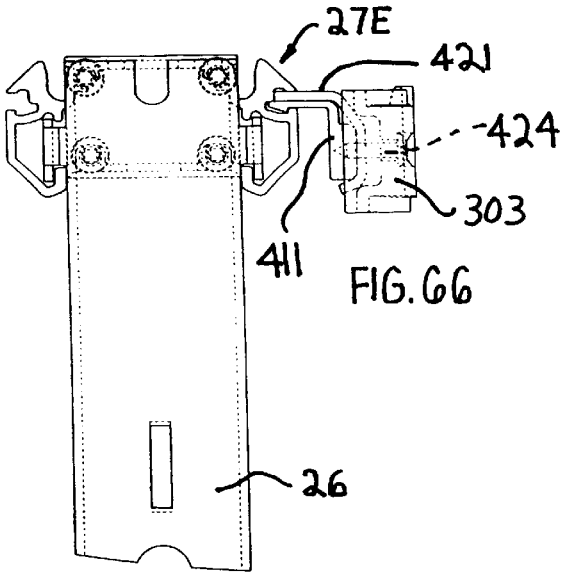
FIG. 66 is a fragmentary elevational view which illustrates the modified hanger assembly used for connection to the intermediate connector member of FIG. 60.

With the hanger arrangement 425 as described above, and its cooperation with the slot 45E, the hanger member 411 will be initially inserted into the slot, which insertion requires that the hanger be angularly tilted (counterclockwise in FIG. 63) into an angle of about 30° relative to the horizontal, whereupon the cantilevered hanger part 413 can be inserted through the mouth 46E into the lower slot portion 403, following which the hanger is then reversely angularly tilted back to its original position causing the hanger member to assume the position substantially as illustrated in FIG. 64. The locking member 421, if a separate member, is then positioned so that the cantilevered locking part 423 projects into the slot substantially as illustrated in FIG. 64. An exterior component such as a branch panel can then be joined to the hanger structure, such as by means of the intermediate connector 303 (FIG. 60) of connector 301, which intermediate connector 303 as shown in FIG. 66 is positioned for engagement with the locking member 421. The fastener 424 is then inserted through the component wall (i.e., member 303) and the locking member 421, and is threadably screwed into the body of the hanger 411 to fixedly connect the hanger to the external component.

Further, since the fastener 425 extends in a direction which is generally parallel with the elongated overlapping directions of the cantilevered hook and lock parts 413 and 423 respectively, the tightening of the fastener 424 tends to draw the hook member 411 and locking member 421 horizontally toward one another. This thus causes the shoulder 417 of tang 416 to be drawn up tightly against the wall or shoulder 404, and at the same time the free end surface 427 of the lock member abuts the rear surface 402, thereby effecting tight securement of the hanger arrangement within the slot so as to eliminate any looseness or slop. The overall arrangement thus results in the exterior component when connected to the wall panel through the hanger arrangement to have a very tight and rigid structural connection, and ensures that the hanger arrangement can not be accidentally dislodged or disconnected.

Figure 67:
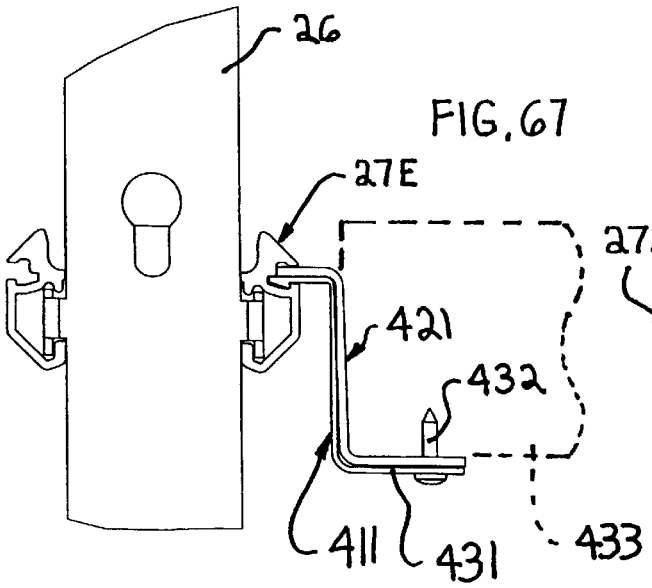
FIG. 67 is a fragmentary elevational view which illustrates the modified hanger arrangement used for supporting an object such as a worksurface.

Another example of the modified hanger arrangement is illustrated in FIG. 67 wherein hanger member 411 and locking member 421 cooperate with the slot formed in the support beam in the same manner as described above, except that in this situation the hanger member 411 and hook part 421 are each of a generally Z-shaped configuration and are disposed so as to generally overlie one another, and have overlying lower legs 431 which project outwardly away from the upright and accommodate therethrough a threaded fastener 432 for securing the locking member and hanger member together. This fastener 432 can also penetrate upwardly for engagement with a component 433, such as a worksurface. With this arrangement, the worksurface 433 adjacent the front edge thereof will be independently supported by a suitable leg or pedestal extending vertically between the worksurface and the floor.

Figure 68:
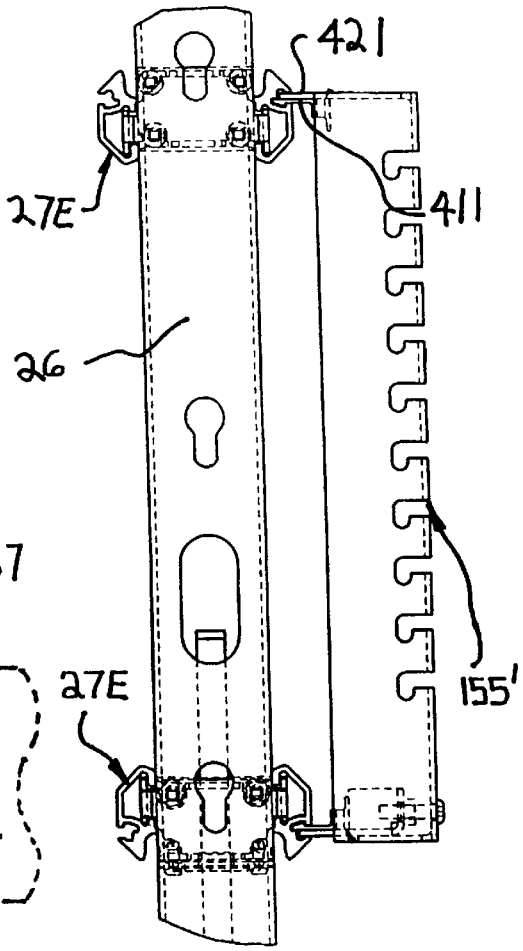
FIG. 68 is a fragmentary elevational view which illustrates the modified hanger arrangement used in conjunction with a support bracket which in turn mounts thereon removable components such as a worksurface or a storage bin.

A still further variation is illustrated in FIG. 68 wherein the modified hanger arrangement cooperates between a pair of vertically spaced support beams 27E and upper and lower ends of a support bracket or hanger 155' which, similar to the hanger 155 described above, permits a component such as a worksurface or an overhead storage bin to be removably mounted thereon. In this variation the top and bottom walls of the hanger 155' are formed so as to have the locking members 421 fixedly associated therewith and protruding rearwardly from the support bracket so as to permit insertion into the respective support beam slot. The hanger member 411, which is formed as a separate part, typically abuts against a rear surface of the bracket 155' to assist in proper positioning of the bracket. The hanger member and locking part are again fixedly secured, as by a screw, which can project horizontally or vertically between the locking and hanger members since, in this variation, the bracket 155' has hangers associated with the upper and lower ends thereof, and this ensures that the hangers and associated locking members are snugly seated within the respective slots.

The modified support beam 27E also includes therein grooves or slots 57E which are disposed adjacent opposite sides of the support beam and open upwardly through the top wall 35E thereof adjacent opposite longitudinally side edges of the top wall. These elongate slots 57E replace the rows of slots 57 associated with the beam 27 as illustrated in FIG. 11. The continuous elongate slots 57E receive therein the fingers 88 (FIG. 21) associated with the lower securing flange of the removable cover tiles or pads 21. With this variation of the support beam, however, the downwardly projecting securing fingers 88, instead of being defined by a plurality of longitudinally spaced individual fingers, can be replaced by a continuous finger or flange extending longitudinally along the bottom securing flange.

The modified support beam 27E can be constructed as an aluminum extrusion, either a one-piece extrusion or a multiple-piece extrusion, with the multiple pieces being appropriately welded together to define a one-piece construction. The support beam 27E, if constructed of aluminum, will typically be fixedly secured to the upright posts 26 in the manner illustrated in FIG. 15 by means of appropriate fasteners such as self-tapping screws or the like.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A load-bearing spine wall comprising rigidly connected spine panels, each said spine panel including an interior frame having plural hollow cross beams rigidly joined between parallel uprights, the cross beams having elongate slots extending lengthwise along the side walls thereof, each side of the frame permitting one or more removable covering tiles to be attached thereto for defining the exterior surface of the spine panel, load-bearing components having cantilevered hangers engaged within the elongate slots which extend lengthwise of the cross beams, and vertically adjacent said tiles having longitudinal edges spaced to define a narrow elongate passage therebetween which aligns with the mouth of a respectively adjacent hanger-accommodating slot.

2. A load-bearing spine wall, comprising a plurality of upright spine panels rigidly connected horizontally in series, each said spine panel including an interior frame having plural hollow cross beams disposed in vertically spaced relation and extending between and rigidly joined to a pair of horizontally spaced parallel uprights, the cross beams having opposite outwardly-facing side walls which are disposed on and accessible from opposite sides of the spine panel, each said side wall having an elongate hanger-accommodating slot extending lengthwise therealong and opening inwardly thereof, each said side of the frame permitting one or more removable covering tiles to be attached thereto for defining an exterior surface of the spine panel, vertically adjacent said covering tiles having adjacent longitudinal edges spaced to define a narrow passage therebetween which aligns with the mouth of a respectively adjacent said hanger-accommodating slot, and a load-bearing component at least partially mounted on said panel adjacent one side thereof, said component having a cantilevered hanger which projects into and is engaged within said hanger-accommodating slot, said hanger-accommodating slot having a vertically narrow mouth which opens inwardly from the respective side wall of the support beam and which communicates with an interior slot portion which opens downwardly from said mouth, said interior slot portion having opposed top and bottom walls which snugly confine the hanger therein, whereby said hanger can be inserted into or removed from said slot only by effecting angular tilting movement of the hanger within a plane generally transverse to the longitudinal direction of the slot.

3. A wall arrangement according to claim 2, wherein said hanger-accommodating slot includes an upper slot portion which is generally horizontally aligned with the mouth as formed in said side wall and opens inwardly therefrom, and a lower slot portion which communicates with and projects downwardly from said upper slot portion to an elevation below a lower edge of said mouth and terminating at said bottom wall, and one of said upper and lower slot portions being defined at least in part by said top wall, said hanger including a cantilevered hanger member having a downwardly projecting hook part adjacent a free end thereof with said hanger member being positionable in said slot so that the hook part projects into the lower slot portion below the lower edge of said mouth, and said hanger also including a cantilevered locking member which projects through the mouth into the upper slot portion and overlies the cantilevered hanger member, one of said members being positioned closely adjacent the top wall, whereby the hanger member can not be withdrawn from the slot without first withdrawing the locking member.

4. A wall arrangement according to claim 2, wherein the hanger includes a cantilevered hanger member having a downwardly projecting hook part at a free end thereof and being insertable into the hanger-accommodating slot for creating a hooked engagement with the respective side wall, the hanger also including a cantilevered locking member which is insertable into the slot in direct overlying relationship with the cantilevered hanger member so that the vertical overlying hanger and locking members occupy substantially the full height of the mouth of the slot and prevent the hanger member from being withdrawn from the slot without first withdrawing the locking member.

5. A wall arrangement according to claim 2, wherein the slot has an arcuate configuration which curves downwardly as it projects horizontally inwardly from the mouth, and the cantilevered hanger having a similar downwardly-curved arcuate configuration as it projects toward the free end thereof for disposition within the slot.

6. A wall arrangement according to claim 2, wherein the hollow support beam has a pair of upwardly-opening slot arrangements formed in and extending lengthwise along a top wall of the support beam adjacent opposite longitudinally-extending sides thereof, and the removable covering tiles having attaching clips along a lower edge thereof provided with downwardly cantilevered attaching flanges which project into said slot arrangements for permitting lower edges of the cover tiles to be removably mounted on the support beams.

7. A wall arrangement according to claim 2, wherein the support beams have notches which extend vertically therethrough and open inwardly from opposite ends thereof, said notches having a width which generally corresponds to the width of the upright so as to accommodate the upright therein, the width of the notch being less than the width of the support beam so that the support beam has cantilevered portions which define opposite sides of the notch and which embrace the upright therebetween, the cantilevered portions extending across exterior side faces of the upright so that serially adjacent panels can have the horizontally aligned support beams thereof positioned in closely adjacent and substantially abutting engagement to effect a substantially continuous hanger-accommodating slot along the horizontally-aligned support beams of adjacent panels.

8. A wall arrangement according to claim 7, wherein first and second said support beams which respectively define uppermost and lowermost support beams of said interior frame are reversely vertically oriented relative to the uprights to which they are fixed.

9. A wall arrangement according to claim 2, wherein said support beam has a bottom wall which is spaced downwardly from said top wall, and opposite longitudinally extending edges of said bottom wall being joined to respectively adjacent side walls through intermediate wall parts which are cantilevered vertically downwardly, and said removable tiles having securing flanges which are fixed to and project rearwardly from upper edges of the tiles for creating a resilient snap engagement with the downwardly cantilevered intermediate wall parts.

10. An upright space-dividing wall arrangement defined by at least two upright wall panels which are joined together in horizontally adjacent and aligned relationship, each said wall panel including an interior frame which includes a pair of horizontally spaced and generally parallel uprights which define opposite edges of the panel and which have lower end parts disposed for supportive engagement with a floor, the panel mounting on the frame a side cover arrangement which closes off the interior of the frame and extends generally from an upper edge of the frame to a lower edge which is spaced upwardly from the floor, the lower end parts of the uprights extending vertically between the floor and the lower edge of the side cover arrangement, the uprights extending along the adjacent edges of the two serially adjacent panels being positioned sidewardly directly adjacent and fixedly connected to one another, and a shroud arrangement positioned to encircle the lower end parts of said adjacent uprights and extend vertically between said floor and the lower edge of the side cover arrangement, said shroud arrangement including upper and lower shroud members which are vertically telescopically supported one on the other to accommodate variations in height between the floor and the bottom edge of the side cover arrangement.

11. A wall arrangement according to claim 10, wherein the shroud arrangement is divided vertically into substantially identical opposed halves which horizontally couple together for enclosing the lower leg parts therebetween, each half of said shroud cooperating with a respective said lower leg part.

12. A wall arrangement according to claim 10, wherein the upper shroud member is connected to and suspended downwardly from the lowermost support beam of the respective panel, and the lower shroud member is supportively engaged with the floor.

13. A wall arrangement according to claim 10, wherein the shroud in horizontal cross section is elongated in the longitudinal direction of the panel support beams and defines therein a vertical clearance space for accommodating cabling.

14. A portable, upright, non-load-bearing, space divider panel, comprising a pair of generally parallel and horizontally spaced upright support legs having lower ends adapted for supportive engagement with a floor, a plurality of generally horizontally elongate cross beams including top and bottom cross beams disposed in vertically spaced relationship and extending between and having opposite ends thereof fixedly connected to said uprights for defining a rigid frame, said cross beams being defined by horizontally elongate tubes having a width which is less than the width of said uprights, said cross beams having openings associated with the side-facing walls thereof, at least one removable cover tile positioned adjacent each side of the frame and having rear spring clips which engage within the openings of the cross beam, said cover tile being disposed vertically so as to substantially occupy a region adjacent one side of the cross beams so that an outer surface of the cover tile is substantially flush with outer side edges of the uprights.

15. A wall panel according to claim 14, wherein a plurality of said removable cover tiles are disposed adjacent at least one side of said frame and are positioned in vertically adjacent relationship one above the other, the vertically adjacent longitudinally extending edges of adjacent upper and lower said cover tiles being adjacent but slightly vertically spaced to define a horizontally elongate clearance passage therebetween which horizontally aligns with one of said cross beams.

* * * * *